US010166769B2

(12) United States Patent
Mu et al.

(10) Patent No.: US 10,166,769 B2
(45) Date of Patent: Jan. 1, 2019

(54) INKJET PRINTHEAD WITH MULTIPLE ALIGNED DROP EJECTORS

(71) Applicant: RF Printing Technologies LLC, Pittsford, NY (US)

(72) Inventors: Richard Mu, Irvine, CA (US); Yonglin Xie, Rochester, NY (US)

(73) Assignee: RF Printing Technologies LLC, Pittsford, NY (US)

( * ) Notice: Subject to any disclaimer, the term of this patent is extended or adjusted under 35 U.S.C. 154(b) by 50 days.

(21) Appl. No.: 15/182,145

(22) Filed: Jun. 14, 2016

(65) Prior Publication Data

US 2017/0355190 A1 Dec. 14, 2017

(51) Int. Cl.
*B41J 2/14* (2006.01)

(52) U.S. Cl.
CPC ..... *B41J 2/1404* (2013.01); *B41J 2/14016* (2013.01); *B41J 2/14201* (2013.01); *B41J 2002/14185* (2013.01); *B41J 2202/11* (2013.01)

(58) Field of Classification Search
CPC . B41J 2/155; B41J 2/2146; B41J 2/515; B41J 2202/20; B41J 2/1404; B41J 2/14201; B41J 2/14016; B41J 2002/14185; B41J 2202/11
See application file for complete search history.

(56) References Cited

U.S. PATENT DOCUMENTS

| | | | | |
|---|---|---|---|---|
| 6,565,196 | B2 * | 5/2003 | Matsuo | B41J 2/14233 347/68 |
| 6,991,318 | B2 | 1/2006 | Silverbrook | |
| 7,163,278 | B2 | 1/2007 | Lee et al. | |
| 7,300,127 | B2 | 11/2007 | Konno | |
| 8,118,405 | B2 | 2/2012 | Xie et al. | |
| 2005/0168539 | A1 | 8/2005 | Billow et al. | |

FOREIGN PATENT DOCUMENTS

| | | |
|---|---|---|
| JP | 10-151735 | 6/1998 |
| JP | 10-157135 | 6/1998 |

* cited by examiner

*Primary Examiner* — Geoffrey S Mruk
(74) *Attorney, Agent, or Firm* — Gary A. Kneezel

(57) ABSTRACT

An inkjet printhead includes a two-dimensional array of drop ejectors arranged as a plurality of columns, each column including a plurality of banks, and each bank including a plurality of groups that each include a plurality of drop ejectors. The drop ejectors in each group are substantially aligned along a first direction. The groups in each bank are spaced from each other along the first direction and are offset from each other along a second direction. The banks in each column are spaced from each other along the first direction and are offset from each other along the second direction. The columns are offset from each other along the second direction. The two-dimensional array has a width W along the first direction and a length L greater than W along the second direction. Each drop ejector includes a nozzle, an ink inlet, a pressure chamber and an actuator.

27 Claims, 29 Drawing Sheets

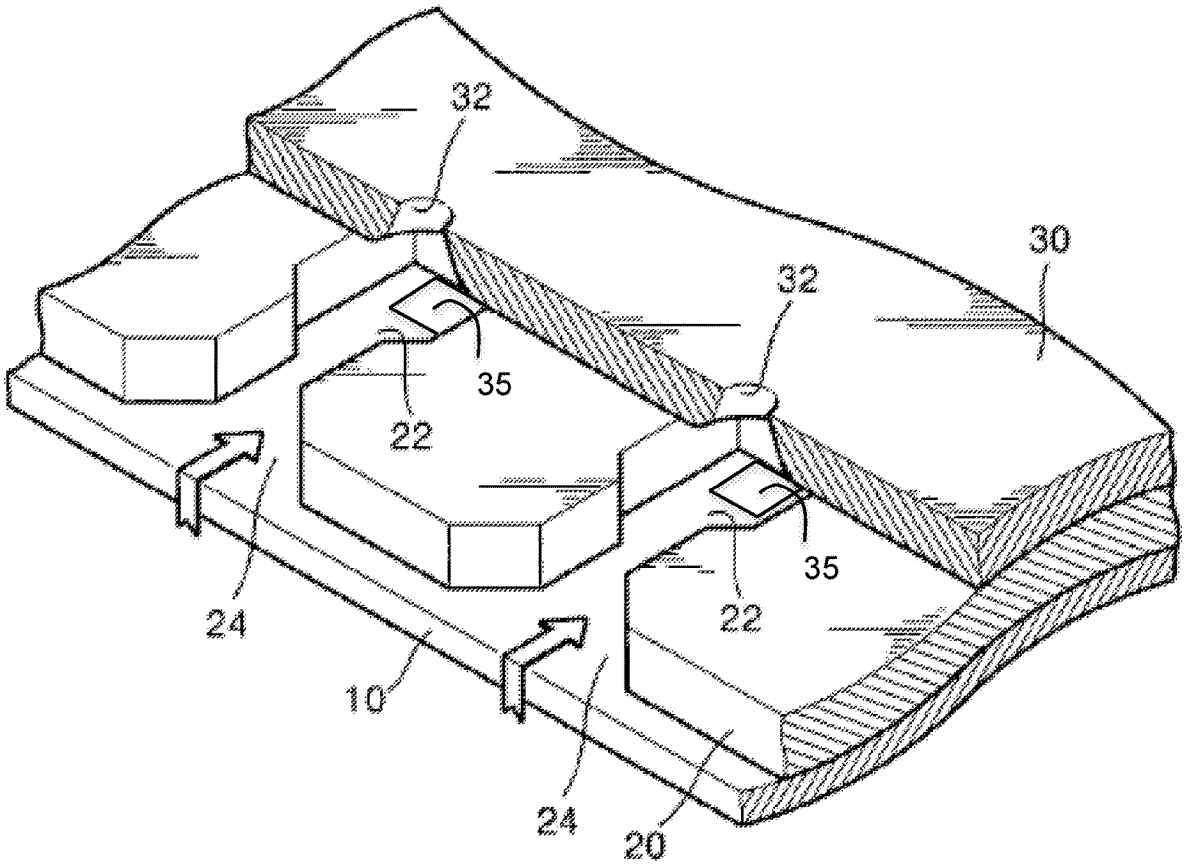
FIG. 1 – PRIOR ART

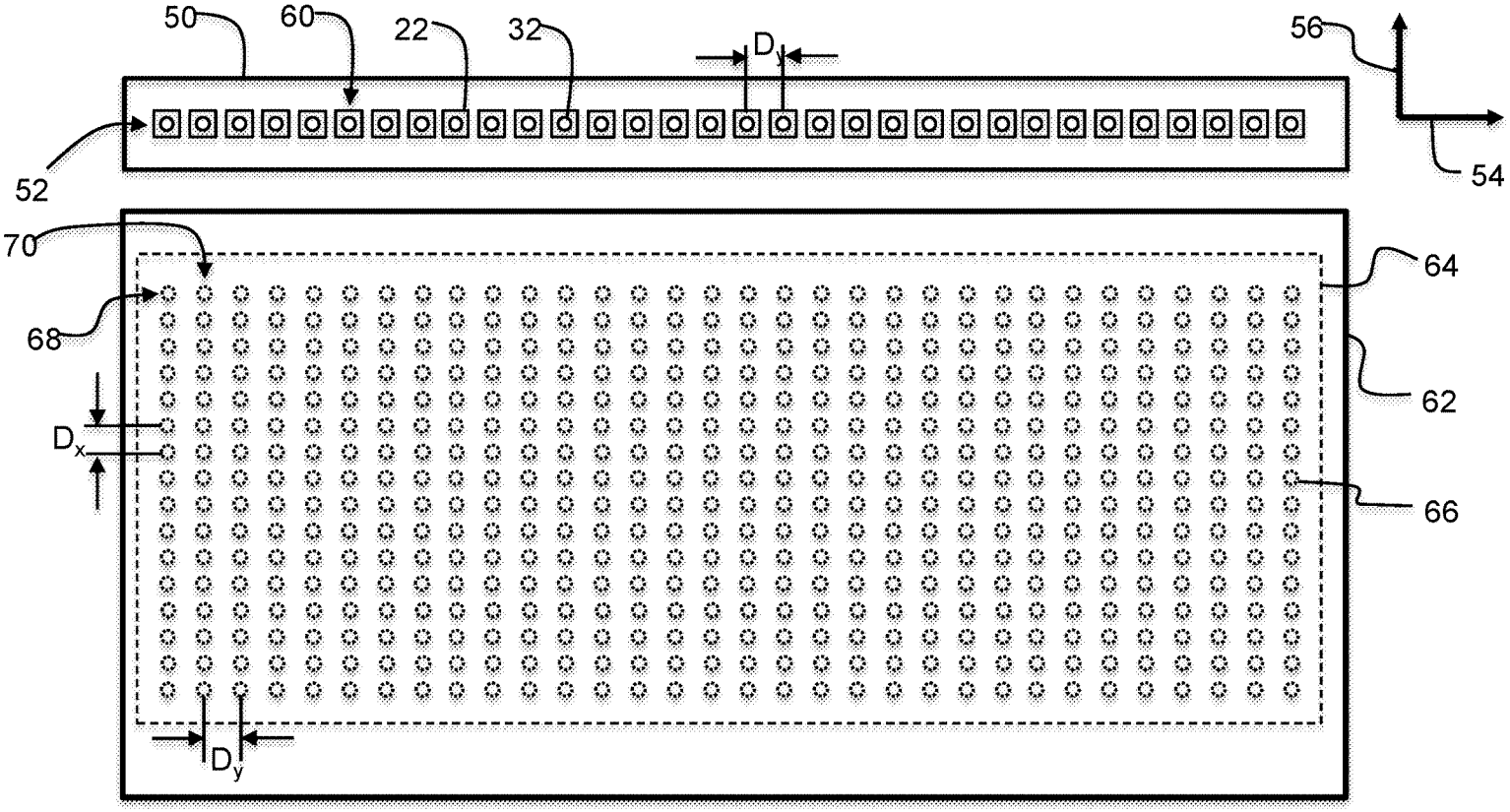
FIG. 2 – PRIOR ART

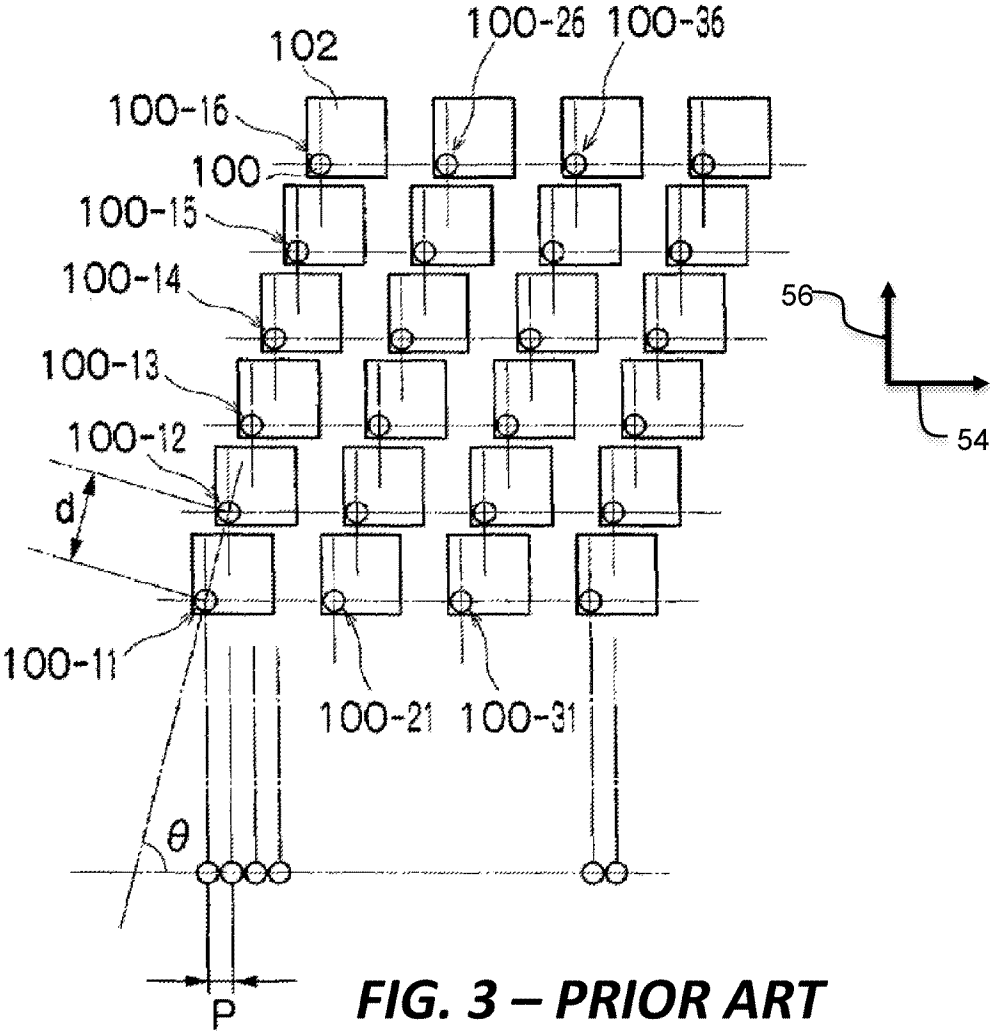
FIG. 3 – PRIOR ART

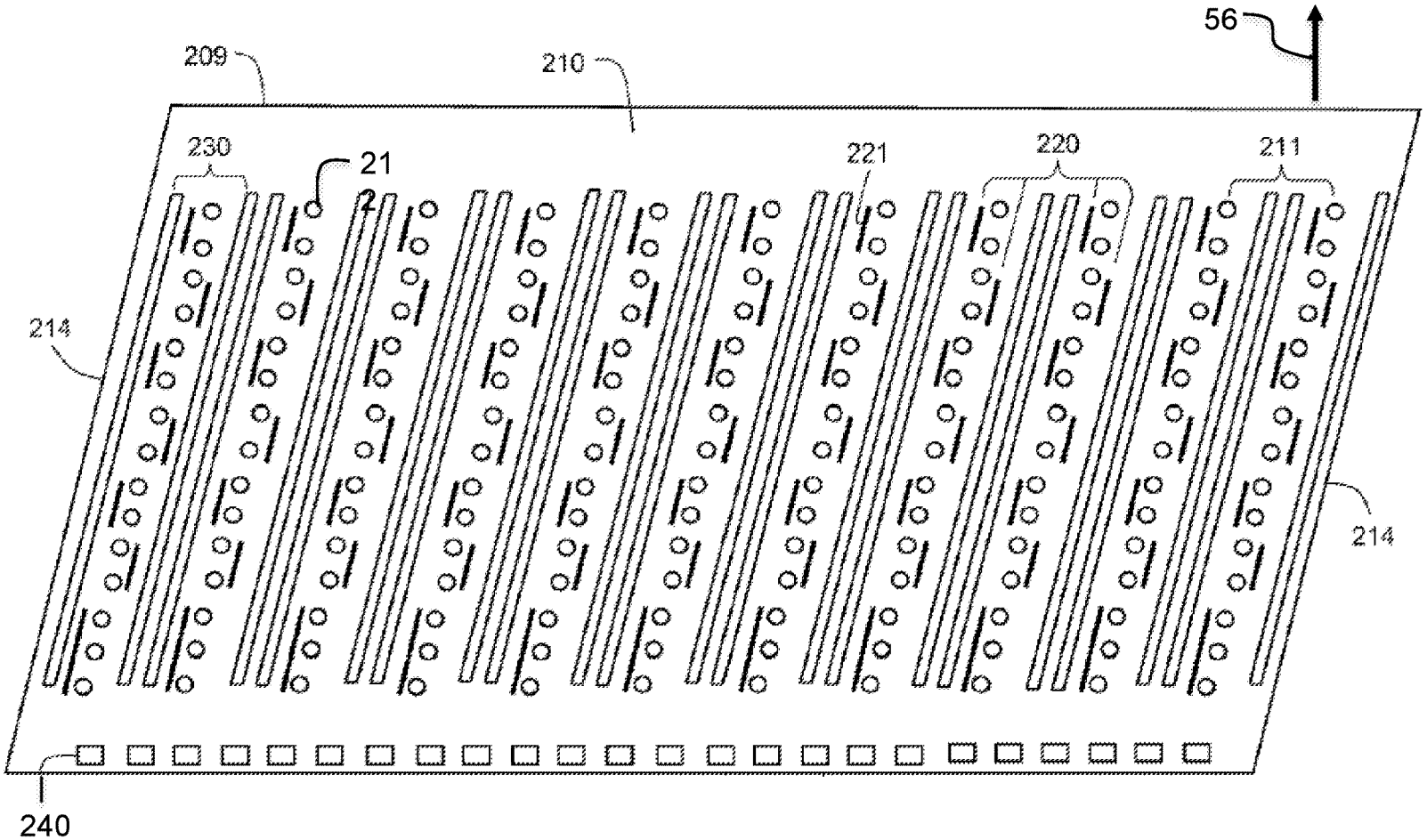
FIG. 4 – PRIOR ART

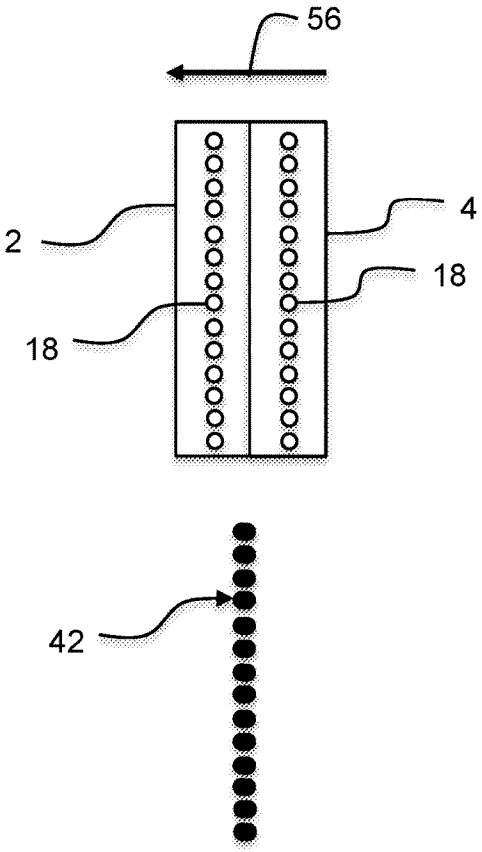
FIG. 5B – PRIOR ART
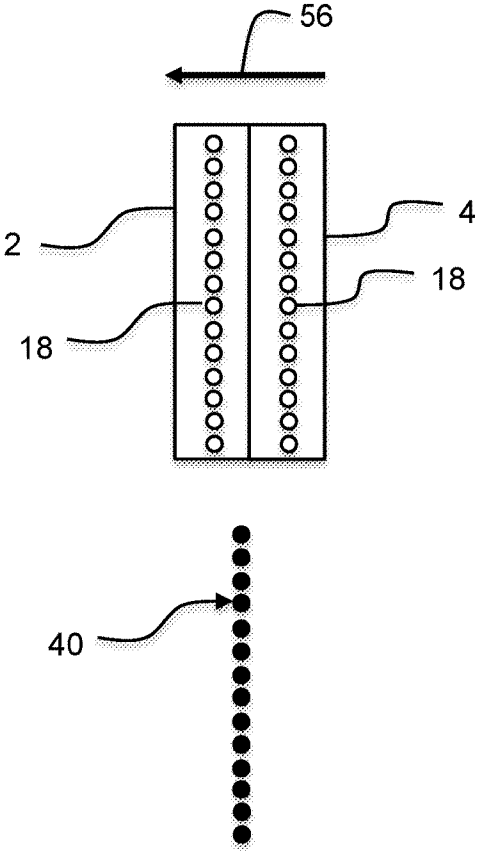
FIG. 5A – PRIOR ART

FIG. 20 – PRIOR ART

INKJET PRINTHEAD WITH MULTIPLE ALIGNED DROP EJECTORS

CROSS-REFERENCE TO RELATED APPLICATIONS

Reference is made to commonly assigned, U.S. patent application Ser. No. 15/182,185, entitled: "Printing Method with Multiple Aligned Drop Ejectors", by Mu et al. filed concurrently herewith, which is incorporated herein by reference.

FIELD OF THE INVENTION

This invention pertains to the field of inkjet printing and more particularly to a drop ejector arrangement for high speed, high reliability, high resolution printing.

BACKGROUND OF THE INVENTION

Inkjet printing is typically done by either drop-on-demand or continuous inkjet printing. In drop-on-demand inkjet printing ink drops are ejected onto a recording medium using a drop ejector including a pressurization actuator (thermal or piezoelectric, for example). Selective activation of the actuator causes the formation and ejection of a flying ink drop that crosses the space between the printhead and the recording medium and strikes the recording medium. The formation of printed images is achieved by controlling the individual formation of ink drops, as is required to create the desired image.

Motion of the recording medium relative to the printhead during drop ejection can consist of keeping the printhead stationary and advancing the recording medium past the printhead while the drops are ejected, or alternatively keeping the recording medium stationary and moving the printhead. This former architecture is appropriate if the drop ejector array on the printhead can address the entire region of interest across the width of the recording medium. Such printheads are sometimes called pagewidth printheads. A second type of printer architecture is the carriage printer, where the printhead drop ejector array is somewhat smaller than the extent of the region of interest for printing on the recording medium and the printhead is mounted on a carriage. In a carriage printer, the recording medium is advanced a given distance along a medium advance direction and then stopped. While the recording medium is stopped, the printhead carriage is moved in a carriage scan direction that is substantially perpendicular to the medium advance direction as the drops are ejected from the nozzles. After the carriage has printed a swath of the image while traversing the print medium, the recording medium is advanced; the carriage direction of motion is reversed; and the image is formed swath by swath.

A drop ejector in a drop-on-demand inkjet printhead includes a pressure chamber having an ink inlet for providing ink to the pressure chamber, and a nozzle for jetting drops out of the chamber. Two side-by-side drop ejectors are shown in prior art FIG. 1 (adapted from U.S. Pat. No. 7,163,278) as an example of a conventional thermal inkjet drop on demand drop ejector configuration. Partition walls 20 are formed on a base plate 10 and define pressure chambers 22. A nozzle plate 30 is formed on the partition walls 20 and includes nozzles 32, each nozzle 32 being disposed over a corresponding pressure chamber 22. Ink enters pressure chambers 22 by first going through an opening in base plate 10, or around an edge of base plate 10, and then through ink inlets 24, as indicated by the arrows in FIG. 1. A heater 35, which functions as the actuator, is formed on the surface of the base plate 10 within each pressure chamber 22 and is configured to selectively pressurize the pressure chamber 22 by rapid boiling of a portion of the ink in order to eject drops of ink through the nozzle 32.

FIG. 2 shows a prior art configuration of drop ejectors 60 disposed as a linear array 52 along an array direction 54 on a printhead 50. For simplicity, only the pressure chamber 22 and the nozzle 32 are shown for each drop ejector 60. The spacing between drop ejectors 60 in linear array 52 along array direction 54 is $D_y$. Recording medium 62 and printhead 50 are moved relative to each other along scan direction 56, and drop ejectors 60 are controllably fired to eject drops of ink toward recording medium 62. Dots are formed on recording medium 62 where ink drops land. Allowable image dot locations 66 are defined by a pixel grid 64 including pixel rows 68 and pixel columns 70. The spacing of pixel columns 70 from each other along the array direction is $D_y$, which is the same as the spacing between drop ejectors 60 in linear array 52. The spacing $D_x$ of pixel rows 68 from each other along the scan direction 56 is related to the timing of firing of drop ejectors 60. For recording medium 62 and printhead 50 moving at constant velocity V relative to each other along scan direction 56, $D_x=Vt=V/f$, where t is the time interval between consecutive firings of drop ejectors 60 and f is the drop ejection frequency. For many types of printheads 50, drop ejectors 60 cannot be all fired simultaneously due to excessive electrical current requirements. In such cases, the linear array 52 is typically not actually a straight line. Rather the drop ejectors 60 are offset as needed in order to compensate for firing at different times so that the ink drops land along substantially straight pixel rows 68 on recording medium 62.

Image resolution $R_x$ along the scan direction 56 is equal to $1/D_x=f/V$. In other words, the print speed $V=f/R_x$. For a desired image resolution along the scan direction, $R_x$ is proportional to the drop ejector frequency f and inversely proportional to print speed. There are physical limitations to the drop ejection frequency f. For example, the pressure chamber 22 needs to refill with ink before a subsequent drop can be fired.

Image resolution $R_y$ along the array direction 54 is equal to $1/D_y$. For a linear array 52, in order to have a high resolution $R_y$, the drop ejector spacing $D_y$ needs to be small. Drop ejectors 60 of various types need to have a certain size to eject sufficiently large drops in order to provide good ink coverage on the recording medium 62. A typical achievable drop ejector spacing $D_y$ for a thermal inkjet drop ejector is 42.3 microns, equivalent to 600 nozzles per inch. By contrast, a typical achievable drop ejector spacing for a piezo inkjet printhead is approximately 254 microns, equivalent to 100 nozzles per inch. Conventional thermal inkjet printheads can provide 1200 spot per inch resolution $R_y$ by providing two staggered linear arrays 52 of drop ejectors 60.

In order to enable high resolution printing for larger drop ejectors, such as piezo drop ejectors, multiple offset rows of drop ejectors can be provided on a printhead, as seen in prior art FIG. 3 adapted from U.S. Pat. No. 7,300,127. Rows of drop ejectors extend horizontally along array direction 54 in FIG. 3. Each drop ejector in the figure includes a pressure chamber 102 and a nozzle **100-*kl*, where l indicates the row number with the first row (l=1) being at the bottom, and k indicates the position within each row and increases toward the right. A first row of drop ejectors includes nozzles 100-11, 100-21, 100-31. A second row of drop ejectors includes nozzles 100-12, 100-22 (not labeled) and 100-32 (not labeled). The second row is offset along the array direction 54 from the first row by a distance P. There are a total of six rows, so the spacing in the array direction 54 between nozzle 100-11 and 100-21 is 6P. By appropriately timing the firing of drop ejectors as the recording medium is moved relative to the printhead, the drops can be made to land on the recording medium to form dots in a horizontal line along the array direction 54 as shown. The leftmost dot in FIG. 3 was ejected by nozzle 100-11. The adjacent dot to the right (shown as being located a distance P to the right of the leftmost dot) was ejected by nozzle 100-12. Using such a two-dimensional "staggered lattice" of drop ejectors, high resolution printing can be provided even though individual drop ejectors are large compared to the dot spacing P. As the recording medium is moved relative to the staggered lattice of drop ejectors in the scan direction 56**, additional horizontal lines of dots can be printed.

Even for compact types of drop ejectors such as thermal inkjet drop ejectors, it can be beneficial to arrange the drop ejectors in multiple offset rows in order to provide room for ink feeds and electrical circuitry, as shown in prior art FIG. 4 adapted from U.S. Pat. No. 8,118,405. Printhead module 210 (shown in a top view in FIG. 4) is one of a plurality of printhead modules 210 that are assembled together end to end at butting edges 214 in order to extend the printhead length. Arrays 211 of drop ejectors 212 are inclined relative to the non-butting edges 209 of printhead module 210. Ink can be fed from the back side of printhead module 210 through segmented ink feeds 220 including slots 221 that extend from the back side to the top side. Ink then flows from slots 221 to ink inlets 24 (FIG. 1) to enter pressure chambers 22 (FIG. 1) of the drop ejectors 212. The segmented ink feeds 220 are disposed adjacent to arrays 211 of drop ejectors 212. Also disposed between arrays 211 and near butting edges 214 is electrical circuitry 230 that can include driver transistors to provide electrical pulses for firing drop ejectors 212, as well as logic electronics to control the driver transistors so that the correct drop ejectors 212 are fired at the proper time. Electrical contacts 240 extend along one or both non-butting edges 209 for providing electrical signals to the electrical circuitry 230. Recording medium (not shown) is advanced relative to printhead module 210 along scan direction 56.

A plurality of printheads having corresponding nozzles that are aligned to each other can be used to form dots having multiple ink drops per dot, as shown in FIGS. 5A and 5B adapted from Japanese Patent Application Publication No. 10-151735 (JP '735). Printheads 2 and 4 are mounted on a common carriage (not shown) that is moved along scan direction 56. Corresponding nozzles 18 in printheads 2 and 4 are aligned along the scan direction 56. The drop ejectors are sized such that ejected drops have half the drop volume required to form a dot of the desired size on the recording medium. FIG. 5A shows half-sized dots 40 that are printed by only the nozzles 18 in printhead 2. FIG. 5B shows overlapping dots formed by nozzles 18 on both printheads 2 and 4. A more generalized example disclosed in Japanese Patent Application Publication No. 10-151735 is the use of three or more printheads having aligned nozzles 18, where the drop ejectors are sized to provide drop volumes that are inversely proportional to the number of printheads. An advantage stated is that the printing speed can be increased.

A plurality of printheads having corresponding nozzles that are aligned to each other is also disclosed in Japanese Patent Application Publication No. 10-157135 (JP '135). In JP '135 two printheads each having a single row of drop ejectors are arranged in similar fashion to FIG. 5A adapted from JP '735. In JP '135 aligned drop ejectors of the two printheads are controllably fired to form dots on a scan line from each printhead in order to compensate for drop volume nonuniformity of drop ejectors on the two printheads.

Drop ejectors can fail during the life of a printer. For example there can be electrical failure of the actuator, such as a failed resistive heater in a thermal inkjet drop ejector. Alternatively a drop ejector nozzle can become plugged. For inkjet printheads (such as those in FIGS. 2 through 4) that print in a single pass and that have a single drop ejector responsible for printing all pixels on a line along the scan direction 56, a non-recoverable failure of a single drop ejector results in an objectionable white streak in the image along the scan direction 56. Carriage printers can disguise the effects of failed drop ejectors through multi-pass printing where each printed line of dots along the carriage scan direction is printed by multiple drop ejectors during the multiple print passes where the recording medium is advanced along the scan direction between each pass. However, multi-pass printing reduces printing throughput dramatically.

Despite the previous advances in drop ejector configurations on inkjet printheads, what is still needed are printhead and printing system designs, as well as printing methods, that provide high resolution printing with high reliability and image uniformity, even if high speed single-pass printing is used and even if one or more drop ejectors fail

SUMMARY OF THE INVENTION

According to an aspect of the present invention, an inkjet printhead includes a two-dimensional array of drop ejectors arranged as a plurality of columns. Each column includes a plurality of banks, and each bank includes a plurality of groups. Each group includes a plurality of drop ejectors that are substantially aligned along a first direction. The groups in each bank are spaced from each other along the first direction and are offset from each other along a second direction. The banks in each column are spaced from each other along the first direction and are offset from each other along the second direction. The columns are offset from each other along the second direction. The two-dimensional array has a width W along the first direction and a length L greater than W along the second direction. Each drop ejector in the two-dimensional array includes a nozzle, an ink inlet that is configured to be in fluidic communication with a first ink source, a pressure chamber in fluidic communication with the nozzle and the ink inlet, and an actuator configured to selectively pressurize the pressure chamber for ejecting ink through the nozzle.

According to another aspect of the present invention, an inkjet printing system includes an ink source, a printhead, a transport mechanism, an image data source and a controller. The printhead includes a two-dimensional array of drop ejectors arranged as a plurality of columns, each column including a plurality of banks, and each bank including a plurality of groups that each includes a plurality of drop ejectors. The drop ejectors in each group are substantially aligned along a first direction. The groups in each bank are spaced from each other along the first direction and are offset from each other along a second direction. The banks in each column are spaced from each other along the first direction and are offset from each other along the second direction. The columns are offset from each other along the second direction. The printhead also includes circuitry for selectively ejecting ink from the drop ejectors. The transport mechanism provides relative motion between the printhead and a recording medium along a scan direction that is substantially parallel to the first direction. The image data source provides image data. The controller includes an image processing unit, a transport control unit, and an ejection control unit for ejecting ink drops to print a pattern of dots corresponding to the image data on the recording medium. The plurality of drop ejectors in a first group are configured to cooperatively print a first set of dots that are disposed linearly along the scan direction.

This invention has the advantage that the printhead can be manufactured at high yield and with a long reliable print lifetime, due to drop ejector redundancy in the print scan direction.

It has the additional advantage that high printing resolution is achieved with a relatively larger drop ejector spacing.

BRIEF DESCRIPTION OF THE DRAWINGS

FIG. 1 shows a perspective of a prior art drop ejector configuration;

FIG. 2 shows a prior art printhead including a linear array of drop ejectors and also a recording medium with a pixel grid of allowable dot locations;

FIG. 3 shows a prior art printhead having multiple offset rows of drop ejectors;

FIG. 4 shows a prior art printhead module having inclined arrays of drop ejectors;

FIGS. 5A and 5B show a prior art configuration of two printheads having aligned nozzles plus the dot patterns that they print;

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 6:
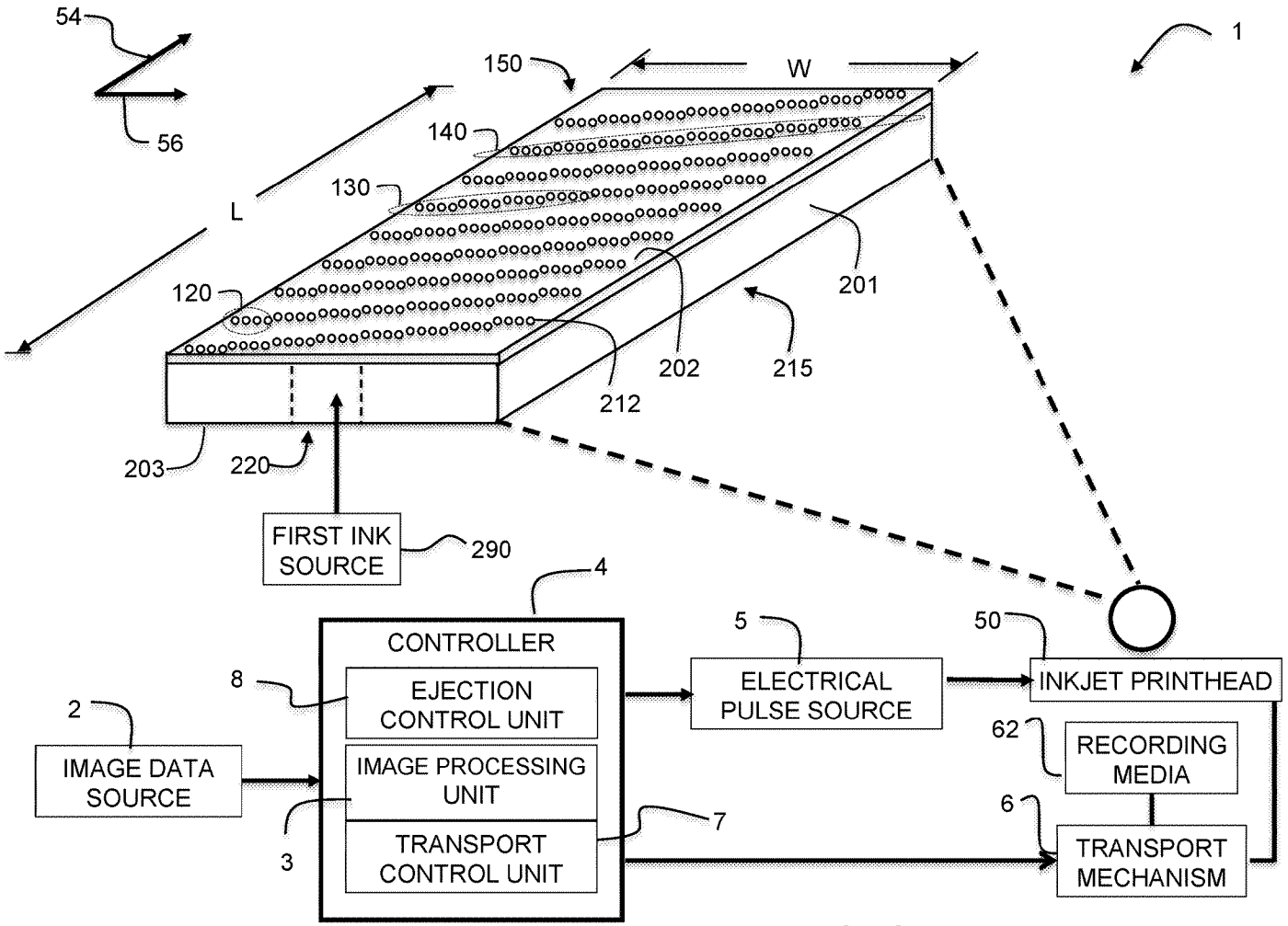
FIG. 6 is a schematic representation of an inkjet printing system according to an embodiment.

The present invention will now be described with reference to FIG. 6, which includes a schematic representation of inkjet printing system 1 together with a perspective of printhead die 215. Image data source 2 provides data signals that are interpreted by a controller 4 as commands for ejecting drops. Controller 4 includes an image processing unit 3 for rendering images for printing. The term "image" is meant herein to include any pattern of dots directed by the image data. It can include graphic or text images. It can also include patterns of dots for printing functional devices if appropriate inks are used. Controller 4 also includes a transport control unit for controlling transport mechanism 6 and an ejection control unit for ejecting ink drops to print a pattern of dots corresponding to the image data on the recording media 62. Controller 4 sends output signals to an electrical pulse source 5 for sending electrical pulses to an inkjet printhead 50 that includes at least one inkjet printhead die 215. Transport mechanism 6 provides relative motion between inkjet printhead 50 and recording medium 62 along a scan direction 56. Transport mechanism 6 is configured to move the recording medium 62 while the printhead 50 is stationary in some embodiments. Alternatively, transport mechanism 6 can move the printhead 50, for example on a carriage, past stationary recording medium 62. In a carriage printer, the scan direction 56 during drop ejection can reverse as successive swaths of the image are printed.

Various types of recording media for inkjet printing include paper, plastic, and textiles. In a 3D inkjet printer, the recording media include flat building platform and thin layer of powder material. In addition, in various embodiments recording medium 62 can be web fed from a roll or sheet fed from an input tray.

Printhead die 215 includes a two-dimensional array 150 of drop ejectors 212 formed on a top surface 202 of a substrate 201 that can be made of silicon or other appropriate material. Ink is provided to drop ejectors 212 by first ink source 290 through ink feed 220 which extends from the back surface 203 of substrate 201 toward top surface 202. Ink source 290 is generically understood herein to include any substance that can be ejected from an inkjet printhead drop ejector. Ink source 290 can include colored ink such as cyan, magenta, yellow or black. Alternatively ink source 290 can include conductive material, dielectric material, magnetic material, or semiconductive material for functional printing. Ink source 290 can alternatively include biological or other materials. For simplicity, location of the drop ejectors 212 is represented by the circular nozzle. Not shown in FIG. 6 are the pressure chamber 22, the ink inlet 24, or the actuator 35 (FIG. 1). Ink inlet 24 is configured to be in fluidic communication with first ink source 290. The pressure chamber 22 is in fluidic communication with the nozzle 32 (FIG. 1) and the ink inlet 24. The actuator 35 is configured to selectively pressurize the pressure chamber 22 for ejecting ink through the nozzle 32.

Two-dimensional array 150 is configured according to a prescribed organizational structure. The basic building block of the organizational structure is the group 120. Each group 120 includes a plurality $N_1>1$ of drop ejectors 212. In the example shown in FIG. 6, each group 120 includes four drop ejectors 212. The drop ejectors 212 within each group 120 are substantially aligned along a first direction that is parallel to scan direction 56. The next higher level building block is the bank 130. Each bank includes a plurality $N_2>1$ of groups 120. Groups 120 within each bank 130 are spaced from each other along the scan direction 56 and are offset from each other along a second direction, which is called the array direction 54 herein. In the example shown in FIG. 6, each bank 130 includes four groups 120. The next higher level of the organizational structure is the column 140. Each column 140 includes a plurality $N_3>1$ of banks 130. The banks 130 in each column 140 are spaced from each other along the scan direction 56 and are offset from each other along the array direction 54. Columns 140 are offset from each other along the array direction 54. Two-dimensional array 150 includes a plurality $N_4>1$ of columns 140. In the example shown in FIG. 6 there are nine columns 140 and each column 140 includes two banks 130. The total number of drop ejectors in the two-dimensional array 150 is $N_1*N_2*N_3*N_4$, where * is the multiplication operator. In the example shown in FIG. 6 there are a total of 4*4*2*9=288 drop ejectors 212.

Two-dimensional array 150 has a width W along the scan direction 56 and a length L along the array direction 54, where L is greater than W. Typically the array direction 54 is perpendicular to the scan direction 56. In the figures included herein the size of the two-dimensional array is relatively small for simplicity. In an actual printhead die 215 there can be thousands of drop ejectors 212, and the length L is typically much greater than the width W. It is advantageous for the length L along a direction perpendicular to scan direction 56 to be long in order to allow printing a large area of the recording medium 62 in a single pass or in a single swath. It is advantageous to keep the area of printhead die 215 relatively small in order to reduce manufacturing costs. Therefore, it is advantageous for width W of the two-dimensional array 150 to be somewhat smaller than L, while still accommodating multiple drop ejectors 212 in each group 120 aligned along the scan direction 56 along which the width W extends.

Figure 7:
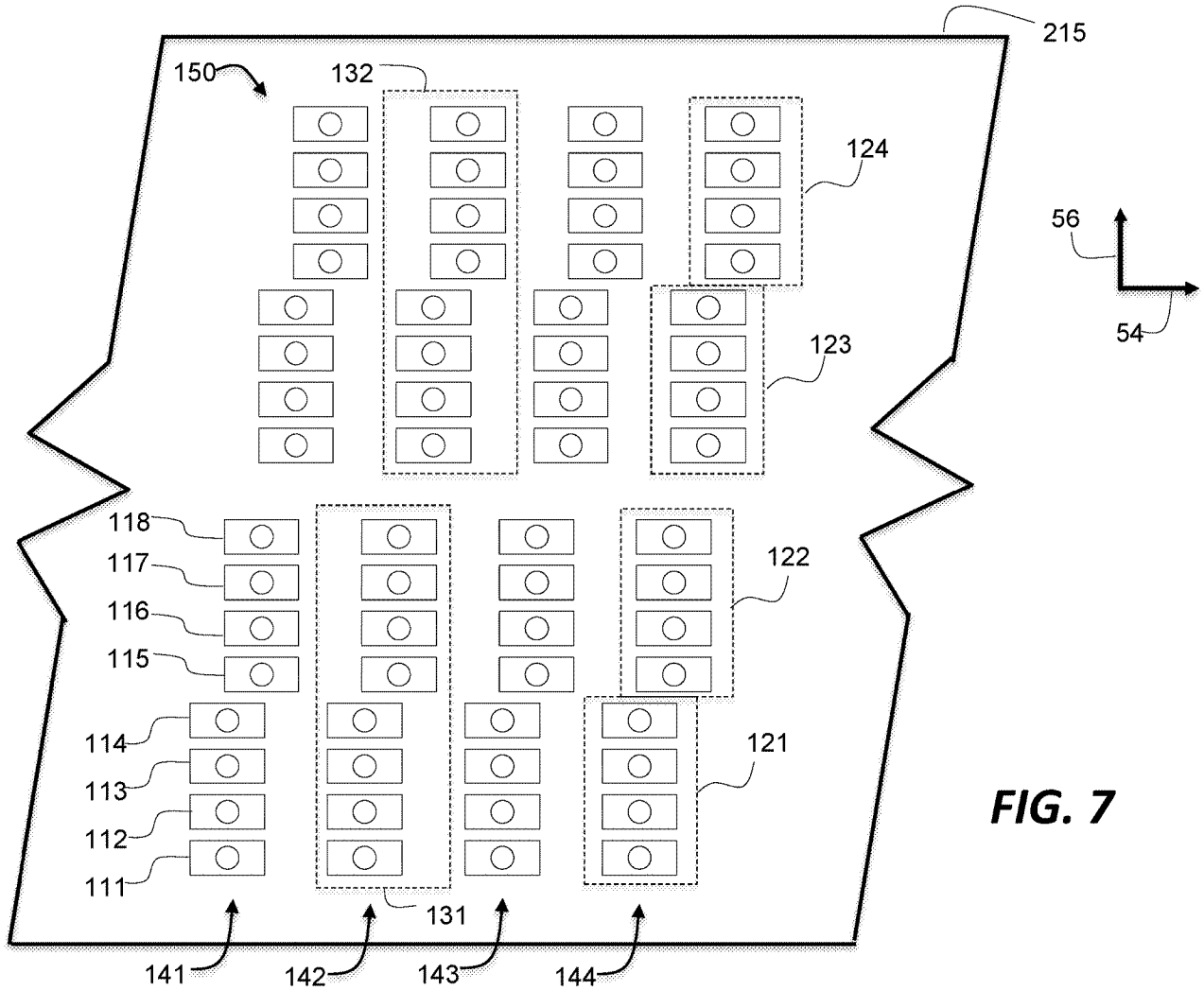
FIG. 7 is a top view of a printhead die having a two-dimensional array of drop ejectors including groups of drop ejectors that are aligned along the scan direction according to an embodiment.

FIG. 7 is a top view of a portion of a printhead die 215 (also called a die herein) and shows a portion of a two-dimensional array 150. In the example of FIG. 7, four columns (141, 142, 143 and 144) are shown. The sides of printhead die 215 are illustrated as jagged lines, indicating that there can be more than four columns. Each column includes two banks 131 and 132. Bank 131 includes two groups 121 and 122, and bank 132 includes two groups 123 and 124. Each group includes four drop ejectors, such as drop ejectors 111, 112, 113 and 114. The numbering convention in FIG. 7 is that the drop ejectors in each bank are numbered consecutively. For example, in column 141 and bank 131, the drop ejectors in group 121 are numbered 111, 112, 113 and 114 from lowest member of group 121 to the highest member. In group 122 the drop ejectors are numbered 115, 116, 117 and 118. Drop ejectors in a group are substantially aligned along scan direction 56. In the example shown in FIG. 7, $N_1=4$, $N_2=2$, $N_3=2$ and $N_4\geq4$.

Figure 8:
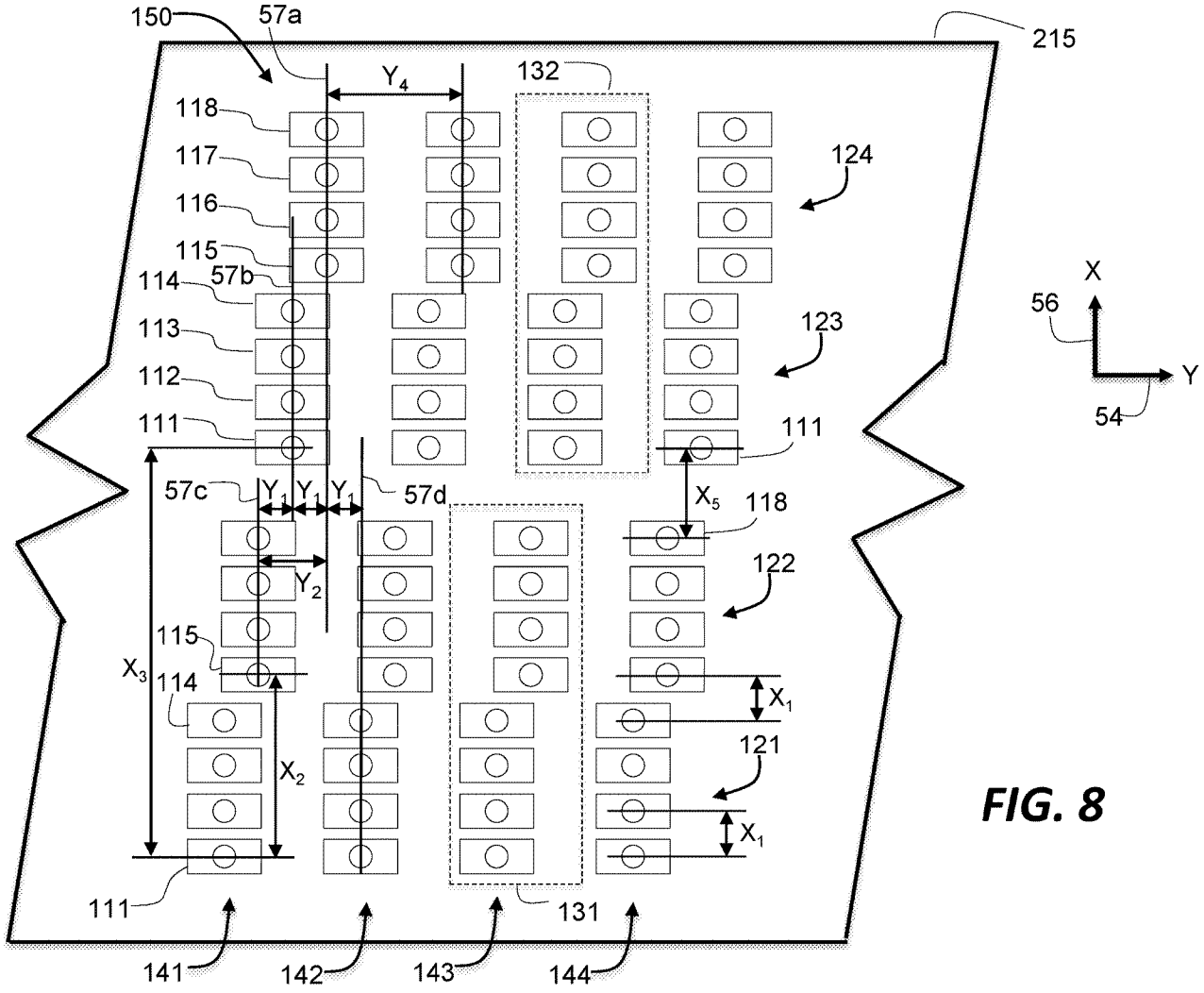
FIG. 8 is similar to FIG. 7 and shows spatial relationships of the drop ejectors in the two-dimensional array.

FIG. 8 is similar to FIG. 7 and shows the spatial relationships of the drop ejectors in the two-dimensional array 150, where X is the scan axis having coordinates along the scan direction 56, and Y is the array axis having coordinates along the array direction 54. The center to center distance between the substantially evenly spaced drop ejectors within a group along the scan direction 56 is $X_1$, as seen in the bottom right corner of two-dimensional array 150 (i.e. between drop ejectors 111 and 112 in bank 131 in column 144). The center to center distance between nearest neighbor drop ejectors of adjacent groups within a bank along the scan direction 56 is $X_1$, as seen between drop ejector 114 in group 121 and drop ejector 115 in group 122 in bank 131 in column 144. As a result, the center to center distance between corresponding drop ejectors in two adjacent groups in a bank is equal to $X_2=N_1X_1$. For example, in bank 131 of column 141 the spacing between bottom-most drop ejector 111 in group 121 and bottom-most drop ejector 115 in group 122 is $X_2=4X_1$.

Adjacent groups within each bank are substantially evenly spaced by a first offset $Y_1$ along the array direction 54. Reference lines 57 are parallel to the scan direction 56 and pass through the centers of drop ejectors in each group in the example shown in FIG. 8. In bank 132 of column 141, for example, a first reference line 57*a* passes through the centers of drop ejectors 115, 116, 117 and 118 of group 124, and a second reference line 57*b* passes through the centers of drop ejectors 111, 112, 113 and 114 of group 123. The distance between first reference line 57*a* and second reference line 57*b* is equal to first offset $Y_1$ along the array direction 54.

The spacing along the scan direction 56 between nearest neighbor drop ejectors of a first bank and an adjacent second bank in a column is equal to $X_5$, which is greater than or equal to $X_1$. For example, in column 144, drop ejector 118 in group 122 of bank 131 has a nearest neighbor drop ejector 111 along the scan direction 56 in group 123 in adjacent bank 132. The distance along the scan direction 56 between these two drop ejectors is $X_5$, which is greater than $X_1$ in the example shown in FIG. 8. The distance $X_5$ is the spacing between nearest neighbor drop ejectors of first bank 131 and adjacent second bank 132 for all four columns 141, 142, 143 and 144. As a result, the center to center distance between corresponding drop ejectors in corresponding groups in adjacent banks is equal to $X_3=N_2*X_2+X_5-X_1$. This expression reduces to $X_3=N_2*N_1*X_1$ if $X_5=X_1$. For example, in column 141 the spacing between bottom-most drop ejector 111 in bottom-most group 121 of bank 131 and bottom-most drop ejector 111 in bottom-most group 123 of bank 132 is $X_3=7X_1+X_5$.

Nearest adjacent groups in adjacent banks in each column are spaced apart by the first offset $Y_1$ along array direction 54. In column 141, for example, second reference line 57*b* passes through the centers of drop ejectors 111, 112, 113 and 114 of group 123 in bank 132. The nearest adjacent group in adjacent bank 131 is group 122. Third reference line 57*c* passes through the centers of drop ejectors 115, 116, 117 and 118 of group 122 in adjacent bank 131. The distance between second reference line 57*b* and third reference line 57*c* is equal to first offset $Y_1$ along the array direction 54.

A smallest spacing along array direction 54 between a group in a first column and a group in an adjacent second column is also equal to first offset $Y_1$. For example, the groups that have the smallest spacing along array direction 54 in columns 141 and 142 are group 124 of column 141 and group 121 of column 142. First reference line 57*a* passes through the centers of the drop ejectors of group 124 of column 141. Fourth reference line 57*d* passes through the centers of the drop ejectors of group 121 of column 142. The distance between first reference line 57*a* and fourth reference line 57*d* is equal to first offset $Y_1$ along the array direction 54.

In other words, in two-dimensional array 150, successive groups (from left to right in FIG. 8) are equally spaced by first offset $Y_1$ along array direction 54. If recording medium 62 (FIG. 6) is moved relative to printhead die 215 along scan direction 56, and if the firing of drop ejectors in different groups is appropriately timed, the allowable adjacent dot locations 66 (FIG. 2) within rows 68 along array direction 54 will be spaced evenly by first offset $Y_1$. Dot spacing along the array direction 54 is analogous to prior art FIGS. 2 and 3. As described in more detail below in connection with the method of printing, dot formation along the scan direction 56 is different from the prior art. The differences in printing along the scan direction 56 are enabled by having groups of drop ejectors that are aligned along scan direction 56. A printhead configuration that includes a plurality of drop ejectors aligned along the scan direction 56 in each group in two-dimensional array 150 enables dots that are disposed linearly along the scan direction 56 on the recording medium 62 to be cooperatively printed in a single pass by a plurality of different drop ejectors. If a single drop ejector in a group fails, it does not result in a white streak along the scan direction 56 as is the case for prior art printheads used in single-pass printing.

Figure 9:
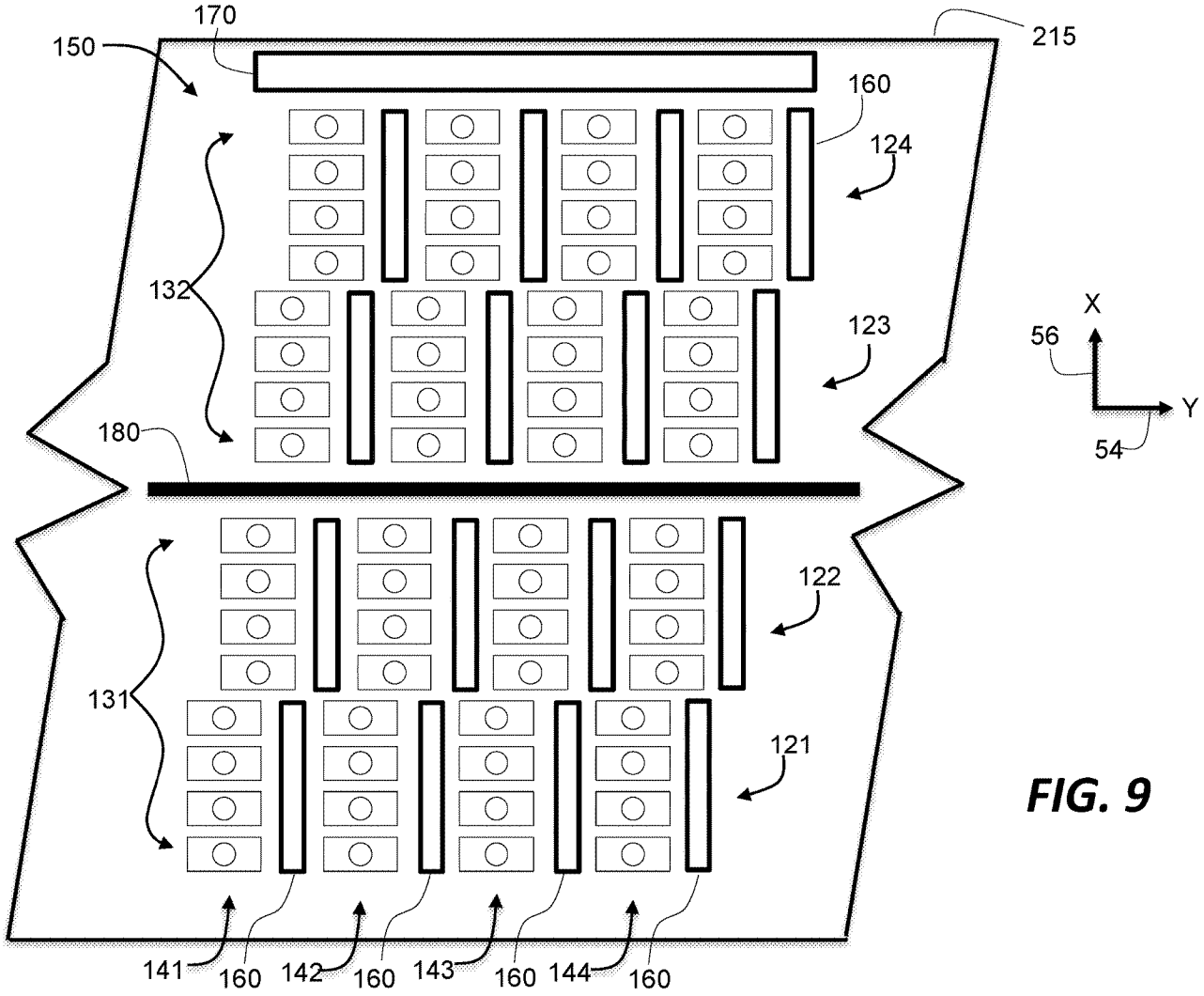
FIG. 9 is similar to FIG. 7 and further shows electrical features.

As described above relative to prior art FIG. 4, it can be beneficial to arrange the drop ejectors in multiple offset rows in order to provide room for ink feeds and electrical circuitry. As shown in FIGS. 8 and 9, offset groups of drop ejectors provide a similar advantage. With reference to FIG. 8, the distance $Y_4$ along the array direction 54 between corresponding groups in adjacent columns is equal to $4Y_1$ for the case where there are $N_2=2$ groups in a bank and $N_3=2$ banks in a column. More generally speaking, the distance between corresponding groups in adjacent columns is equal to $N_2*N_3*Y_1$. As shown in the example of FIG. 9, driver circuitry 160 can thus be fit into the spaces between corresponding groups in adjacent columns. The actuator of each drop ejector is electrically connected to the driver circuitry 160 for energizing the actuator. Also schematically shown in FIG. 9 is addressing circuitry 170 for selectively energizing the actuators of the drop ejectors by the driver circuitry 160. For example, the driver circuitry 160 can include driver transistors 161 (FIG. 10) that are connected to each actuator. The addressing circuitry 170 can include data input lines, clock lines and logic elements such as shift registers and latches in order to turn on the driver transistors of the driver circuitry 160 for energizing the actuators in the proper sequence and timing for printing the image according to image data source 2 (FIG. 6).

Figure 10:
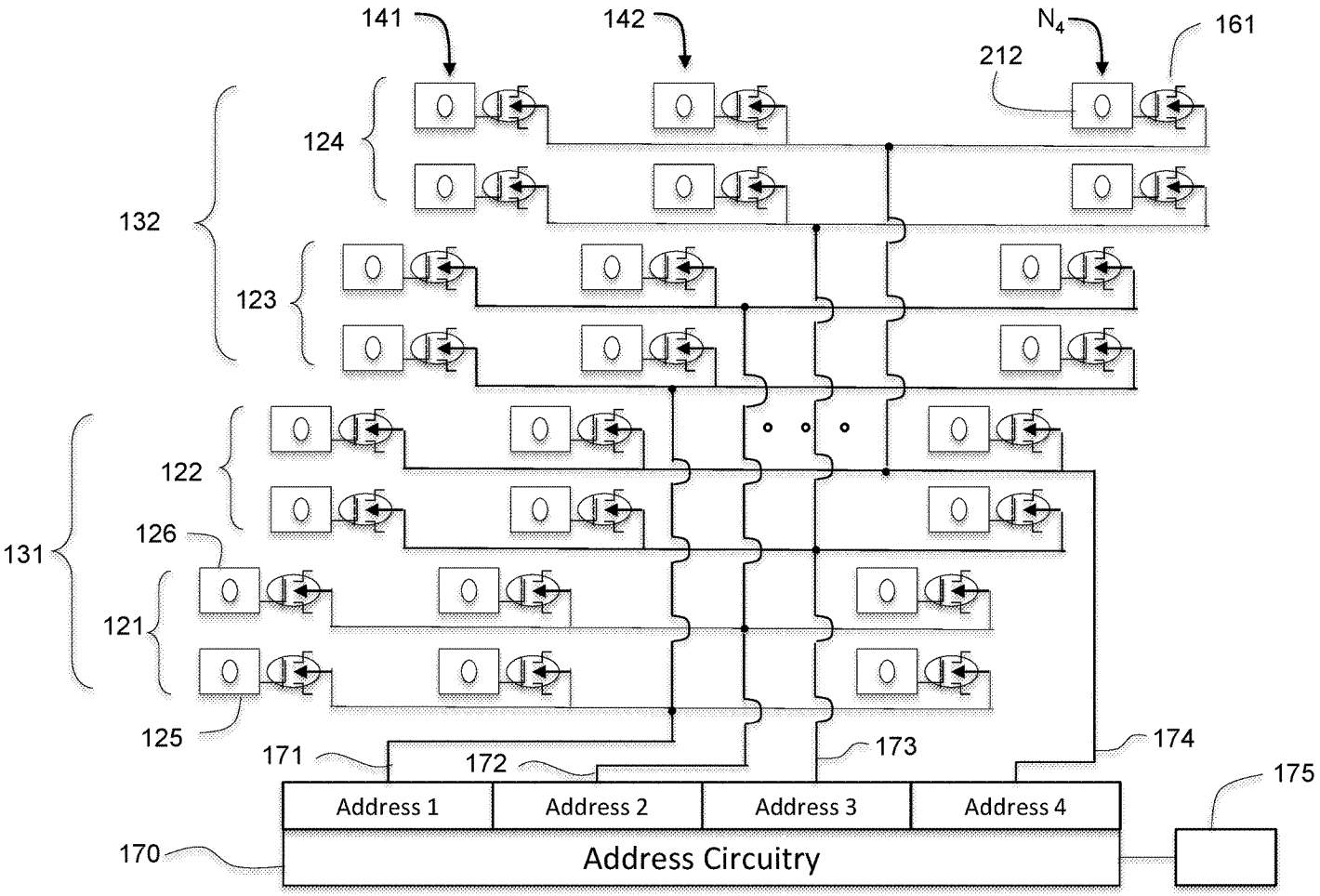
FIG. 10 is a schematic of driver circuitry and addressing circuitry according to an embodiment.

FIG. 10 shows an example of driver circuitry 160 and addressing circuitry 170 that can be included in a printhead die 215 similar to the example of FIG. 9. For simplicity in FIG. 10, each group 121, 122, 123 and 124 has two drop ejectors 212 rather than the four drop ejectors per group in the example of FIG. 9. There are $N_4$ columns (141, 142 up to $N_4$) in FIG. 10 and each column has two banks 131 and 132. Address circuitry 170 includes a plurality of address lines 171, 172, 173 and 174. More generally speaking, the number of address lines is equal to the number of drop ejectors per bank (the product of the number of drop ejectors per group and the number of groups per bank, i.e. $N_1*N_2$). Each drop ejector in a bank is connected to a different address line. By that it is meant that the driver transistor 161 connected to the actuator (not shown) of each drop ejector 212 in a bank is connected to a different address line. For example, in bank 131 address line 171 is connected to the driver transistor 161 corresponding to the lower drop ejector 125 in group 121; address line 172 is connected to the driver transistor 161 corresponding to the upper drop ejector 126 in group 121; address line 173 is connected to the driver transistor 161 corresponding to the lower drop ejector 125 in group 122; and address line 174 is connected to the driver transistor 161 corresponding to the upper drop ejector 126 in group 122. Similarly, in bank 132, address line 171 is connected to the driver transistor 161 corresponding to the lower drop ejector 125 in group 123; address line 172 is connected to the driver transistor 161 corresponding to the upper drop ejector 126 in group 123; address line 173 is connected to the driver transistor 161 corresponding to the lower drop ejector 125 in group 124; and address line 174 is connected to the driver transistor 161 corresponding to the upper drop ejector 126 in group 124. Each address line of the addressing circuitry 170 is connected to one drop ejector 212 in a corresponding location in each group in each bank. For example, address line 171 is connected to the driver transistor 161 corresponding to the lower drop ejector 125 in the lower group 121 in bank 131, and address line 171 is also connected to the driver transistor 161 corresponding to the lower drop ejector 125 in the lower group 123 in bank 132. In addition, each address line is connected to drop ejectors in corresponding locations in each column. For example, address line 171 is connected to the driver transistor 161 corresponding to the lower drop ejector 125 in group 121 in column 141, to the driver transistor 161 corresponding to the lower drop ejector 125 in group 121 in column 142, and to the driver transistor 161 corresponding to the lower drop ejector 125 in group 121 in column $N_4$. As a result of this address line configuration, when a signal pulse is sent along address line 171, for example, the lower drop ejector 125 in corresponding groups in each bank in each column can be fired simultaneously. Whether an ejector will actually be fired depends on the image date from image data source 2 (FIG. 6). The maximum number of drop ejectors 215 that can be fired simultaneously by the addressing configuration of FIG. 10 is the product of the number of banks per column and the number of columns, i.e. $N_3*N_4$.

Also associated with addressing circuitry 170 is a sequencer 175 that determines the order in which signals are sent by address lines 171, 172, 173 and 174. For example, signals can be sent successively by address lines in a first sequence 171, 172, 173 and 174 or in a second sequence 174, 173, 172 and 171 that is opposite to the first sequence. In other words, the addressing circuitry 170 is configured to selectively address the driving circuitry 160 for energizing the actuators in either a first sequence or a second sequence that is opposite to the first sequence.

In the examples described herein, the number $N_1$ of drop ejectors in each group is an even number. An even number of drop ejectors in a group can be preferable for addressing, but it is also contemplated that there can be configurations having an odd number of drop ejectors in each group.

In the example shown in FIG. 8 the spacing along the scan direction 56 between nearest neighbor drop ejectors of a first bank and an adjacent second bank in a column is equal to $X_5$, which is greater than or equal to $X_1$. For $X_5$ greater than $X_1$, proper dot spacing can be achieved by causing different position drop ejectors in different banks to eject the drops to land on the recording medium 62 in the appropriate positions. In some embodiments, as shown in FIG. 9, it can be advantageous to have $X_5$ greater than $X_1$ in order to place an electrical lead 180 between first bank 131 and adjacent second bank 132. This is especially true for types of drop ejectors such as thermal inkjet drop ejectors that require relatively high electrical currents. In order to avoid excessive voltage drops along the current-carrying leads, it can be useful to provide additional leads such as electrical lead 180 in the space provided between adjacent banks.

Figures 11A, 11B, 11C:
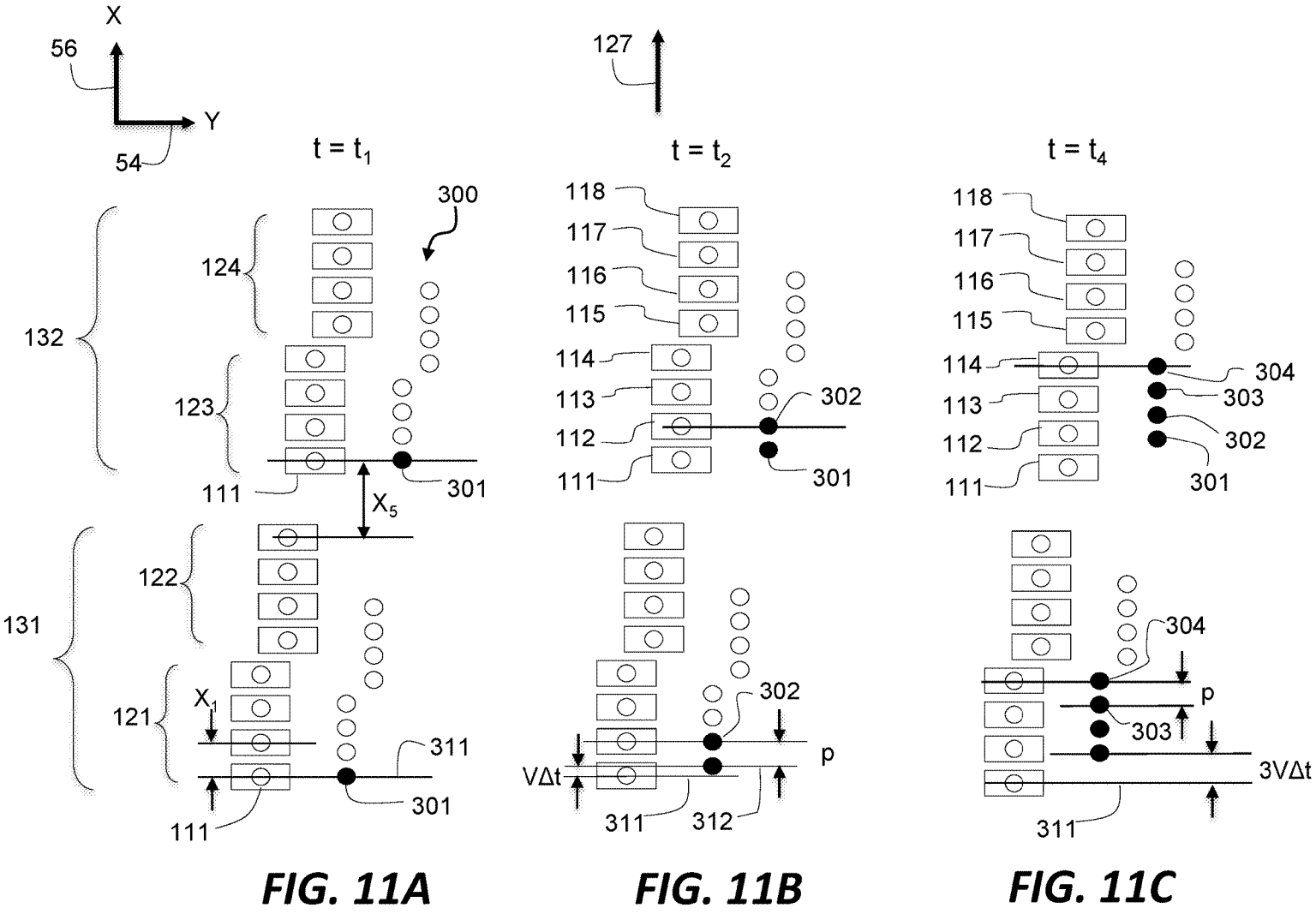
FIGS. 11A through 11E schematically show snapshots at successive times that occur during a first printing stroke according to an embodiment.

Further embodiments of printheads and printing systems will be described below, but it is instructive to consider methods of printing using the printhead configuration embodiments described above. FIGS. 11A through 11E schematically show snapshots at successive times during a first print stroke. A stroke is defined as a plurality of print cycles during which drop ejectors 212 in the two-dimensional array 150 (FIG. 6) are fired, such that during one stroke all drop ejectors 212 in the two-dimensional array 150 (FIG. 6) are fired once. FIGS. 11A to 11C show snapshots at three times $t_1$, $t_2$ and $t_4$ as drop ejectors 111 to 114 from groups 121 and 123 in a single column eject drops of ink while the recording medium 62 (FIG. 6) is moved relative to printhead die 215 along scan direction 56. Note: relative motion of the recording medium 62 and the printhead along scan direction 56 is sometimes referred to herein as moving relative to the printhead, or to the printhead die, or to the drop ejectors. All of these expressions are understood to be equivalent herein. The relative motion during drop ejection can consist of transporting the recording medium past the stationary printhead or transporting the printhead past the stationary recording medium. For simplicity, the recording medium 62 (FIG. 6) is not shown in FIG. 11 but just the dot locations. Numbering of drop ejectors, groups and banks is similar to that used in FIGS. 7 and 8. Allowable pixel locations 300 are shown as unfilled circles, while already enabled print dots are shown as filled circles. In FIG. 11A at an initial time $t_1$, endmost drop ejector 111 from group 121 in bank 131 and corresponding endmost drop ejector 111 from group 123 in bank 132 are simultaneously enabled to fire during a first printing cycle to form first dots 301 at first positions 311 on the recording medium that are aligned with drop ejectors 111 at time $t_1$. Whether or not drops of ink will actually be ejected by drop ejectors 111 to form first dots 301 is controlled according to image data from image data source 2 (FIG. 6).

The recording medium is moved relative to the drop ejectors along scan direction 56 at a substantially constant velocity V, so that at a second time $t_2$ shown in FIG. 11B, the recording medium has moved a distance $V\Delta t$ relative to first position 311 where $\Delta t=t_2-t_1$, or more generally $\Delta t=t_n-t_{n-1}$, where $t_n$ is the time at the start of the nth printing cycle. First dot 301 has moved a distance $V\Delta t$ from first position 311 at $t_1$ to second position 312 at $t_2$. As shown in FIG. 11B, after waiting for time delay $\Delta t$ after firing the first drop ejector of the first group, second drop ejectors 112 from group 121 in bank 131 and from group 123 in bank 132 are enabled to be fired simultaneously in a second printing cycle. Drops that are fired during the second printing cycle form second dots 302 that are aligned with drop ejectors 112 at time $t_2$. Second drop ejectors 112 are nearest neighbors of the first endmost drop ejectors 111 in their respective groups. The distance (also called the scan direction pitch p) between first dot 301 and second dot 302 is equal to the spacing between drop ejectors 111 and 112 minus the distance that the recording medium has moved along scan direction 56 relative to the printhead die 215 during the time interval between $t_1$ and $t_2$, i.e. $p=X_1-V\Delta t$. In this embodiment, the direction 127 between the first drop ejector 111 enabled for firing in a group and the second drop ejector 112 enabled for firing in the group is in the same direction as the recording medium travel direction (scan direction 56) relative to the printhead die. In such embodiments, the scan direction pitch p is less than the spacing $X_1$ between drop ejectors. This can be advantageous for achieving higher resolution printing (spots per inch) along the scan direction 56 than the number of drop ejectors per inch formed on the printhead.

Printing cycles are repeated in similar fashion, where the time interval from the start of a printing cycle to the start of the next printing cycle is $\Delta t=(X_1-p)/V$. Although a third printing cycle where drop ejectors 113 (nearest neighbors of drop ejectors 112) print third dots 303 at time $t_3=t_1+2\Delta t$ is not shown, a fourth printing cycle where drop ejectors 114 (nearest neighbors of drop ejectors 113) print fourth dots 304 at time $t_4=t_1+3\Delta t$ is shown in FIG. 11C. The recording medium has traveled a distance $V\Delta t$ since the third printing cycle, so the scan direction pitch p between third dot 303 and fourth dot 304 is again $p=X_1-V\Delta t$. Relative to initial position 311, the recording medium has moved relative to the printhead by a total distance of $3V\Delta t$ and all four drop ejectors in each of groups 121 and 123 have been fired by time $t_4$ for this example where there are $N_1=4$ drop ejectors per group. More generally, all $N_1$ drop ejectors in the first groups in each bank are fired by time $t_{N1}$ and the recording medium has moved relative to the printhead by a total distance of $(N_1-1)*V\Delta t$. FIGS. 11A to 11C show only the printing of dots by a single column of drop ejectors. Similar printing is simultaneously enabled for each column 140 in the two-dimensional array 150 (FIG. 6). In other words, firing of successive nearest neighbor drop ejectors of a first group in each bank in each column is sequentially enabled during $N_1$ successive cycles of a first stroke until all $N_1$ members of the first group in each bank in each column have had opportunity to eject a drop of ink.

Figure 11E:
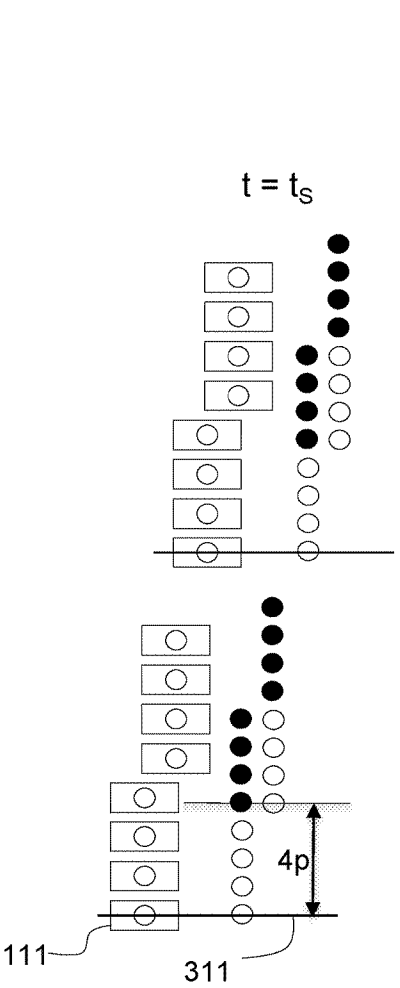
Figure 11D:
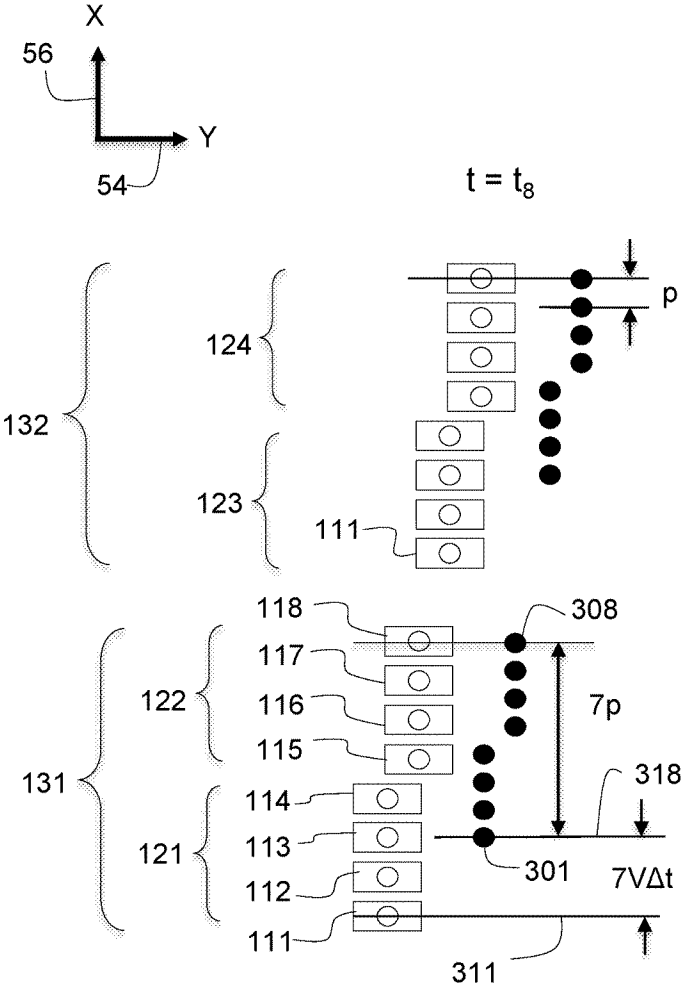

In a similar way, firing of endmost drop ejectors 115 of second groups 122 and 124 in banks 131 and 132 of each column is enabled during an $N_1+1$ cycle of the first stroke. Then, firing of drop ejectors 116 (nearest neighbors of drop ejectors 115) of second groups 122 and 124 in banks 131 and 132 of each column is enabled during an $N_1+2$ cycle of the first stroke. Then, successive nearest neighbor drop ejectors of the second group in each bank in each column is enabled during successive cycles of the first stroke until all $N_1$ members of the second group in each bank in each column have had opportunity to eject a drop of ink. FIG. 11D shows the dots that have been enabled for printing at $t_8$, after drop ejectors 115-118 in second groups 122 and 124 have been successively fired following the firing of drop ejectors 111-114 that was illustrated in FIGS. 11A to 11C. Consecutive printing cycles within the first stroke are spaced evenly in time by time interval $\Delta t$, so that (since $X_1$ and V are substantially constants), the scan direction pitch $p=X_1-V\Delta t$ is substantially constant. The distance between dot 301 printed by drop ejector 111 and dot 118 printed seven printing cycles later is 7p. The distance the recording medium has moved relative to the drop ejectors from first position 311 to eighth position 318 is $7V\Delta t$, as shown in FIG. 11D.

In this example, the number of groups in a bank is $N_3=2$. If the number of groups in a bank were greater than 2, firing of the drop ejectors of additional groups in each bank in each column would be sequentially enabled in similar fashion until all drop ejectors in the two-dimensional array 150 have had opportunity to eject a drop of ink.

In FIG. 11D, the recording medium is not yet in position to start printing the second stroke. In order for the pitch p to remain constant along the scan direction 56, the recording medium must move a total distance of $N_1*p$ between the start of the first stroke at time $t_1$ and the start of the next stroke at time $t_S$, as illustrated in FIG. 11E where $N_1*p=4p$. In FIG. 11D at $t=t_8$, the recording medium has moved by $7V\Delta t=(N_1*N_2-1)*V\Delta t$ relative to the first position 311. The extra distance that the recording medium needs to move between $t_8$ (FIG. 11D) and $t_S$ (FIG. 11E) is $N_1*p-(N_1*N_2-1)V\Delta t=N_1*p-(N_1*N_2-1)*(X_1-p)$ Thus there needs to be a delay time $\tau_1=t_S-t_8=(N_1*p-(N_1*N_2-1)*(X_1-p))/V$ after all $N_1*N_2$ drop ejectors in each bank have been fired in a first stroke before the second stroke begins.

Figures 12A, 12B, 12C, 12D:
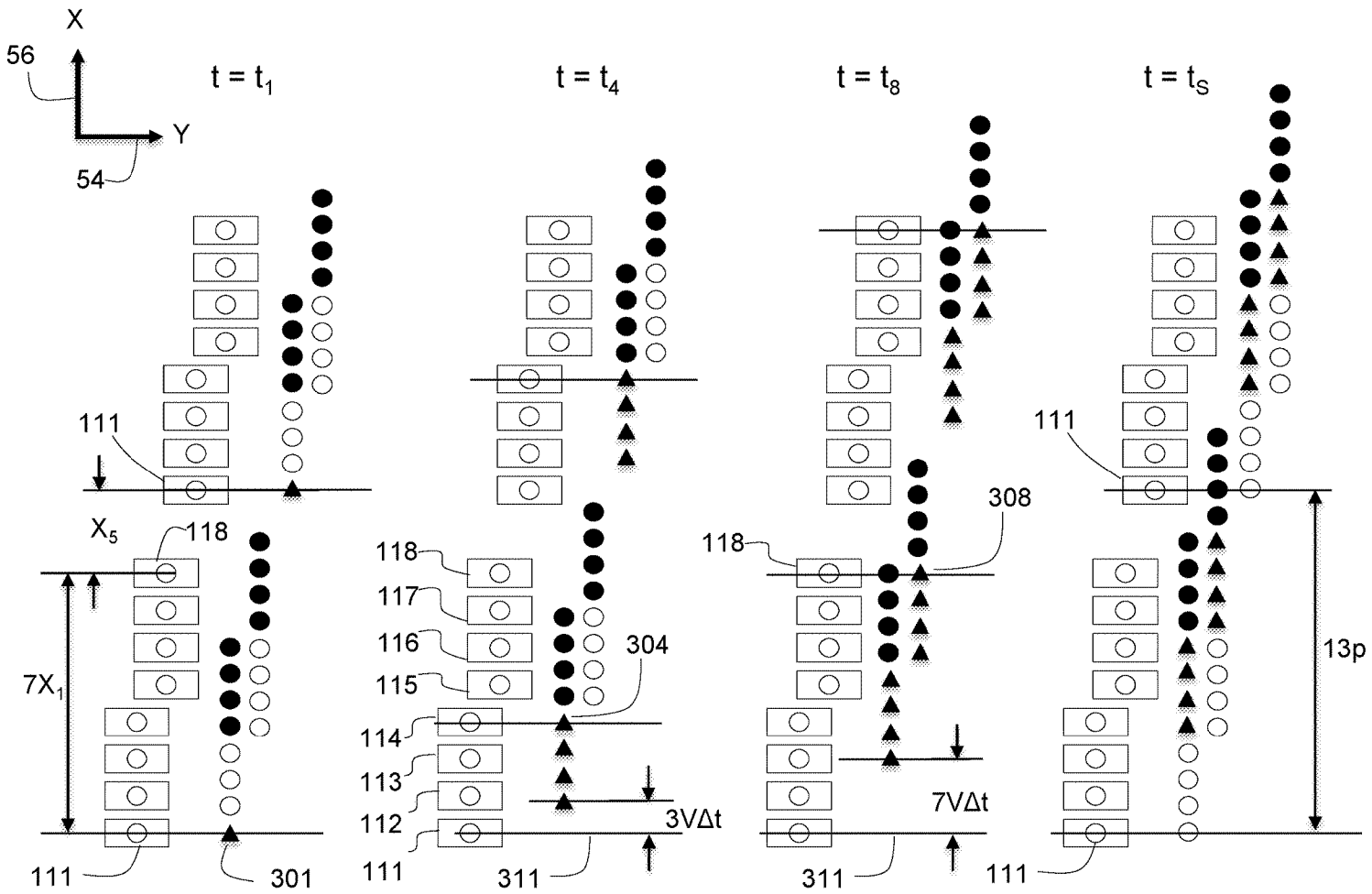
FIGS. 12A through 12D schematically show snapshots at successive times during a second print stroke following the first print stroke according to an embodiment.

FIGS. 12A through 12D schematically show snapshots at successive times during a second print stroke following the first print stroke. Dots that are printed during the second stroke are shown as filled triangles in order to distinguish them from dots that are printed during the first stroke. FIG. 12A is at $t_1=t_8+\Delta t$, after the first dot 301 of the second stroke is printed by drop ejector 111. FIG. 12B shows the fourth printing cycle of the second stroke where drop ejectors 111, 112, 113 and 114 have successively fired during the second stroke, and the fourth dot 304 of the second stroke is aligned with drop ejector 114. FIG. 12B is analogous to FIG. 11C. The distance the recording medium has traveled relative to the drop ejectors between FIGS. 12A and 12B is $3V\Delta t$. FIG. 12C shows the eighth printing cycle of the second stroke where drop ejectors 111, 112, 113, 114, 115, 116, 117 and 118 have successively fired during the second stroke, and the eighth dot 308 of the second stroke is aligned with drop ejector 118. FIG. 12C is analogous to FIG. 11D. The distance the recording medium has traveled relative to the drop ejectors between FIGS. 12A and 12C is $7V\Delta t$.

FIG. 12D is analogous to FIG. 11E. The distance between drop ejector 111 in group 121 and drop ejector 111 in group 123 is equal to $X_5+7X_1$, or more generally $X_5+(N_1*N_2-1)*X_1$. Because drop ejector 111 in bank 132 is fired at the same time as drop ejector 111 in bank 131, in order to provide an integer number n of equally spaced dots with pitch p between them, it follows that $$X_5+(N_1*N_2-1)*X_1=np. \tag{1}$$

In other words, the spacing between corresponding drop ejectors of adjacent banks in each column in the scan direction is an integer multiple of p. By counting the dot spacings between drop ejector 111 in bank 131 and drop ejector 111 in bank 132 in FIG. 12D or FIG. 13A it can be seen that in this example, equation 1 reduces to $X_5+7X_1=13p$.

Figures 13A, 13B, 13C, 13D:
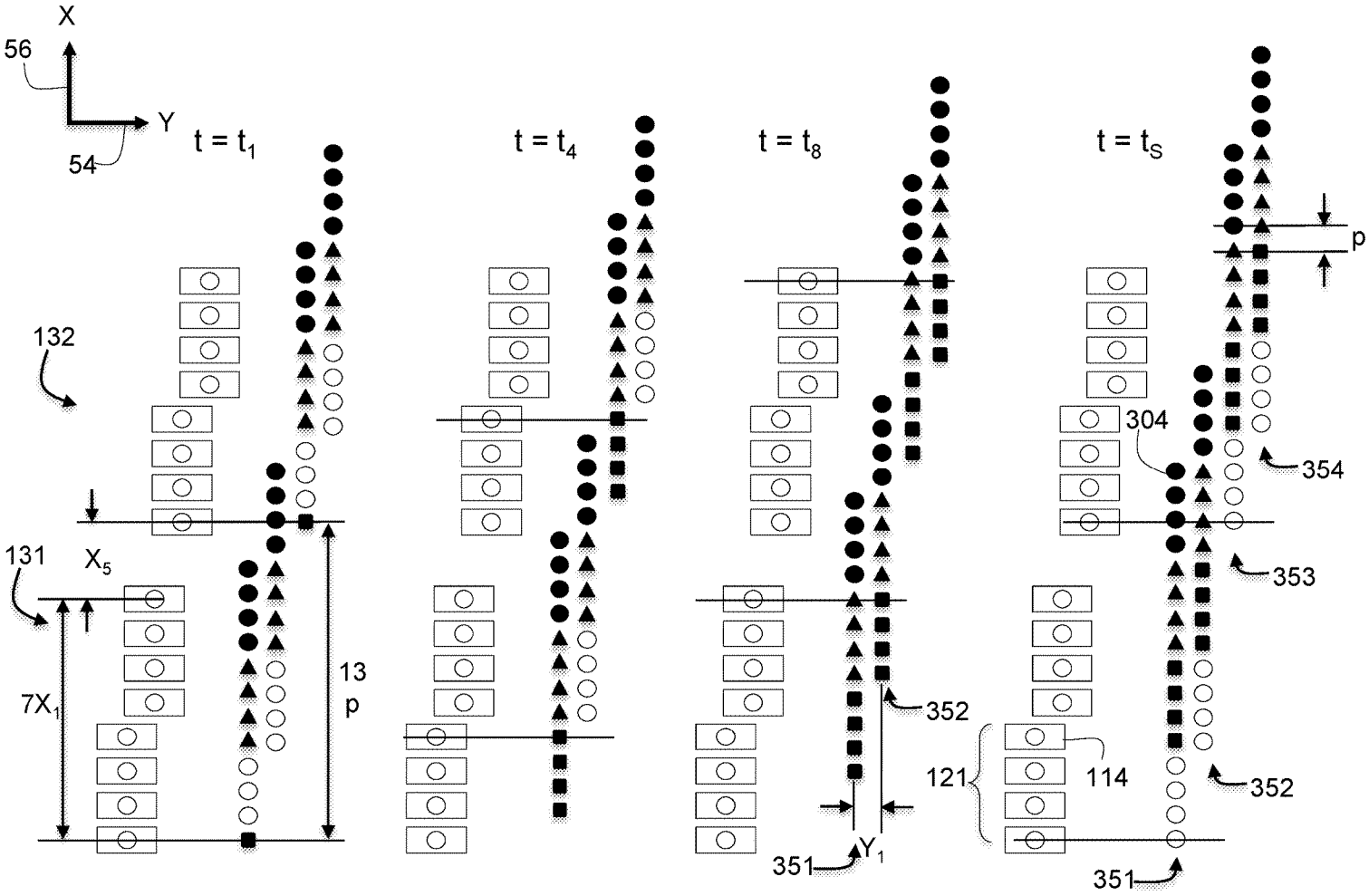
FIGS. 13A through 13D schematically show snapshots at successive times during a third print stroke following the second print stroke according to an embodiment.

FIGS. 13A through 13D schematically show snapshots at successive times during a third print stroke following the second print stroke. Dots that are printed during the third stroke are shown as filled squares in order to distinguish them from dots that are printed during the first and second strokes. FIGS. 13A through 13D are analogous to FIGS. 12A through 12D respectively, and the dot positions and timing will not be described in detail. FIGS. 13A through 13D illustrate the formation of lines 351, 352, 353 and 354 of printed dots that extend linearly along the scan direction 56. As shown in FIG. 13C, adjacent lines of dots are separated along the array direction 54 by first offset $Y_1$, which is the offset distance between adjacent groups of drop ejectors in the array direction 54.

The Y axis (parallel to array direction 54) on the recording medium is sometimes called the cross-track direction. Dots that are printed along the scan direction 56 at a particular cross-track location on the recording medium are cooperatively printed by the $N_1$ drop ejectors of a corresponding group. With reference to FIGS. 8 and 13D, the dots in line 351 were cooperatively printed by drop ejectors 111, 112, 113 and 114 in group 121 in bank 131 of column 141, for example. No one single drop ejector is responsible for printing all the dots in a line. Therefore, if one drop ejector fails in a group of $N_1$ drop ejectors, the other $(N_1-1)$ drop ejectors print the remaining dots in the line, so it does not appear as a white streak. Similarly, the dots in line 352 were cooperatively printed by drop ejectors 115, 116, 117 and 118 in group 122 in bank 131 of column 141. The dots in line 353 were cooperatively printed by drop ejectors 111, 112, 113 and 114 in group 123 in bank 132 of column 141. The dots in line 354 were cooperatively printed by drop ejectors 115, 116, 117 and 118 in group 124 in bank 132 of column 141.

Drop ejectors in the two-dimensional array 150 are enabled to be fired in a series of subsequent strokes similar to the first stroke as the recording medium is moved relative to the printhead, as has been described for the second stroke in FIGS. 12A through 12D and for the third stroke in FIGS. 13A through 13D. As a result, dots are printed on the recording medium by ejected drops of ink until printing of the image according to the image data from image data source 2 (FIG. 6) is completed.

Figure 14:
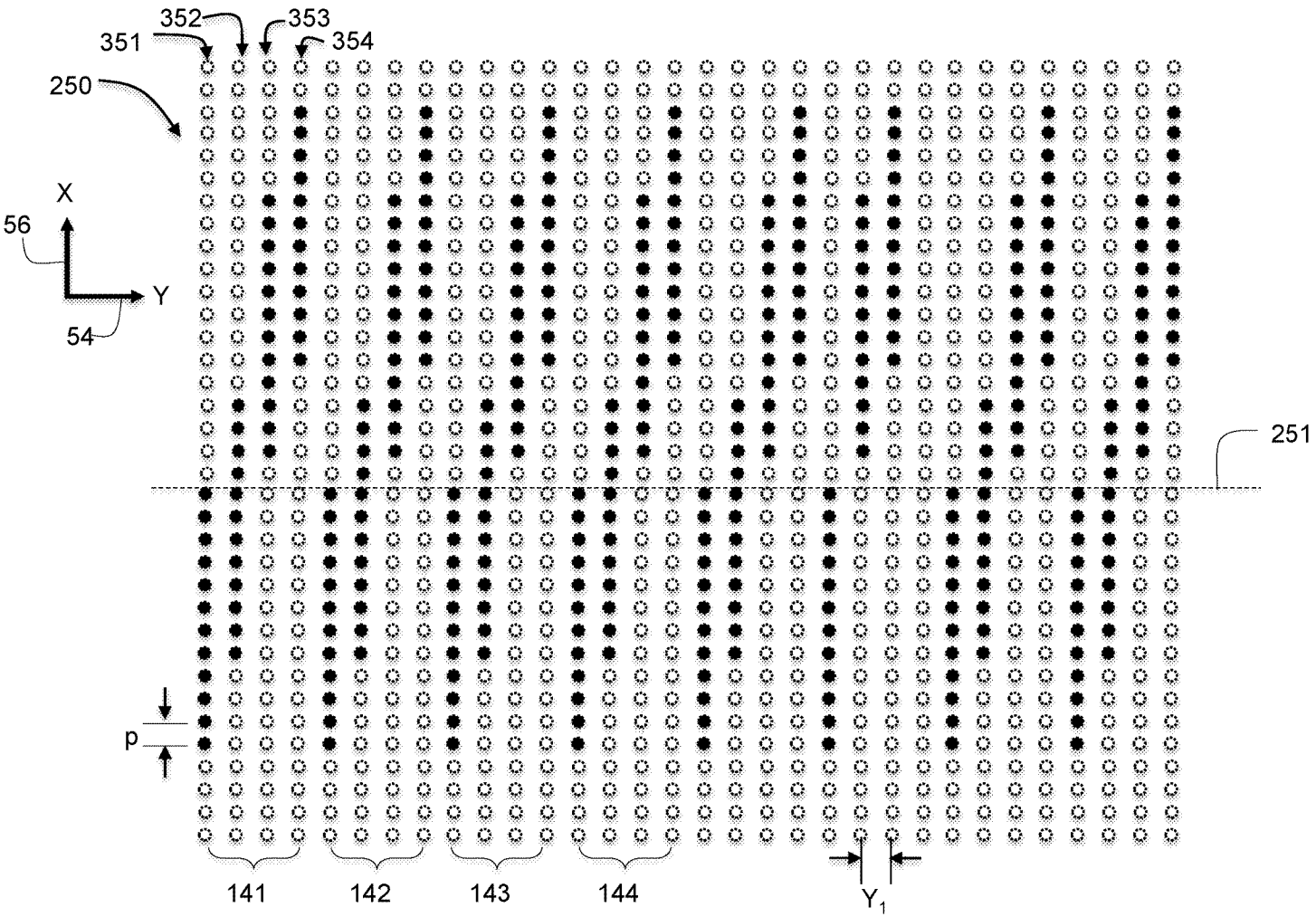
FIG. 14 shows a portion of a pixel grid with solid circles representing dots that are enabled for printing during the first three printing strokes shown in FIGS. 11A through 13D according to an embodiment.

FIG. 14 shows a portion of a pixel grid 250 with solid circles representing dots that are enabled for printing during the first three strokes as in FIG. 13D. Allowable image dot locations formed by ink drops ejected onto the recording medium are defined by pixel grid 250. The printed dots in FIG. 13D represent printing of lines of dots 351, 352, 353 and 354 by one column such as column 141 of FIG. 8. Pixel grid 250 also shows dots enabled for printing by columns 142, 143, 144 and several other columns of drop ejectors during the first three strokes. The pixel spacing along scan direction 56 is scan direction pitch p, while the pixel spacing along the cross-track direction Y is first offset $Y_1$. Because groups of drop ejectors within each column are offset from each other by first offset $Y_1$ along the cross-track direction as shown in FIG. 8, and because the smallest spacing along array direction 54 between a first group in a first column and a second group in an adjacent second column is also equal to the first offset $Y_1$ (FIG. 8), the pixel grid 250 has a uniform cross-track pitch equal to the first offset $Y_1$. Because of the relative movement of the recording medium and the printhead during printing, it is generally true that scan direction pitch p is different from the drop ejector spacing $X_1$ along scan direction 56. In the example described above relative to FIGS. 11-13, $p=(X_1-V\Delta t)$ is less than $X_1$.

FIGS. 13D and 14 illustrate the filling of pixel grid 250 during the first three successive strokes as the recording medium is advanced along the scan direction 56 relative to the drop ejectors. As seen in FIG. 13D, in a particular line such as line 351, the pixels (represented by filled squares) printed during the third stroke are located below the pixels (represented by filled triangles) printed during the second stroke, which are below the pixels (represented by filled circles) printed during the first stroke. In other words, pixel grid 250 is filled from below on successive strokes as the recording medium moves upward relative to the printhead. In line 351, for example, no dot can be printed above dot 304 (FIG. 11C) that was printed by the topmost drop ejector 114 in group 121 during the first stroke, because the relative motion of the recording medium has moved that portion of the recording medium beyond the last drop ejector 114 at the corresponding position in the array direction 54. More generally, in FIG. 14, pixel locations above boundary line 251 can never be printed. Therefore, at the lead edge of an image, the image processing unit 3 and controller 4 (FIG. 6) will arrange the print data and the firing sequences such that drops will not be ejected corresponding to the dots above boundary line 251. Another way to think about this is that if recording medium 62 is a sheet of paper, at time $t_1$ in FIG. 11A when drop ejectors 111 in bank 131 and 132 are enabled to be fired, if the lead edge of the paper has just reached drop ejector 111 in bank 131, there would be no paper under drop ejector 111 in bank 132, so image processing unit 3 and controller 4 would not allow drop ejector 111 in bank 132 to fire at the lead edge. In general, image processing unit 3 and controller 4 format the print data and the firing sequences such that drops will land in the appropriate locations to form the desired image on the recording medium 62.

In the example described above with reference to FIGS. 11A through 13D consecutive dots printed in a line along scan direction 56 are printed by consecutive drop ejectors in a group. For example, in FIG. 11C, dot 301 is printed by drop ejector 111, adjacent dot 302 is printed by adjacent drop ejector 112, next adjacent dot 303 is printed by next adjacent drop ejector 113 and next adjacent dot 304 is printed by next adjacent drop ejector 114. In this type of printing, which will be called non-interlaced printing herein, the scan direction pitch p is less than $X_1$, but cannot be made arbitrarily small. The time between printing cycles in a stroke is $\Delta t=(X_1-p)/V$. Since there are $N_1*N_2$ printing cycles in a stroke, the time required to print all the drop ejectors in the two dimensional array 150 is $N_1*N_2*\Delta t=N_1*N_2*(X_1-p)/V$, and the distance moved by the recording medium moving at velocity V relative to the two dimensional array printhead is $N_1*N_2*(X_1-p)$. This distance needs to be less than or equal to $N_1*p$. In other words, the travel distance between the recording medium and the printhead along the scan direction 56 during a time used to complete each stroke is less than or equal to a spacing along the scan direction 56 between a first dot formed on the recording medium by ejecting a drop of ink from a drop ejector in a group within a bank and a second dot formed on the recording medium by ejecting a drop of ink from a corresponding drop ejector in an adjacent group within the bank. If the distance relatively moved by the recording medium is greater than $N_1*p$, then there would be a gap between a cluster of dots printed along the scan direction 56 during the first stroke and a cluster of dots subsequently printed along the scan direction 56 during the second stroke. In other words, the delay time $\tau_1$ described above with reference to FIG. 11E needs to be greater than or equal to zero. Therefore, $$N_1*N_2*(X_1-p)\leq N_1*p, \text{ so that } N_2*(X_1-p)\leq p. \quad (2)$$

As a result, the minimum value of scan direction pitch for non-interlaced printing in the example of FIGS. 11A through 13D is $$p_{min}=N_2*X_1/(N_2+1). \quad (3)$$

In the non-interlaced printing example of FIGS. 11A through 13D where the number of groups in a bank $N_2=2$, the minimum scan direction pitch p is two-thirds of the drop ejector spacing $X_1$ along the scan direction 56. For example, a two-dimensional array of 400 drop ejectors per inch along the scan direction could print non-interlaced dots on a pixel grid where the scan direction resolution is 600 dots per inch.

Figures 15A, 15B, 15C, 15D:
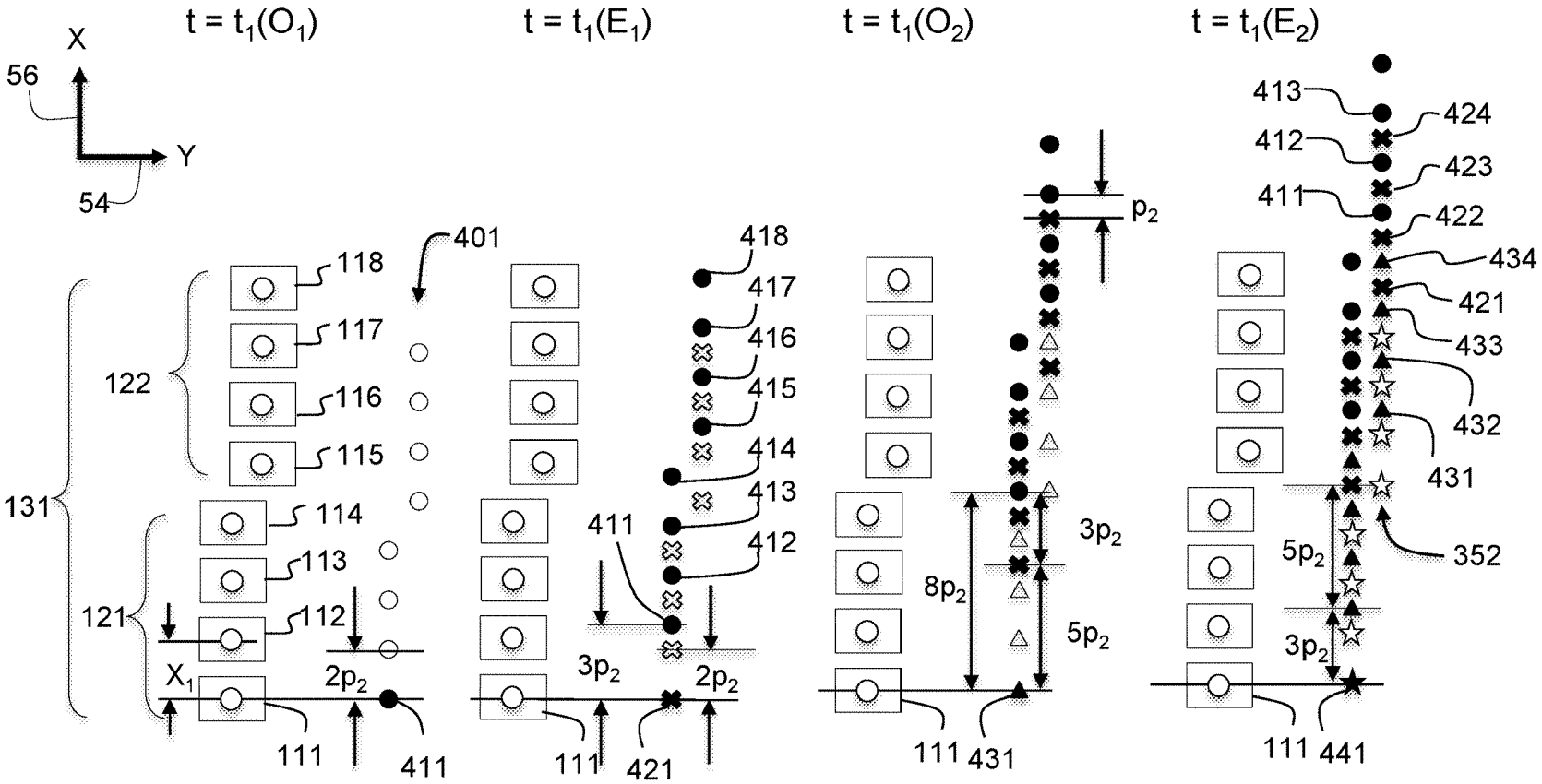
FIGS. 15A through 15D illustrate four printing strokes for double-interlaced printing according to an embodiment.

In order to print at even higher scan direction resolution with the drop ejector array arrangement described above with reference to FIG. 7, it is necessary to use interlaced printing as described below. FIGS. 15A through 15D illustrate a method of double-interlaced printing at higher resolution by using double the number of strokes. Successive double-interlaced strokes are called odd strokes and even strokes below. FIGS. 15A through 15D show only the drop ejectors and dot locations corresponding to groups 121 and 122 of bank 131 for simplicity. For the double-interlaced example, $p_2$ is the scan direction pitch. FIG. 15A is analogous to FIG. 11A. In FIG. 15A at an initial time $t_1(O_1)$ for a first odd stroke, drop ejector 111 from group 121 is enabled to fire during a first printing cycle to form first odd dot 411 on the recording medium. Unfilled circles represent allowable odd dot positions 401 that have not yet been enabled for printing. Spacing between allowable dot positions printed by the first odd stroke is $2p_2$, i.e. twice the scan direction pitch $p_2$. During the printing of the first odd stroke, the recording medium moves at velocity V in the scan direction 56 relative to the drop ejectors. Similar to the discussion above relative to FIG. 11B, after waiting for time delay $\Delta t$ after firing the first drop ejector of the first group, second drop ejectors 112 from group 121 in bank 131 are enabled to be fired in a second printing cycle (not shown) to form second dot 412 (FIG. 15B). The distance between first odd dot 411 and second odd dot 412 printed during the first odd stroke is equal to the spacing between drop ejectors 111 and 112 minus the distance that the recording medium has moved during the time $\Delta t$, i.e. $2p_2=X_1-V\Delta t$. During the third through eighth printing cycles in the first odd stroke, odd dots 413, 414, 415, 416, 417 and 418 are printed by drop ejectors 113, 114, 115, 116, 117 and 118 respectively.

In FIG. 15B at an initial time $t_1(E_1)$ for a first even stroke, drop ejector 111 from group 121 is enabled to fire during a first printing cycle to form first even dot 421 on the recording medium. In order to interlace the printed dots at a scan direction pitch $p_2$, the recording medium is allowed to travel a distance $3p_2$ between the first printing cycle of the first odd stroke (FIG. 15A) and the first printing cycle of the first even stroke (FIG. 15B). In other words, during a time $3p_2/V$ between the start of the first odd stroke (when drop ejector 111 prints first odd dot 411) and the start of the first even stroke (when drop ejector 111 prints first even dot 421) the recording medium moves relative to the drop ejectors by $3p_2$ in the scan direction 56. More generally for double interlacing, if there are $N_1$ drop ejectors in each group and $N_1$ is an even number, the time between the start of the first odd stroke and the start of the first even stroke is equal to $(N_1-1)*p_2/V$. First even dot 421 is represented by a filled X, while allowable dot positions that have not yet been enabled for printing in the first even stroke are represented by unfilled X's.

In FIG. 15C at an initial time $t_1(O_2)$ for a second odd stroke, drop ejector 111 from group 121 is enabled to fire during a first printing cycle to form first odd dot 431 on the recording medium. In order to provide a constant scan direction pitch $p_2$, the recording medium must move relative to the drop ejectors by a total of $8p_2$ between the first printing cycle of the first odd stroke (FIG. 15A) and the first printing cycle of the second odd stroke (FIG. 15C). Equivalently, the recording medium must move relative to the drop ejectors by $5p_2$ between the first printing cycle of the first even stroke (FIG. 15B) and the first printing cycle of the second odd stroke (FIG. 15C). More generally for double interlacing, if there are $N_1$ drop ejectors in each group and $N_1$ is an even number, the time between the start of the first even stroke and the start of the second odd stroke is equal to $(N_1+1)*p_2/V$. First odd dot 431 is represented by a filled triangle, while allowable dot positions that have not yet been enabled for printing in the second odd stroke are represented by unfilled triangles.

In FIG. 15D at an initial time $t_1(E_2)$ for a second even stroke, drop ejector 111 from group 121 is enabled to fire during a first printing cycle to form first even dot 441 on the recording medium. In order to interlace the printed dots at a scan direction pitch $p_2$, the recording medium is allowed to travel a distance $3p_2$ between the first printing cycle of the second odd stroke (FIG. 15C) and the first printing cycle of the second even stroke (FIG. 15D). First even dot 441 is represented by a filled star, while allowable dot positions that have not yet been enabled for printing in the second even stroke are represented by unfilled stars.

Near the upper right-hand portion of FIG. 15D the sequence of consecutively enabled dots in line 352 is shown. Beginning at dot 433 and going upward: dot 433 is printed on the second odd stroke by drop ejector 113; dot 421 is printed on the first even stroke by drop ejector 111; dot 434 is printed on the second odd stroke by drop ejector 114; dot 422 is printed on the first even stroke by drop ejector 112; dot 411 is printed on the first odd stroke by drop ejector 111; dot 423 is printed on the first even stroke by drop ejector 113; dot 412 is printed on the first odd stroke by drop ejector 112; dot 424 is printed on the first even stroke by drop ejector 114; and dot 413 is printed on the first odd stroke by drop ejector 113. In other words, unlike non-interlaced printing where consecutive dots printed in a line along scan direction 56 are printed by consecutive drop ejectors in a group as described above, in interlaced printing, consecutive dots printed in a line along scan direction 56 are not printed by consecutive drop ejectors in a group. In the particular example for the portion of line 352 described above in this paragraph, the consecutive dots are printed by drop ejectors in the following order: 113, 111, 114, 112, 111, 113, 112, 114, 113.

In the example described above with reference to FIGS. 15A through 15D the time between the start of the first odd stroke and the start of the first even stroke is equal to $3p_2/V$, or more generally $(N_1-1)*p_2/V$, and the time between the start of the first even stroke and the start of the second odd stroke is equal to $5p_2/V$, or more generally $(N_1+1)*p_2/V$, in order to properly position the dots for double interlacing. Alternatively, the time between the start of the first odd stroke and the start of the first even stroke can be equal to $5p_2/V$, or more generally $(N_1+1)*p_2/V$, and the time between the start of the first even stroke and the start of the second odd stroke can be equal to $3p_2/V$, or more generally $(N_1-1)*p_2/V$. Another way to look at this is that it is arbitrary whether one designates the first odd stroke as the first stroke and the first even stroke as the subsequent stroke that immediately follows the first stroke. Equally well one could designate the first even stroke as the first stroke and the second odd stroke as the subsequent stroke that immediately follows the first stroke.

In double-interlaced printing, the scan direction pitch $p_2$ is less than can be achieved for non-interlaced printing, but it cannot be made arbitrarily small. The time between printing cycles in a stroke for double-interlaced printing is $\Delta t=(X_1-2p_2)/V$. Consider the example shown in FIGS. 15A through 15D where the number of drop ejectors per group is $N_1=4$ and the number of groups per bank is $N_2=2$. The time in a stroke required for firing all 8 drop ejectors 111 through 118 is $8(X_1-2p_2)/V$. The distance the recording medium moves at velocity V along scan direction 56 relative to the drop ejectors during this time is $8(X_1-2p_2)$. This distance needs to be less than or equal to $3p_2$, so that there are no gaps between clusters of pixels. Therefore, $$8(X_1-2p_2)\leq 3p_2, \text{ so } 8X_1\leq 19p_2. \tag{4}$$

As a result, the minimum value of scan direction pitch for double-interlaced printing in the example of FIGS. 15A through 15D is $$p_{2min}=8X_1/19, \tag{5}$$

which is less than half of $X_1$.

Figures 16A, 16B, 16C, 16D, 16E:
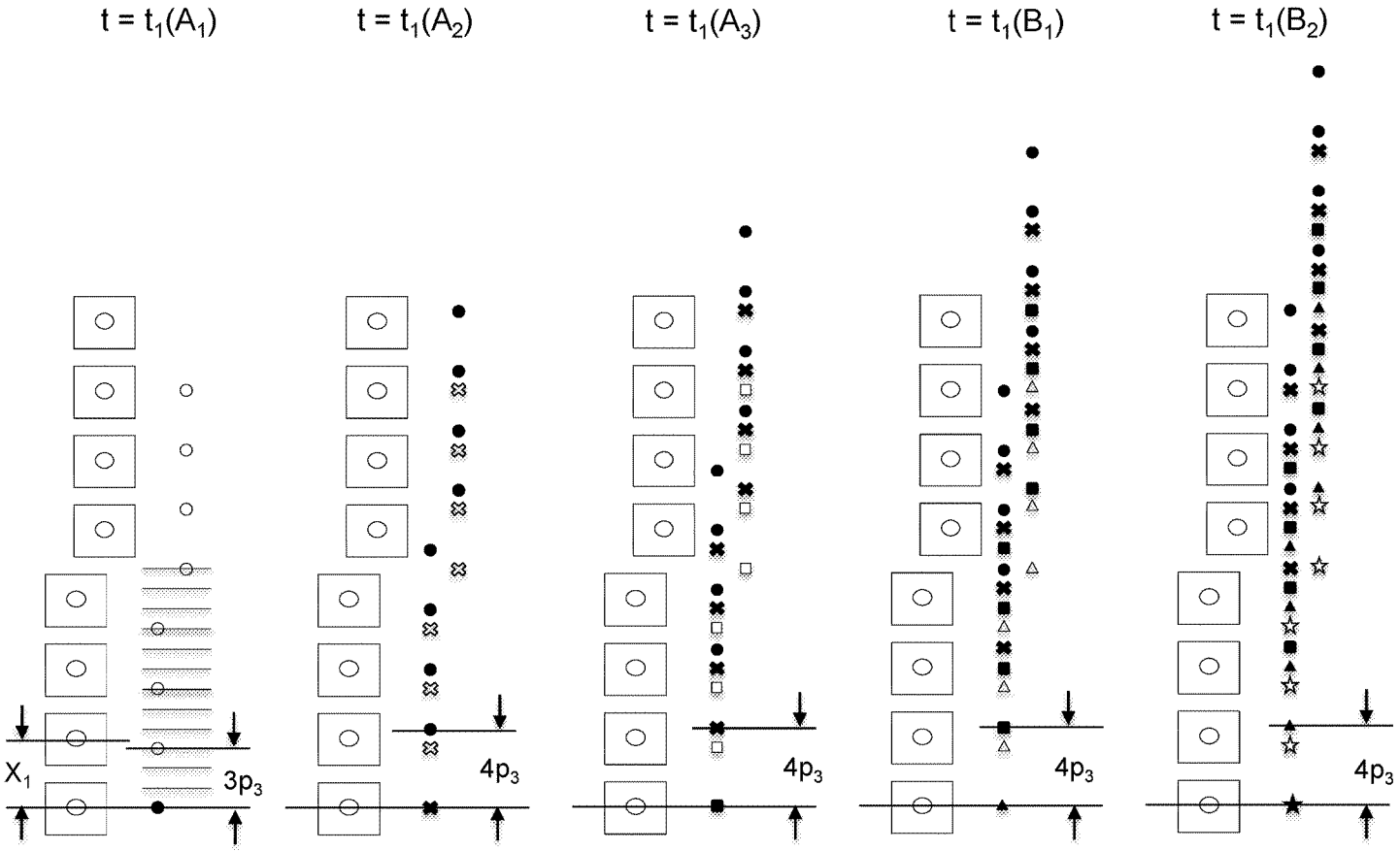
FIGS. 16A through 16E illustrate five printing strokes for triple-interlaced printing according to an embodiment.

In order to print at even higher scan direction resolution with the drop ejector array arrangement described above with reference to FIG. 7, it is necessary to use higher-order interlaced printing as described below. FIGS. 16A through 16E illustrate a method of triple-interlaced printing at higher resolution by using triple the number of strokes. Conventions for drop ejectors and dots are similar to FIGS. 15A through 15D. Less individual labeling is used in FIGS. 16A through 16E so as not to unnecessarily clutter these more compact figures. The first printing cycles of each of five consecutive strokes $A_1$, $A_2$, $A_3$, $B_1$ and $B_2$ are shown in FIGS. 16A through 16E. For the triple-interlaced example, $p_3$ is the scan direction pitch. In FIG. 16A at an initial time $t_1(A_1)$ for a first stroke, an endmost drop ejector from a first group is enabled to fire during a first printing cycle to form a first dot (represented as a filled circle) on the recording medium. Unfilled circles in FIG. 16A represent allowable dot positions from stroke $A_1$ that have not yet been enabled for printing. Spacing between allowable dot positions printed during stroke $A_1$ is $3p_3$, i.e. three times the scan direction pitch $p_3$. During the printing of the first stroke $A_1$, the recording medium moves at velocity V in the scan direction 56 relative to the drop ejectors. Similar to the discussion above relative to FIG. 15A, after waiting for time delay $\Delta t$ after firing the first drop ejector of the first group, successive drop ejectors from the first group are enabled to be fired in a successive printing cycles (not shown) to form successive dots represented by filled circles in FIG. 16B. The distance between consecutive dots printed during stroke $A_1$ is equal to the spacing between adjacent drop ejectors minus the distance that the recording medium has moved relative to the drop ejectors during the time $\Delta t$, i.e. $3p_3=X_1-V\Delta t$.

In FIG. 16B at an initial time $t_1(A_2)$ for a second stroke, an endmost drop ejector from the first group is enabled to fire during a first printing cycle to form a first dot (represented as a filled X) on the recording medium. In order to interlace the printed dots at a scan direction pitch $p_3$, the recording medium is allowed to travel relative to the drop ejectors a distance $4p_3$ between the first printing cycle of the first stroke $A_1$ (FIG. 16A) and the first printing cycle of the second stroke $A_2$ (FIG. 16B). In other words, during a time $4p_3/V$ between the start of the first stroke $A_1$ and the start of the second stroke $A_2$ the recording medium moves relative to the drop ejectors by $4p_3$ in the scan direction 56. More generally for triple-interlacing, if there are $N_1$ drop ejectors in each group and if $N_1$ is not a multiple of 3, the time between the start of the first stroke and the start of the second stroke is equal to $N_1*p_3/V$. Unfilled X's in FIG. 16B represent allowable dot positions from stroke $A_2$ that have not yet been enabled for printing.

In FIG. 16C at an initial time $t_1(A_3)$ for a third stroke, an endmost drop ejector from the first group is enabled to fire during a first printing cycle to form a first dot (represented as a filled square) on the recording medium. In other respects, printing in third stroke $A_3$ is similar to that described above for FIGS. 16A and 16B.

In FIG. 16D at an initial time $t_1(B_1)$ for a fourth stroke, an endmost drop ejector from the first group is enabled to fire during a first printing cycle to form a first dot (represented as a filled triangle) on the recording medium. In other respects, printing in fourth stroke $B_1$ is similar to that described above for FIGS. 16A through 16C.

In FIG. 16E at an initial time $t_1(B_2)$ for a fifth stroke, an endmost drop ejector from the first group is enabled to fire during a first printing cycle to form a first dot (represented as a filled star) on the recording medium. In other respects, printing in fifth stroke $B_2$ is similar to that described above for FIGS. 16A through 16D.

In triple-interlaced printing, the scan direction pitch $p_3$ is less than can be achieved for double-interlaced printing, but it cannot be made arbitrarily small. The time between printing cycles in a stroke for triple-interlaced printing is $\Delta t=(X_1-3p_3)/V$. Consider the example shown in FIGS. 16A through 16E where the number of drop ejectors per group is $N_1=4$ and the number of groups per bank is $N_2=2$. The time in a stroke required for firing all 8 drop ejectors is $8(X_1-3p_3)/V$. The distance the recording medium moves at velocity V along scan direction 56 relative to the drop ejectors during this time is $8(X_1-3p_3)$. This distance needs to be less than or equal to $4p_3$, so that there are no gaps between clusters of pixels printed by each group of drop ejectors. Therefore, $$8(X_1-3p3)\leq 4p_3, \text{ so } 8X_1<28p_2. \tag{6}$$

As a result, the minimum value of scan direction pitch for triple-interlaced printing in the example of FIGS. 16A through 16E is $$p_{3min}=2X_1/7, \tag{7}$$

which is less than a third of $X_1$.

In order to print at even higher scan direction resolution with the drop ejector array arrangement described above with reference to FIG. 7, it is necessary to use higher-order interlaced printing. Multiple-interlacing is referred to herein as M-interlacing, where M=2 for double-interlacing and M=3 for triple-interlacing. In general for M-interlacing (and as illustrated above for M=2 and M=3), each stroke in a series of (M−1) consecutive subsequent strokes following the first stroke is timed relative to the first stroke such that subsequent-stroke dots formed on the recording medium by drops ejected from at least one drop ejector in each group during each of the subsequent strokes in the series of (M−1) consecutive subsequent strokes are disposed in interlacing fashion in the scan direction between allowable first-stroke dot locations on the recording medium.

For the example of double-interlacing described above with reference to FIGS. 15A through 15D, scan direction pitch $p_2=(X_1-V\Delta t)/2$. For the example of triple-interlacing described above with reference to FIGS. 16A through 16E, scan direction pitch $p_3=(X_1-V\Delta t)/3$. In general for M-interlacing for embodiments where a direction from the first-fired drop ejector of the first group to the second-fired drop ejector of the first group is the same as the scan direction, scan direction pitch $p_M=(X_1-V\Delta t)/M$. More simply, $p=(X_1-V\Delta t)/M$, where the scan direction pitch for M-interlacing is generically denoted as p.

For the example of double-interlaced printing as described above with reference to FIGS. 15A through 15D, the time between the start of the first odd stroke and the start of the first even stroke is equal to $3p_2/V$, or more generally $(N_1-1)*p/V$ where $N_1$ is even, and the time between the start of the first even stroke and the start of the second odd stroke is equal to $5p/V$, or more generally $(N_1+1)*p/V$, in order to properly position the dots for double interlacing. More generally for M-interlacing where a least common multiple of $N_1$ and M is less than $N_1*M$, it can be shown that the time between the start of the first stroke and the start of the subsequent stroke immediately following the first stroke is equal to $(N_1-1)*p/V$, and the time between the start of the Mth subsequent stroke and the start of a stroke immediately following the Mth stroke is equal to $(N_1+1)*p/V$. In addition, for M greater than 2, it can be shown that for each of the M strokes except the first stroke and the Mth stroke, a time between the start of each stroke and the start of the immediately following stroke is equal to $N_1*p/V$. Also, as observed above for the double-interlacing example, since the sequence of strokes is repetitive, it is somewhat arbitrary which stroke is denoted as the first stroke, i.e. whether the time between strokes $(N_1-1)*p/V$ is considered to occur before or after the time between strokes $(N_1+1)*p/V$.

For the example of triple-interlaced printing as described above with reference to FIGS. 16A through 16E, the time between the start of each stroke and the start of the immediately following stroke is equal to $4p_3/V$, or more generally $N_1*p/V$, where $N_1=4$ and M=3. It can be shown in general that for embodiments where a least common multiple of $N_1$ and M is equal to $N_1*M$, the time between the start of each of the M strokes, including the first stroke, and the start of an immediately following stroke is equal to $N_1*p/V$.

In the interlacing examples described above, the advantage has been described in terms of higher scan direction resolution, i.e. an increased number of dots per inch along the scan direction 56. In some embodiments, as in piezo inkjet, a fairly wide range of drop volumes can be ejected by a given drop ejector. In such embodiments the drop volume can be controlled by adjusting the electrical pulses from electrical pulse source 5 (FIG. 6) such that smaller dots can be printed when using interlacing than when not using interlacing. In this way the overall ink coverage can be kept substantially constant. In other embodiments, as in thermal inkjet, a given drop ejector can eject only a fairly narrow range of drop volumes. In some instances interlacing is used in increasing the addressability along the scan direction 56 without greatly increasing the number of dots per inch that are printed. In other words, not every allowable pixel location on the pixel grid would be printed for the image. Instead, interlacing would be used to make fine adjustments on the positions of dots to be printed. For example, a diagonal line that is not parallel to either the array direction 54 or the scan direction 56 can have a jagged appearance if the scan direction pitch p is about equal to the cross-track pitch $Y_1$ (FIG. 6). By printing in interlaced fashion, the dot position along the scan direction 56 can be adjusted in fine increments by controllably printing a particular interlaced dot rather than an adjacent interlaced dot, thereby smoothing the appearance of lines or other features in the image.

Figures 17A, 17B, 17C, 17D:
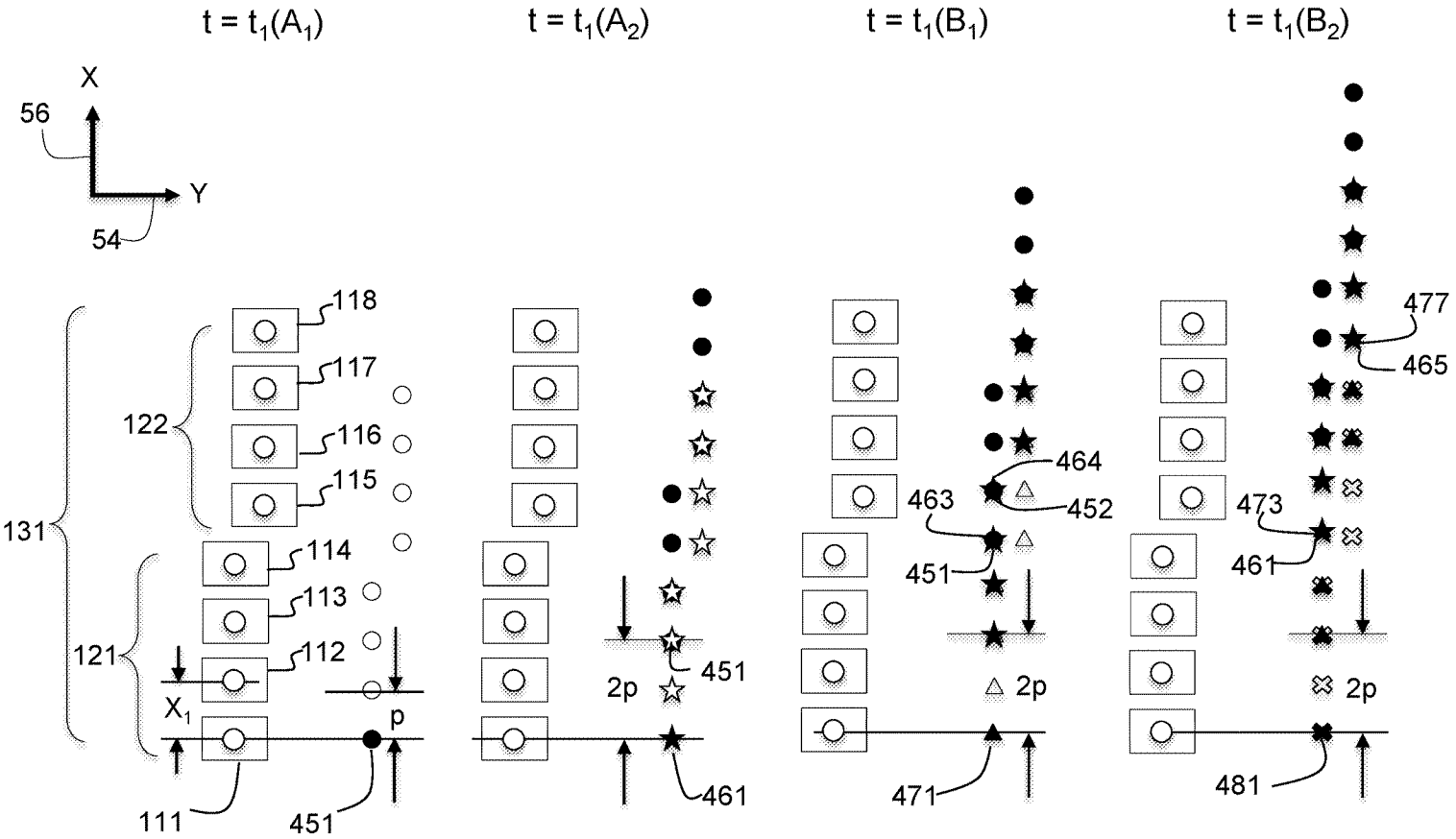
FIGS. 17A through 17D illustrate the printing of up to two drops per pixel according to an embodiment.

In some embodiments it can be advantageous to print multiple drops of ink on the same pixel location to increase ink coverage and enlarge the color gamut. FIGS. 17A through 17D illustrate the printing of up to two drops per pixel by doubling the number of strokes and timing the strokes appropriately using the drop ejector array arrangement described above with reference to FIG. 7. As was the case for FIGS. 15A through 16E, FIGS. 17A through 17D show only the drop ejectors and dot locations corresponding to groups 121 and 122 of bank 131 for simplicity. In FIG. 17A at an initial time $t_1(A_1)$ for a first stroke, an endmost drop ejector 111 from a first group 121 is enabled to fire during a first printing cycle to form a first dot 451 (represented as a filled circle) on the recording medium. Unfilled circles in FIG. 17A represent allowable dot positions from stroke $A_1$ that have not yet been enabled for printing. Spacing between allowable dot positions for first stroke $A_1$ is the scan direction pitch p. During the printing of the first stroke $A_1$, the recording medium moves at velocity V in the scan direction 56 relative to the drop ejectors. Similar to the discussion above relative to FIG. 15A, after waiting for time delay $\Delta t$ after firing the first drop ejector of the first group, successive drop ejectors from the first group are enabled to be fired in a successive printing cycles (not shown) to form successive dots represented by filled circles in FIG. 17B. The distance between consecutive dots printed during stroke $A_1$ is equal to the spacing between adjacent drop ejectors minus the distance that the recording medium has moved relative to the drop ejectors during the time $\Delta t$, i.e. $p=X_1-V\Delta t$.

In FIG. 17B at an initial time $t_1(A_2)$ for a second stroke, the endmost drop ejector 111 from the first group 121 is enabled to fire during a first printing cycle to form a first dot 461 (represented as a filled star) on the recording medium. In order to allow drops of ink printed during successive strokes to land on the same location, the recording medium is allowed to travel relative to the drop ejectors a distance 2p between the first printing cycle of the first stroke $A_1$ (FIG. 17A) and the first printing cycle of the second stroke $A_2$ (FIG. 17B). In other words, during a time 2p/V between the start of the first stroke $A_1$ and the start of the second stroke $A_2$ the recording medium moves relative to the drop ejectors by 2p in the scan direction 56. Unfilled stars in FIG. 17B represent allowable dot positions from stroke $A_2$ that have not yet been enabled for printing.

In FIG. 17C at an initial time $t_1(B_1)$ for a third stroke, the endmost drop ejector 111 from the first group 121 is enabled to fire during a first printing cycle to form a first dot 471 (represented as a filled triangle) on the recording medium. In order to allow drops of ink printed during successive strokes to land on the same location, the recording medium is allowed to travel relative to the drop ejectors a distance 2p between the first printing cycle of the second stroke $A_2$ (FIG. 17B) and the first printing cycle of the third stroke $B_1$ (FIG. 17C). In other words, during a time 2p/V between the start of the first stroke $A_1$ and the start of the second stroke $A_2$ the recording medium moves relative to the drop ejectors by 2p in the scan direction 56. Unfilled triangles in FIG. 17C represent allowable dot positions from stroke $B_1$ that have not yet been enabled for printing. FIG. 17C also shows printed dots that have landed in the same location on the recording medium. For example, dot 463 (represented as a filled star) that was printed as the third dot by drop ejector 113 during the second stroke has landed on top of dot 451 (represented as a filled circle) that was printed by drop ejector 111 as the first dot during the first stroke. Similarly, dot 464 (represented as a filled star) that was printed as the fourth dot by drop ejector 114 during the second stroke has landed on top of dot 452 (represented as a filled circle) that was printed by drop ejector 112 as the second dot during the first stroke.

In FIG. 17D at an initial time $t_1(B_2)$ for a fourth stroke, the endmost drop ejector 111 from the first group 121 is enabled to fire during a first printing cycle to form a first dot 481 (represented as a filled X) on the recording medium. In order to allow drops of ink printed during successive strokes to land in the same location, the recording medium is allowed to travel relative to the drop ejectors a distance 2p between the first printing cycle of the second stroke $B_1$ (FIG. 17C) and the first printing cycle of the fourth stroke $B_2$ (FIG. 17D). Unfilled X's in FIG. 17D represent allowable dot positions from stroke $B_2$ that have not yet been enabled for printing. FIG. 17D also shows additional printed dots from successive strokes that have landed in the same location on the recording medium. For example, dot 473 (represented as a filled triangle) that was printed by drop ejector 113 in the first group 121 as the third dot during the third stroke has landed on top of dot 461 (represented as a filled star) that was printed by drop ejector 111 in the first group 121 as the first dot during the second stroke. In addition, dot 477 (represented as a filled triangle) that was printed by drop ejector 117 in the second group 122 as the seventh dot during the third stroke has landed on top of dot 465 (represented as a filled star) that was printed by drop ejector 115 in the second group 122 as the fifth dot during the second stroke. Successive strokes beyond the fourth stroke allow each allowable pixel position in a pixel grid to be printed with up to two drops of ink in this example.

More generally, M drops can be printed on the same locations in M successive strokes, where M is not greater than the number $N_1$ of drop ejectors per group. Each stroke in a series of (M−1) consecutive subsequent strokes following the first stroke is timed relative to the first stroke such that subsequent-stroke dots formed on the recording medium by drops ejected from at least one drop ejector in each group during each of the subsequent strokes in the series of (M−1) consecutive subsequent strokes are disposed on allowable first-stroke dot locations on the recording medium.

In the example shown in FIG. 17C the first stroke and the second stroke jointly printed two drops of ink at allowable image dot locations on the recording medium. As described above, a first pair of dots 451 and 463 was jointly printed by the first stroke and the second stroke in one allowable image dot location. A second pair of dots 452 and 464 was jointly printed by the first stroke and the second stroke in another allowable image dot location. In general, the first stroke and at least one subsequent stroke in a series of (M−1) subsequent strokes can be controlled to enable jointly printing more than one drop of ink at allowable image dot locations on the recording medium.

An alternative usage of the capability of printing dots from different strokes at a same location is to provide printing redundancy, so that if one drop ejector fails, its dots can be printed by a different drop ejector during single pass printing. In a carriage printer (as described above in the background) multi-pass printing can be used to allow printing at particular locations on the recording medium using different drop ejectors after the recording medium is advanced along the array direction. However, multi-pass printing is significantly slower than single pass printing. By having a plurality of drop ejectors aligned along the scan direction 56 as shown in FIG. 7, printing redundancy can be provided in single-pass printing. As described earlier with reference to FIG. 8, if a single drop ejector in a group fails, it does not result in a white streak along the scan direction 56 due to the multiple drop ejectors in a group that cooperatively print the dots in a line along the scan direction. However, a failed drop ejector would result in isolated white dots in the image. Using redundant drop ejector printing, the isolated white dots corresponding to a failed drop ejector can be reduced or even eliminated.

For redundant drop ejector printing, the difference in printing method relative to the multiple-drops per pixel method described above with reference to FIGS. 17A through 17D is that in the redundant drop ejector printing method, only one of the strokes is used to print a given dot location. In other words, the first stroke and the at least one subsequent stroke in the series of (M−1) subsequent strokes are controlled to enable jointly printing up to one drop of ink at allowable image dot locations on the recording medium. Such control can be done routinely by alternating which stroke has responsibility for printing a dot in a line of dots along the scan direction. In this way, the number of isolated white dots corresponding to a failed drop ejector is reduced. Alternatively, the control can be done in response to an identified print defect. An identified defective drop ejector can be disabled and its printing data assigned to a corresponding functioning drop ejector that can print the dots instead. In such a way white dots can be eliminated and printing high quality images can be performed with high reliability, even if one or more drop ejectors fail.

In the various printing method embodiments described above, a direction 127 (FIG. 11B) from the first drop ejector 111 enabled to be fired in the first group 121 to the second drop ejector 112 enabled to be fired in the first group 121 is same as the recording medium travel direction (scan direction 56) relative to the drop ejectors. In such embodiments the scan direction pitch p is less than the spacing $X_1$ between drop ejectors along the scan direction 56. In other printing method embodiments a direction from the first drop ejector enabled to be fired in the first group to the second drop ejector enabled to be fired in the first group is opposite to the recording medium travel direction (scan direction 56) relative to the drop ejectors. In such embodiments the scan direction pitch p is greater than the spacing $X_1$ between drop ejectors along the scan direction 56.

FIGS. 18A through 18D are analogous to FIGS. 11A and 11C through 11E respectively and show the same configuration of drop ejectors (111-118), groups (121-124) and banks (131-132). The recording medium travels along the scan direction 56 relative to the drop ejectors as in FIGS. 11A through 11E. What is different in the print stroke illustrated in FIGS. 18A through 18D is that the order of firing the drop ejectors 111-118 is reversed. Rather than enabling firing the drop ejectors in the order 111, 112, 113, 114, 115, 116, 117 and 118, in FIGS. 18A through 18D, the firing order is 118, 117, 116, 115, 114, 113, 112 and 111. The direction 128 between the first drop ejector 118 enabled for firing in a group and the second drop ejector 117 enabled for firing in the group is in the opposite direction as the scan direction 56 relative to the drop ejectors.

Figures 18A, 18B, 18C, 18D:
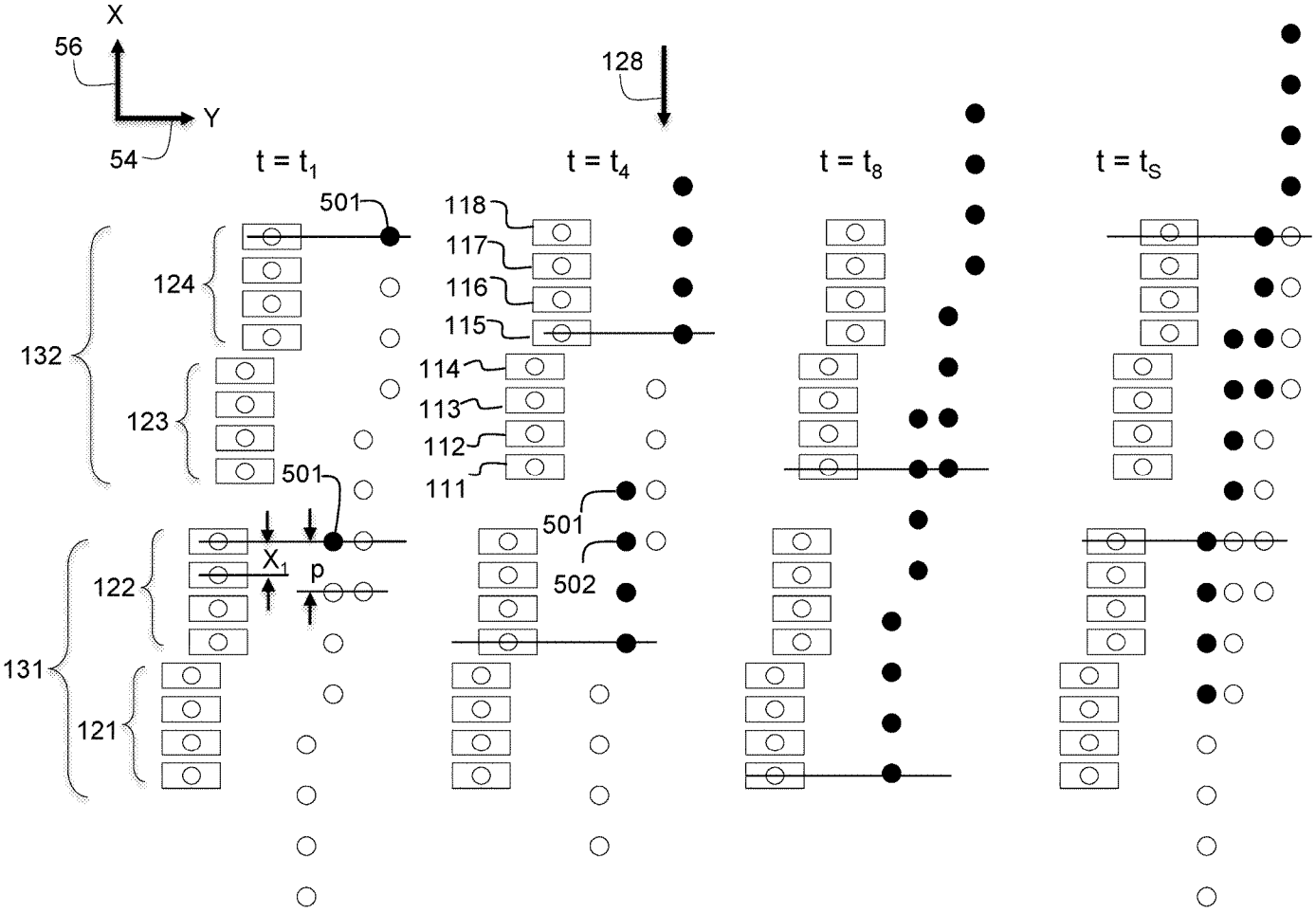
FIGS. 18A through 18D illustrate printing with a reversed firing order relative to FIGS. 11A through 11E according to an embodiment.

At $t=t_1$ FIG. 18A shows the dots 501 printed by drop ejectors 118 in banks 131 and 132 during a first print cycle of the print stroke. At $t=t_4$ FIG. 18B shows the dots printed by the end of the fourth print cycle after drop ejectors 118, 117, 116 and 115 in banks 131 and 132 have been fired. During each print cycle the recording medium moves a distance $V\Delta t$ relative to the drop ejectors along scan direction 56. The distance between dot 501 printed by drop ejector 118 during the first print cycle and dot 502 printed by drop ejector 117 during the second print cycle is scan direction pitch $p=X_1+V\Delta t$. Stated another way, $\Delta t=(p-X_1)/V$. At $t=t_8$ FIG. 18C shows the dots printed by the end of the eighth printing cycles after all eight drop ejectors 118 through 111 in each bank 131 and 132 have been fired. At $t=t_8$ FIG. 18D shows the position of the dots relative to the drop ejectors when the next stroke is ready to begin. Similar to the discussion with reference to FIGS. 11D and 11E, in order for the scan direction pitch p to remain constant along the scan direction 56, the recording medium must move a total distance of $N_1*p$ between the start of the first stroke at time $t_1$ and the start of the next stroke at time $t_S$, as illustrated in FIG. 11E where $N_1*p=4p$. In FIG. 18C at $t=t_8$, the recording medium has moved by $7V\Delta t=(N_1*N_2-1)V\Delta t$ relative to its first position in FIG. 18A. The extra distance that the recording medium needs to move between $t_8$ (FIG. 18C) and $t_S$ (FIG. 18D) is $N_1*p-(N_1*N_2-1)V\Delta t=N_1*p-(N_1*N_2-1)*(p-X_1)$. Thus there needs to be a delay time $\tau_3=t_S-t_8=(N_1*p-(N_1*N_2-1)*(p-X_1))/V$ after all $N_1*N_2$ drop ejectors in each bank have been fired in a first stroke before the second stroke begins.

An alternative way (not shown) to have the direction from the first enabled drop ejector of the first group to the second enabled drop ejector of the first group be opposite the scan direction 56 is to keep the firing order the same as in FIG. 11B (direction 127), but reverse the direction of the relative travel of the recording medium. As described above with reference to FIG. 10, a sequencer 175 can be used to reverse the firing order and that is typically easier than reversing the medium travel direction, especially for single-pass printing.

An advantage of having the direction from the first enabled drop ejector of the first group to the second enabled drop ejector of the first group be opposite the scan direction 56, so that the scan direction pitch p is greater than the drop ejector spacing $X_1$ is that ink coverage is reduced. In other words, a higher resolution print mode can be provided by having the firing order and recording medium travel direction as described with reference to FIGS. 11A through 11E, and an ink-saver print mode can be provided by reversing the firing order as described with reference to FIGS. 18A through 18D. Furthermore, ink spreads differently on different types of recording medium. For a low ink-spread recording medium it can be advantageous to cause the dots to be printed closer together along scan direction 56 by having the firing order and recording medium travel direction as described with reference to FIGS. 11A through 11E. For a high ink-spread medium it can be advantageous to cause the dots to be printed farther apart along scan direction 56 by reversing the firing order as described with reference to FIGS. 18A through 18D.

In addition, it is contemplated that interlacing modes can be used with reversed firing order, although such embodiments are not described in detail herein. Such interlaced modes with reversed firing order can provide scan direction pitches that are different from the scan direction pitches that are achievable using the interlacing modes described above with reference to FIGS. 15A through 16E.

In the printing method embodiments described above, drop ejectors in each bank in each column are simultaneously fired. In other embodiments (not shown) drop ejectors in different groups in different columns are simultaneously fired, but no other drop ejectors within the same column are fired simultaneously. Additionally in the embodiments described above, groups of drop ejectors within a bank are fired sequentially in a left to right direction across the bank of groups. In other embodiments (not shown) groups of drop ejectors within a column can be fired in nonsequential order across the column.

A more general way to describe a printing method using the inkjet printing system 1 of FIG. 6 including a printhead 50 having a two-dimensional array 150 of drop ejectors 212 that are fluidically connected to a common ink source 290, where the two-dimensional array 150 includes spatially offset groups 120 of drop ejectors 212, each group having a plurality of drop ejectors 212 that are aligned substantially along the scan direction 56 is as follows: Image data is provided to inkjet printhead 50 from image data source 2 via image processing unit 3 and controller 4, which use the image data to control whether or not a drop ejector 212 is fired when it is enabled. During the ejection of ink drops, transport mechanism 6 continuously advances the recording medium 62 relative to the printhead 50 along the scan direction. Controller 4 and addressing circuitry 170 (FIG. 9) enable simultaneous firing of drop ejectors 212 that are corresponding members of a first set of groups 120. Controller 4 and addressing circuitry 170 (FIG. 9) enable sequential firing of individual drop ejectors 212 within each group 120 of the first set of groups until each member of each group has had opportunity to fire. Controller 4 and addressing circuitry 170 (FIG. 9) enable simultaneous firing of drop ejectors 212 that are corresponding members of a second set of groups 120. Controller 4 and addressing circuitry 170 (FIG. 9) enable sequential firing of individual drop ejectors 212 within each group 120 of the second set of groups. Controller 4 and addressing circuitry 170 (FIG. 9) successively enable likewise firing of any additional groups 120 in the two-dimensional array 150 until all drop ejectors in the two-dimensional array 150 have had opportunity to fire during a first stroke. The process of enabling the firing of drop ejectors 212 of the two-dimensional array continues in subsequent strokes similar to the first stroke as the recording medium 62 is moved relative to the printhead 50 along the scan direction 56 until printing of the image with ink from the common ink source 290 according to the image data is completed.

Figure 19:
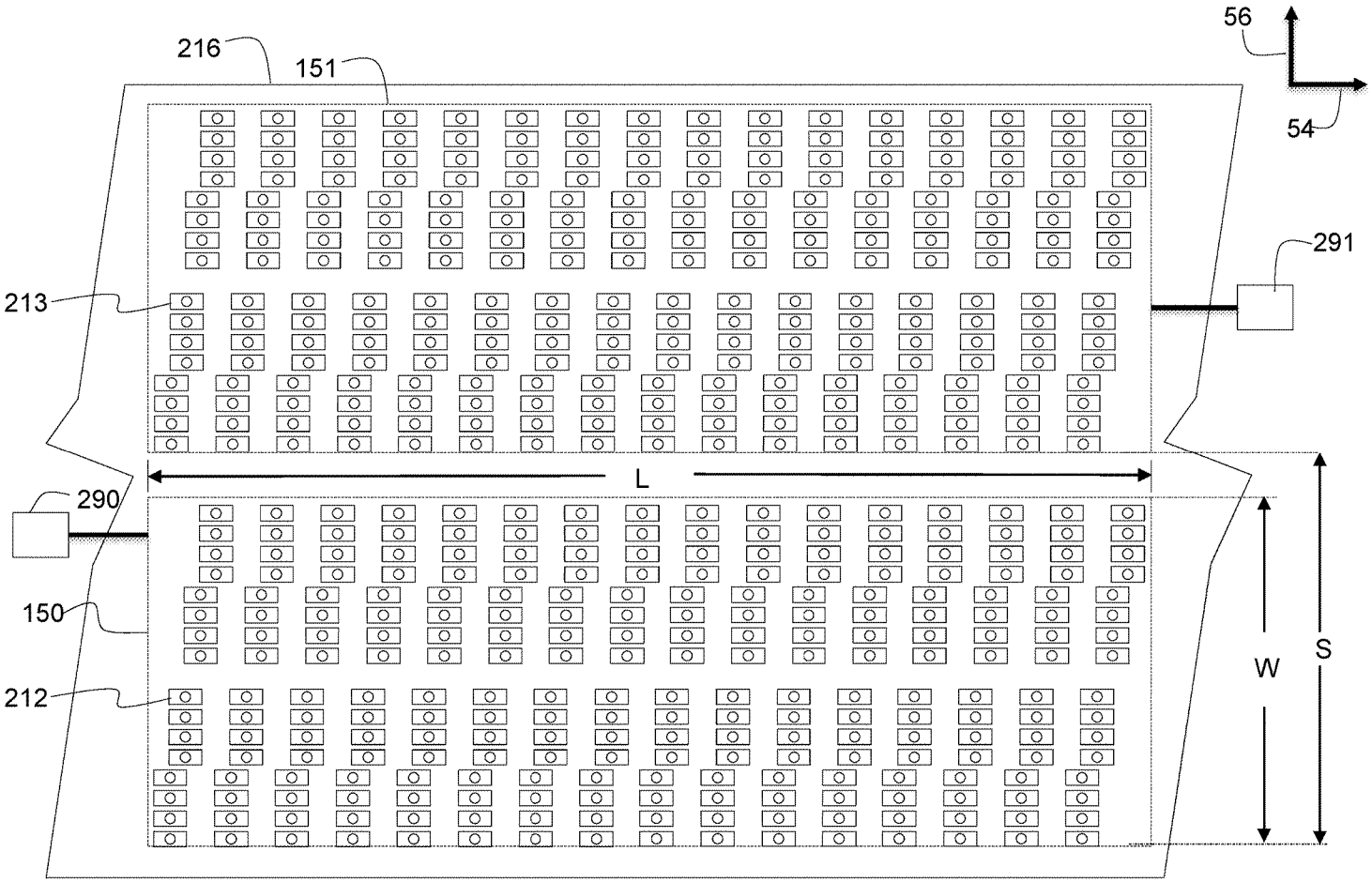
FIG. 19 shows a top view of a printhead die having a pair of two-dimensional arrays of drop ejectors that are separated along the scan direction according to an embodiment.

Printhead die 215 described above relative to FIGS. 6-9 includes a single two-dimensional array 150 of nominally identical drop ejectors and is part of inkjet printhead 50 (FIG. 6). Such a printhead die 215 is capable of monochrome printing of ink from first ink source 290. FIG. 19 shows a printhead die 216 that can be included in inkjet printhead 50 in other embodiments. Printhead die 215 includes a first two-dimensional array 150 of first drop ejectors and a second two-dimensional array 151 of second drop ejectors that is separated from the first two-dimensional array 150 by an array spacing S along the first direction, i.e. along the scan direction 56. In some embodiments the second two-dimensional array 151 is in fluidic communication with a second ink source 291 that is different from the first ink source 290. For example, for a printhead die 216 to be used for color printing, ink source 290 can be cyan ink and ink source 291 can be magenta ink. Inkjet printhead 50 can also include additional two-dimensional arrays (not shown) that are in fluidic communication with corresponding additional ink sources (not shown), such as yellow ink and black ink. These additional two-dimensional arrays can be included on the same printhead die 216 or on a separate printhead die.

Second two-dimensional array 151 has a similar configuration of columns, banks and groups of second drop ejectors 213 as first two-dimensional array 150 of first drop ejectors 212. Second drop ejectors 213 in the second two-dimensional array 151 are fired in similar stroke fashion as the first drop ejectors 212 of the first two-dimensional array 150, as described above for the various printing methods. Strokes for firing the second drop ejectors 213 of the second array 151 are delayed relative to corresponding strokes for firing the first drop ejectors 212 by a delay time S/V, where the recording medium moves at velocity V along the scan direction 56 relative to the printhead die 216. In this way, drops ejected from second two-dimensional array 151 can land on the same pixel grid of dot locations as drops ejected from first two-dimensional array 150 corresponding to image data from image source 2 (FIG. 6) in order to form color print images.

In order to provide the desired nominal drop volume for different inks it can be advantageous for the second drop ejectors 213 in the second two-dimensional array 151 that are in fluidic communication with second ink source 291 to have a different structure than the first drop ejectors 212 in the first two-dimensional array 151 that are in fluidic communication with the first ink source 290. For example the nozzle diameters can be different, the pressure chamber geometries can be different or the actuator sizes can be different for drop ejectors 212 and 213.

As described above with reference to FIG. 6, two-dimensional arrays 150 and 151 have a width W along the scan direction 56 and a length L along the array direction 54, where L is greater than W. It is advantageous for the length L along a direction perpendicular to scan direction 56 to be long, in order to allow printing a large area of the recording medium 62 with ink drops from both ink sources 290 and 291 in a single pass or in a single swath. In a color printhead one can determine from the drop ejector array configuration which dimension of the two-dimensional array corresponds to the scan axis X and which dimension of the two-dimensional array corresponds to the array axis Y. In order for different two-dimensional arrays to print drops in the same location on the recording medium, they must be separated from each other along the scan axis X. Therefore, for a color printhead (even without looking at the transport mechanism for providing relative motion of the recording medium and the printhead) one can determine that the width dimension W (that is shorter than the length dimension L) of the two-dimensional arrays extends along the scan direction 56.

Figure 20:
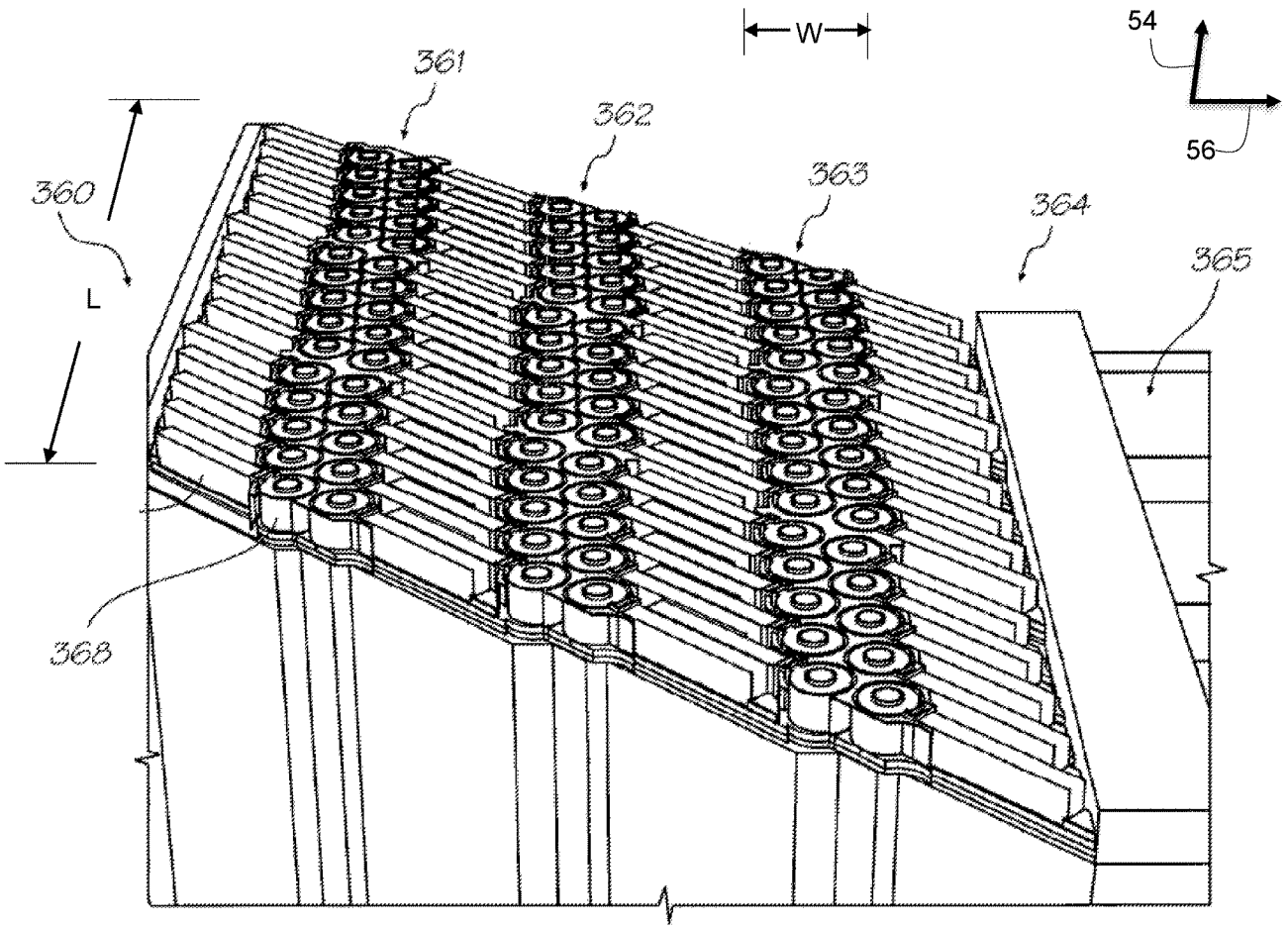
FIG. 20 shows a prior art drop ejector configuration for color printing.

In the prior art there are various two-dimensional array configurations of drop ejectors. Prior art FIG. 20 shows the drop ejector array of U.S. Pat. No. 6,991,318 as depicted in FIG. 85 of that patent (where array direction 54, scan direction 56, length L and width W have been added to FIG.

20). A portion 360 of an array of ink ejection nozzle sets 361-363 is shown with each set providing separate color output (cyan, magenta and yellow) for color printing. Address circuitry 364 and bond pads 365 are also shown. Each set of color nozzles 361-363 contains two spaced apart rows of ink ejection nozzles 368. At first glance the drop ejector arrangement in a given nozzle set (such as nozzle set 361) appears similar to the arrangement shown in FIG. 7. In each of the two nozzle rows of nozzle set 361 in array portion 360 there are three groupings of five nozzles, where the groupings are offset from one other. However nozzle sets 361-363 correspond to different colors so as discussed above, they are separated from each other along the scan direction 56. Therefore the three nozzle groupings of five nozzles in each row do not extend along the scan direction 56, but rather along the array direction 54. (The width W of each nozzle set does not extend along the scan direction 56, but rather along array direction 54.) As such, the drop ejectors in each of the groupings cannot cooperatively print a line of dots along the scan direction 56, but rather a single nozzle 368 in each grouping is responsible for printing all dots in a line that is printed along the scan direction 56. The purpose of the two staggered rows of nozzles 368 in each nozzle set 361-363 is to provide higher resolution printing along the array direction 54 as can be seen more clearly in FIG. 87 of U.S. Pat. No. 6,991,318.

With reference again to FIG. 19, in some embodiments, second ink source 291 is the same as first ink source 290 and the drop ejectors 212 and 213 have different structures to provide different drop sizes for the same ink. In other words, in order to print in gray scale, first drop ejectors 212 can be configured to print small dots and second drop ejectors 213 can be configured to print larger dots.

Figure 21:
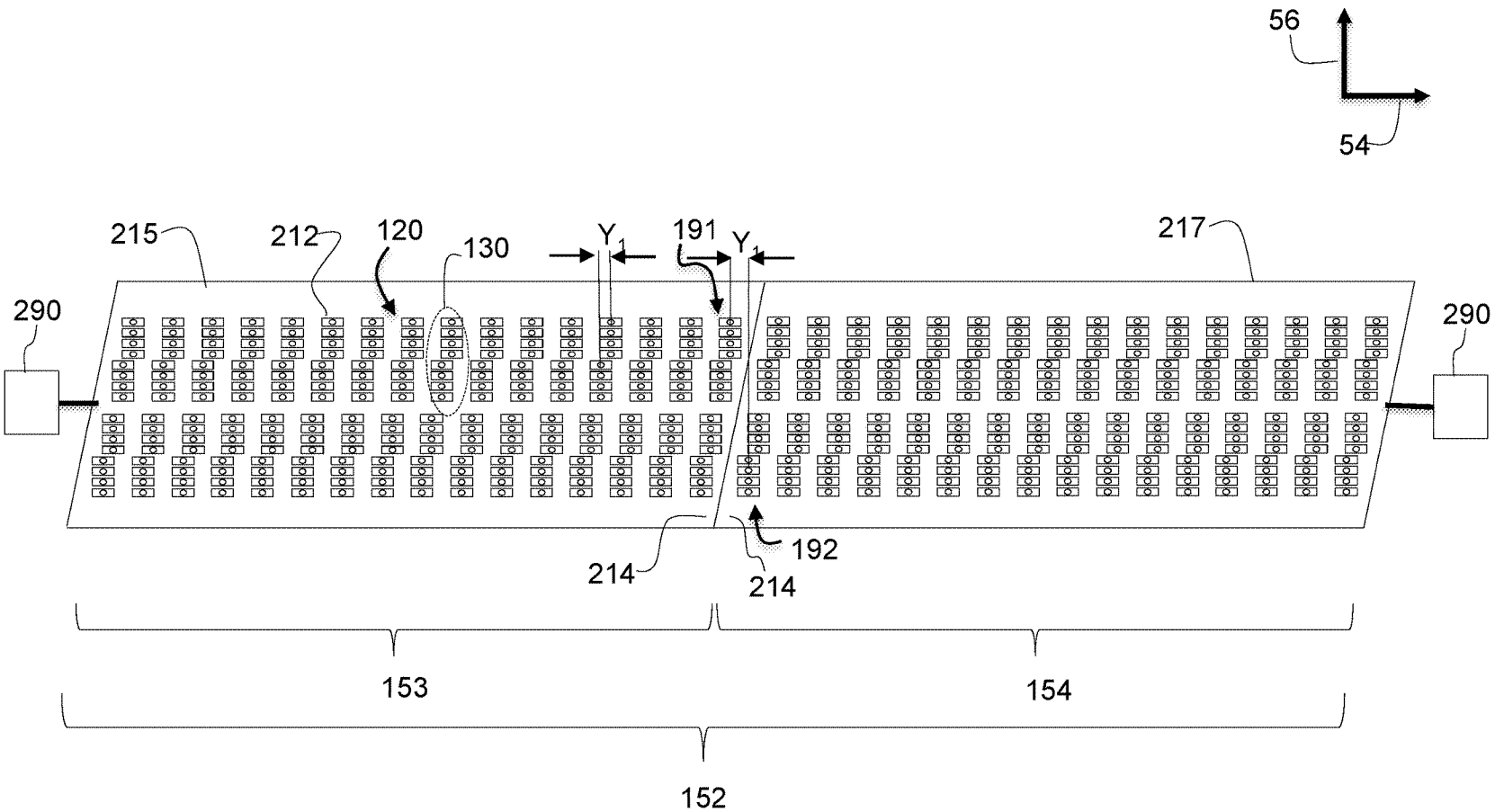
FIG. 21 shows a pair of butted printhead die according to an embodiment.

In some embodiments, especially for pagewidth printheads, it is impractical to provide on a single printhead die all the required drop ejectors in a two-dimensional array that is long enough to extend across a recording medium. FIG. 21 shows a first printhead die 215 and a substantially identical second printhead die 217 that is displaced along the array direction 54 from the first printhead die 215 and butted end to end along butting edges 214. Note: the term "butted end to end" is meant herein to describe close adjacency of the two printhead die without necessarily implying physical contact at the butting edges 214. The two-dimensional array 152 of drop ejectors 212 includes a first two-dimensional array 153 disposed on the first printhead die 215 and a substantially identical two-dimensional array 154 of drop ejectors disposed on the second printhead die 217. Both two-dimensional array 153 and two-dimensional array 154 are configured to be in fluidic communication with the first ink source 290. In the example shown in FIG. 21, in order to maintain a consistent spacing between groups along the array direction 54, adjacent groups 120 within each bank 130 are substantially evenly spaced apart by first offset $Y_1$ along array direction 54; and a first endmost group 191 of the first two-dimensional array 153 and a second endmost group 192 of the substantially identical two-dimensional array 154 are spaced apart along the array direction 54 by a distance that is substantially equal to the first offset $Y_1$.

Figure 22:
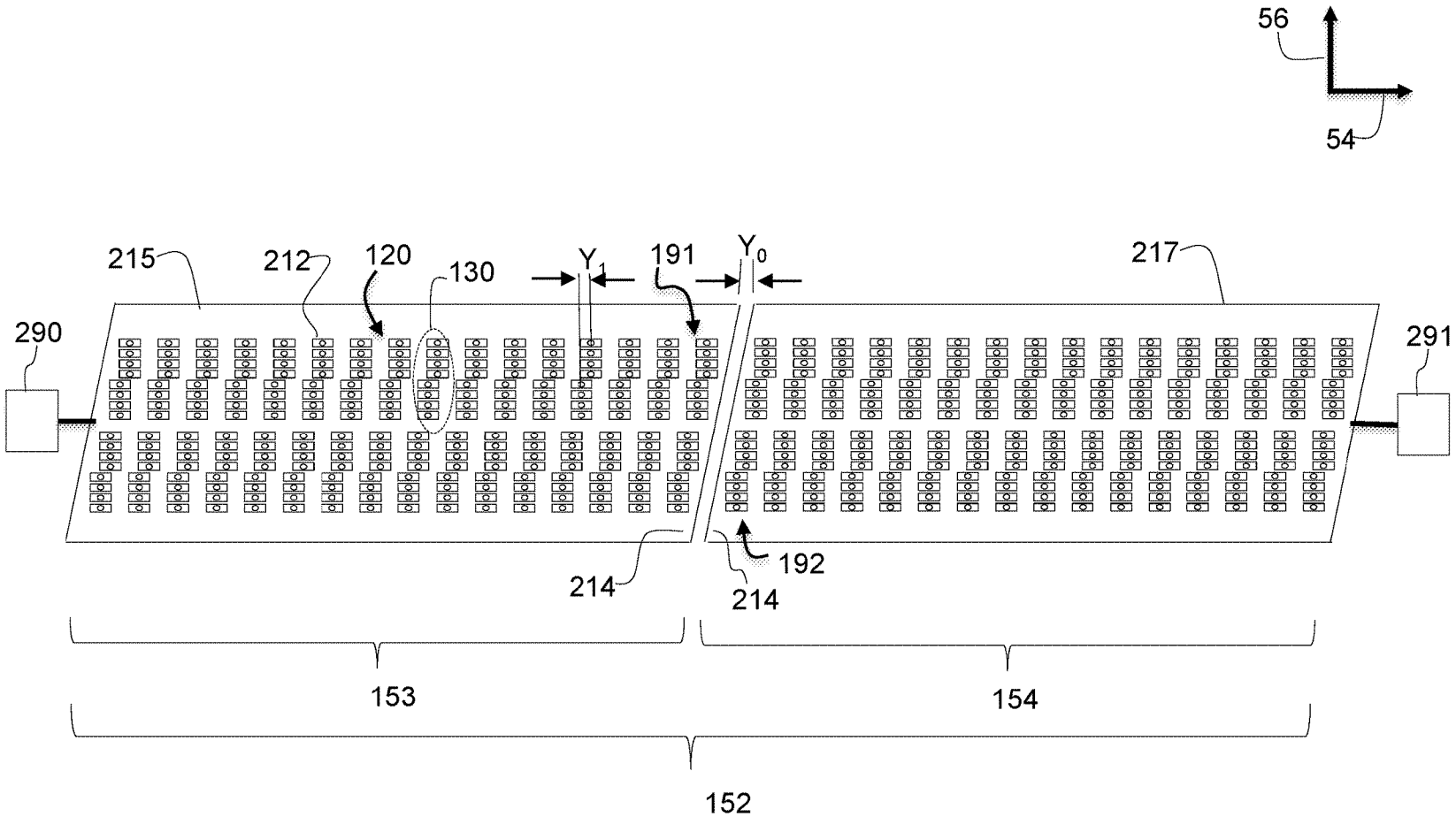
FIG. 22 shows a pair of printhead die that are in fluidic communication with different ink sources according to an embodiment.

FIG. 22 shows a first printhead die 215 and a substantially identical second printhead die 217 that is displaced along the array direction 54 from the first printhead die 215 and is spaced apart from the first printhead die 215 by a distance $Y_0$. The two-dimensional array 152 of drop ejectors 212 includes a first two-dimensional array 153 disposed on the first printhead die 215 and a substantially identical two-dimensional array 154 of drop ejectors disposed on the second printhead die 217. The drop ejectors 212 on the first printhead die 215 includes an ink inlet that is configured to be in fluidic communication with the first ink source 290 and the drop ejectors 212 on the substantially identical second printhead die 217 includes an ink inlet that is configured to be in fluidic communication with a second ink source 291 that is different from the first ink source. The separation $Y_0$ provides necessary area required to seal and separate the ink supply to the first printhead die 215 and the ink supply to the second printhead die 217.

Figure 23:
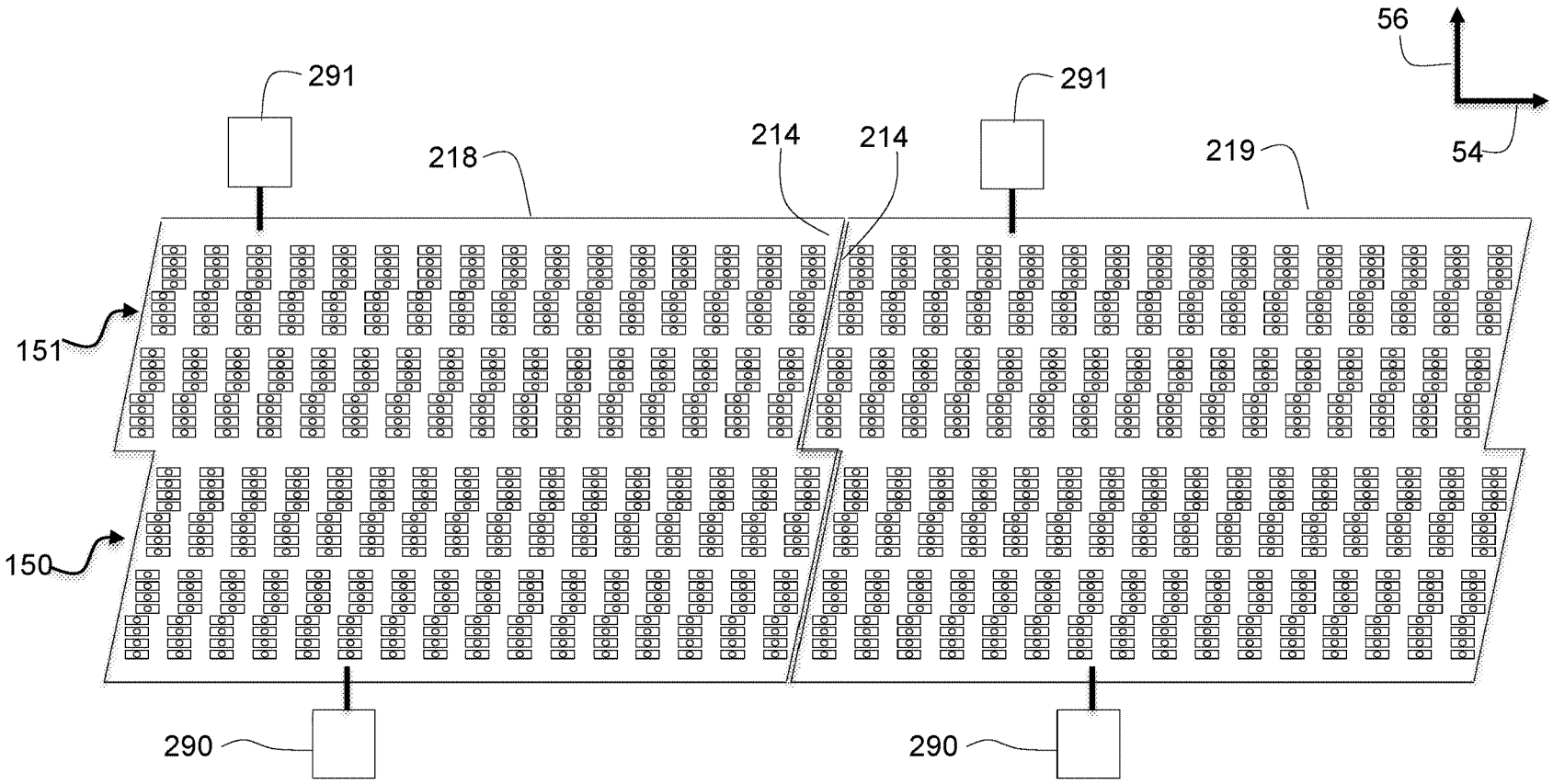
FIG. 23 shows a pair of butted printhead die each having a pair of two-dimensional arrays of drop ejectors according to an embodiment.

FIG. 23 shows a pair of printhead die 218 and 219 that are butted end to end along butting edges 214 similar to FIG. 21. Printhead die 218 and 219 each include a first two-dimensional array 150 of first drop ejectors and a second two-dimensional array 151 of second drop ejectors that is separated from the first two-dimensional array 150 along the first direction, i.e. along the scan direction 56. The first two-dimensional array 150 in each printhead die 218 and 219 is in fluidic communication with a first ink source 290. The second two-dimensional array 151 in each printhead die 218 and 219 is in fluidic communication with a second ink source 291 that is different from the first ink source 290. The butting edges 214 of printhead die 218 and printhead die 219 include stepped features that facilitate maintaining the spacing $Y_1$ between endmost drop ejector groups of two-dimensional array 150 and two-dimensional array 151.

Figure 24A:
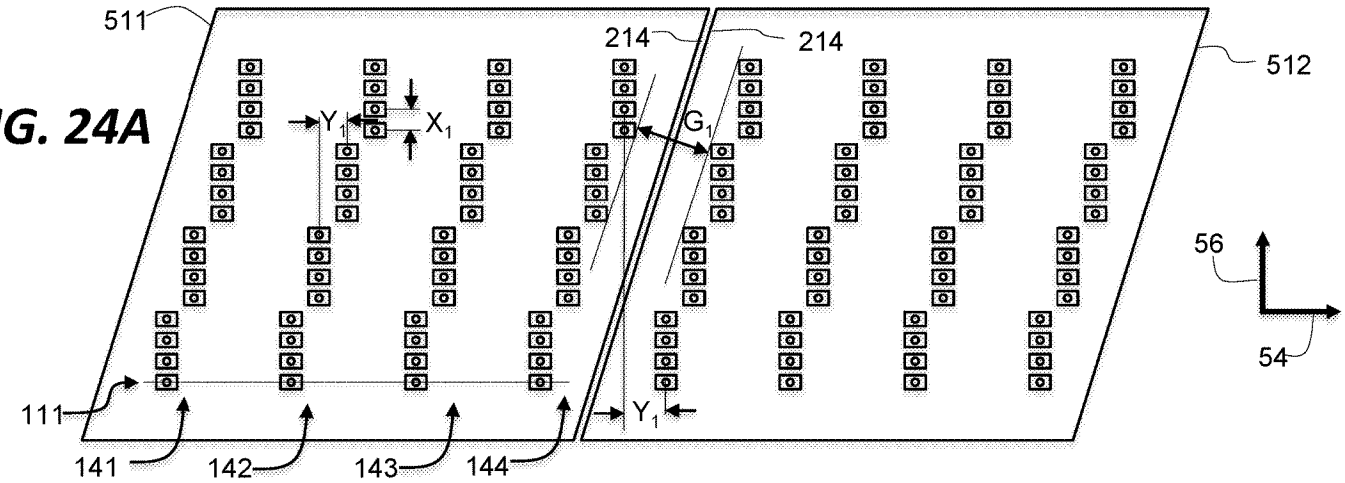
FIG. 24A shows a pair of butted printhead die where corresponding drop ejectors in each column are aligned along the array direction as in FIG. 7.

FIG. 24A shows a pair of printhead die 511 and 512 that are butted end to end at butting edges 214. The drop ejector configuration on both printhead die 511 and 512 is similar to that shown in FIG. 7. In the lowermost groups in columns 141, 142, 143 and 144, the lowermost drop ejectors 111 are all aligned along the array direction 54. There is a gap spacing $G_1$ between outermost portions of nearest neighbor drop ejectors on printhead die 511 and printhead die 512. It is desirable to increase gap spacing $G_1$ while still maintaining the spacing $Y_1$ between endmost adjacent drop ejector groups on the two printhead die 511 and 512 in order to provide room for any electronics or other components near butting edges 214, as well as to allow a small spacing between adjacent butting edges 214.

Figure 24B:
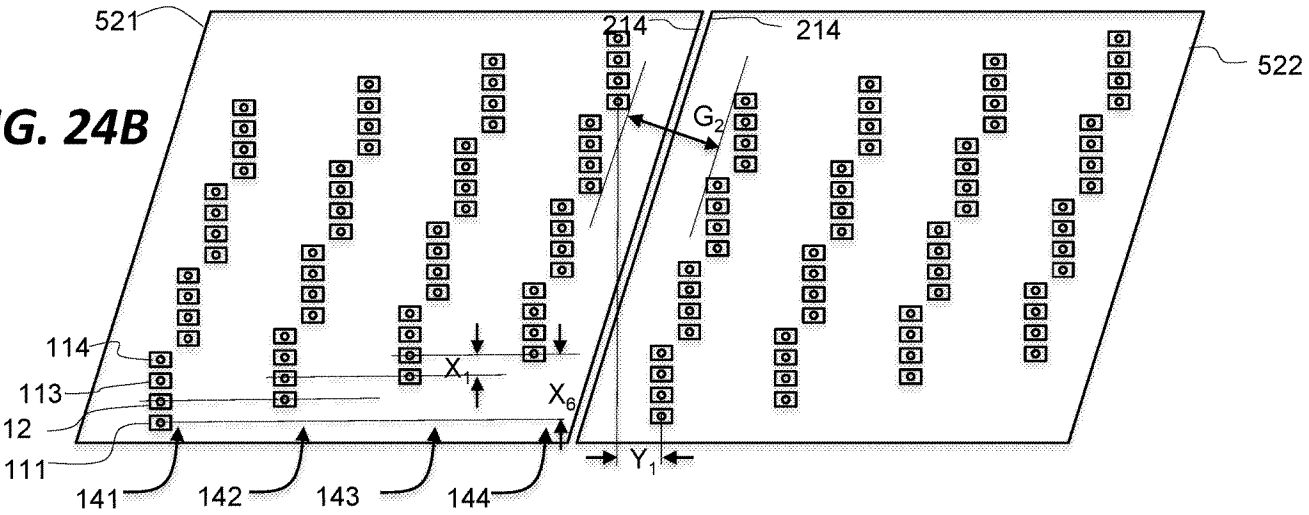
FIG. 24B shows a pair of butted printhead die where adjacent columns of drop ejectors are displaced along the scan direction by one unit of drop ejector spacing according to an embodiment.

FIG. 24B shows a pair of printhead die 521 and 522 that are butted end to end at butting edges 214. In the two-dimensional array of drop ejectors formed on each printhead die 521 and 522, adjacent columns of drop ejectors are displaced along scan direction 56 by a distance $X_1$. As a result, drop ejector 112 in column 141 is aligned with drop ejector 111 in column 142; drop ejector 112 in column 142 is aligned with drop ejector 111 in column 143; and drop ejector 112 in column 143 is aligned with drop ejector 111 in column 144. A distance $X_6$ along scan direction 56 between drop ejector 111 in first column 141 and corresponding drop ejector 111 in last column 144 is $X_6=3X_1=(N_4-1)*X_1$. It can be seen in FIG. 24B that the gap spacing $G_2$ between outermost portions of nearest neighbor drop ejectors on printhead die 521 and printhead die 522 is larger than the gap spacing $G_1$ between outermost portions of nearest neighbor drop ejectors on printhead die 511 and printhead die 512 in FIG. 24A. Gap $G_2$ increases as $X_6$ increases. Although the difference between G1 and G2 does not seem large in the example shown in FIGS. 24A and 24B where the number of columns $N_4=4$, the difference is larger for printhead die having a larger number of displaced columns. In addition, the displacement of adjacent columns in FIG. 24B is $X_1$. More generally the displacement of adjacent columns can be $m*X_1$, where m is an integer, and $X_6=m*(N_4-1)*X_1$.

Figure 25:
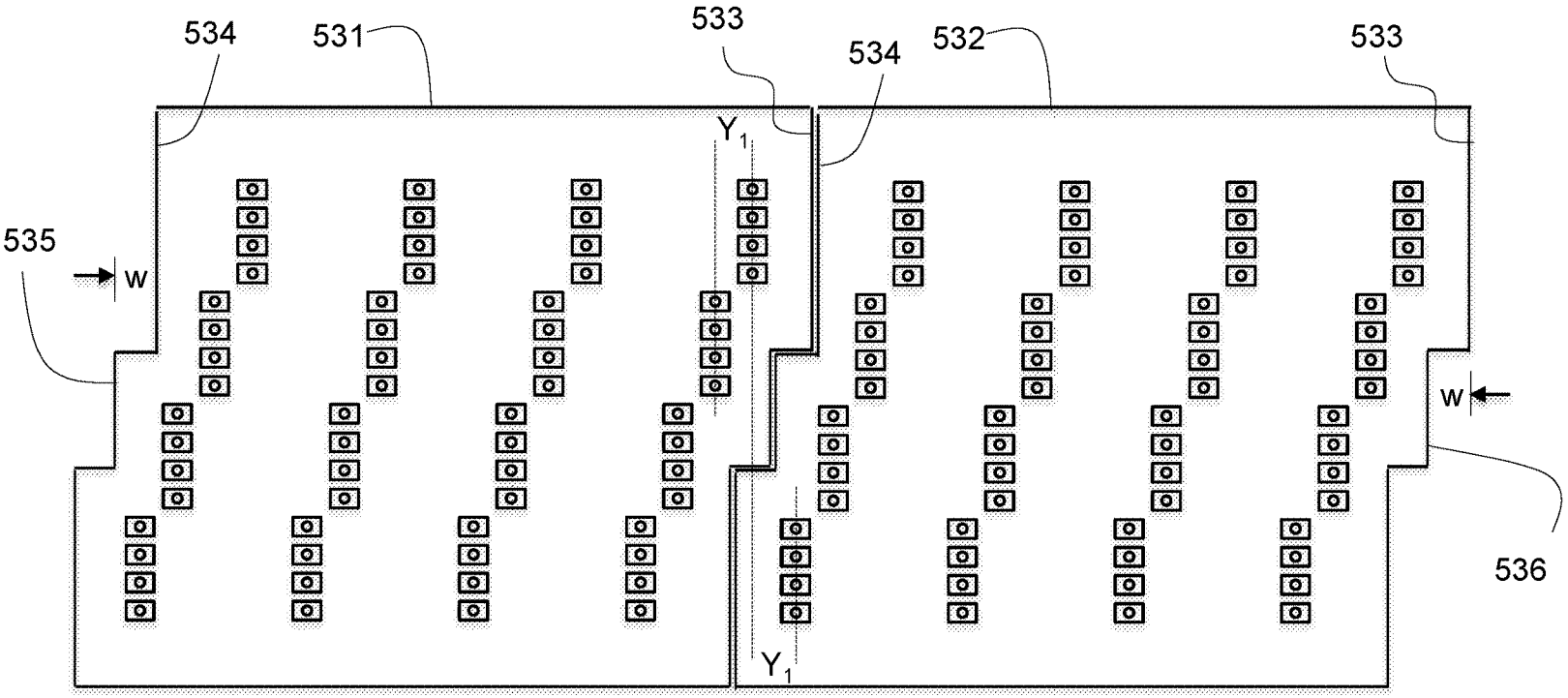
FIG. 25 shows a pair of butted printhead die where adjacent butting edges include steps that are positioned in complementary fashion.

FIG. 25 illustrates a pair of printhead die 531 and 532 that are butted end to end at butting edges 533 and 534 respectively. Unlike examples described above where butting edges 214 are straight, butting edges 533 and 534 include steps 536 and 535 respectively. Each printhead die 531 and 532 has a left-side butting edge 534 having steps 535 that project outwardly toward the left by a step width w, and a right-side butting edge 533 having steps 536 that project inwardly toward the left by a step width w. The steps 536 of butting edge 533 of printhead die 531 and butting edge 534 of printhead die 532 can be positioned in substantially complementary fashion at the point of adjacency of printhead die 531 and 532. In this way maintaining the spacing $Y_1$ between endmost drop ejector groups on the two printhead die 531 and 532 is facilitated. Although the steps 535 and 536 are shown in FIG. 25 are shown as having sharp corners, in practice the corners of steps can be rounded in order to avoid the occurrence of stress concentrators that can result in structural weakness.

Many printhead die are typically fabricated together on a single wafer of silicon, for example. After wafer processing is completed, it is necessary to separate the individual printhead die from the wafer. For printhead die having straight edges, the printhead die can be separated from the wafer by dicing. However, if the edges of printhead die are stepped, as in the example shown in FIGS. 23 and 25, portions of such steps would be cut through during dicing. One way to precisely form the steps 535 and 536 is to use an etching process, such as deep reactive ion etching, which can provide feature delineation through the wafer with accuracy on the order of one micron. Another way to precisely form the steps 535 and 536 is to use a laser cutting process.

Figure 26:
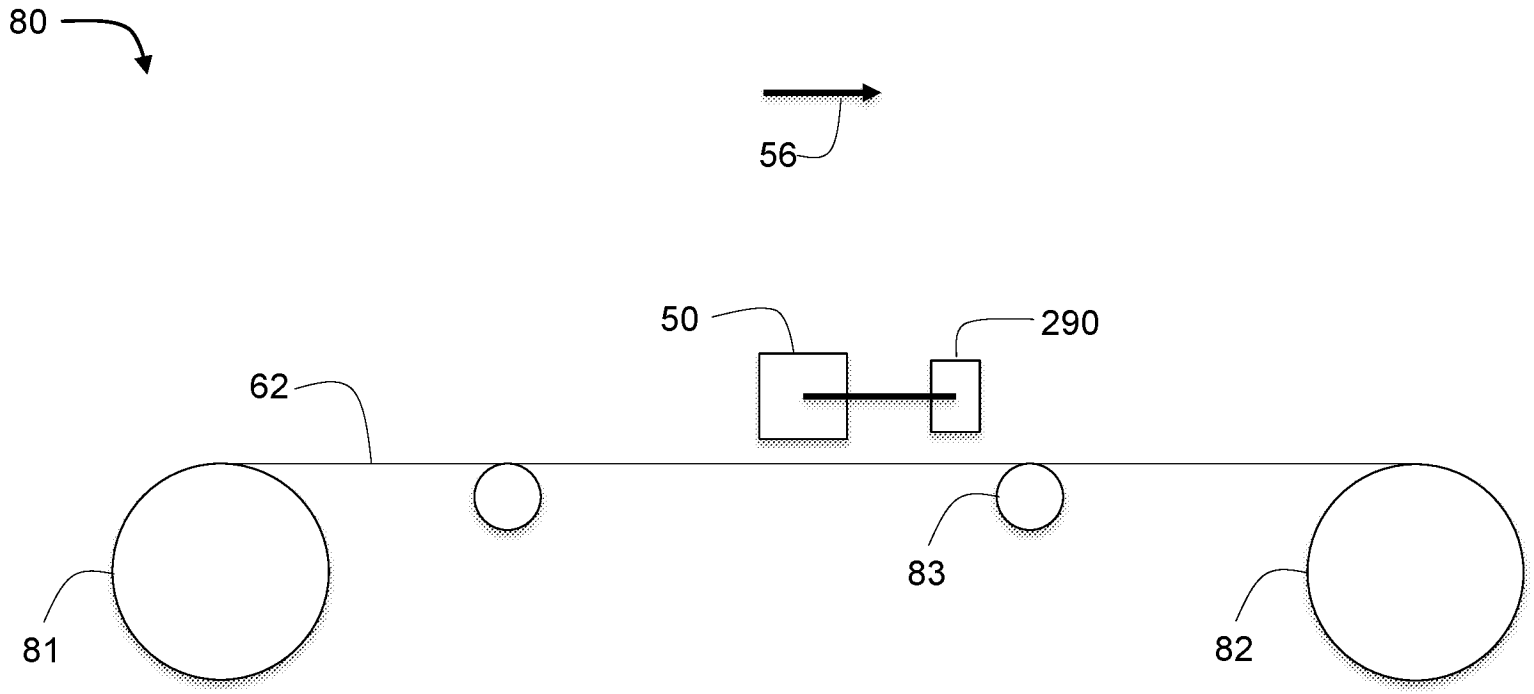
FIG. 26 schematically represents a roll-to-roll inkjet printing system that can be used in some embodiments.

FIG. 26 schematically shows an example of a roll-to-roll printing system 80 that can be used with a printhead 50 having one or more two-dimensional arrays of drop ejectors as described in embodiments above. A stationary inkjet printhead 50 is in fluidic communication with a first ink source 290. A web of recording medium 62 is advanced from a source roll 81 to a take-up roll 82 along scan direction 56 and is guided by one or more rollers 83. The direction of relative motion between the recording medium 62 and the printhead 50 remains constant throughout the printing process. If a color printhead with multiple two-dimensional arrays in fluidic communication with different ink sources is used as described above with reference to FIG. 22, the constant direction of relative motion between the recording medium 62 and the printhead 50 means that the order of printing of different colors always remains the same during single-pass printing. For example, the drop ejectors in two dimensional array 150 always print ink from first ink source 290 before drop ejectors in two dimensional array 151 print ink from second ink source 291. Maintaining the same order of color laydown helps to provide a more consistent image appearance. Printhead 50 is long enough to span the web of recording medium 62, or at least the portion of recording medium 62 that is to be printed.

Figure 27:
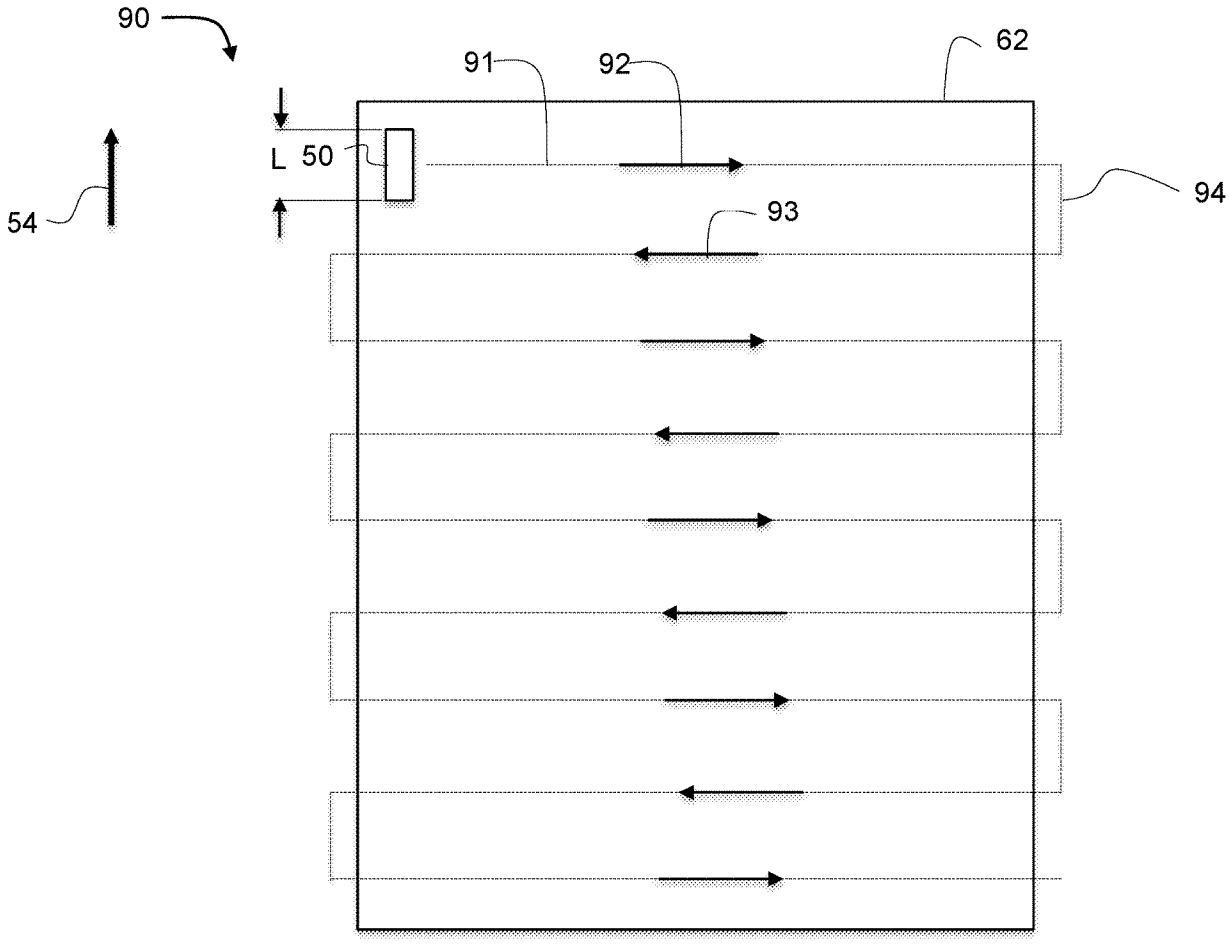
FIG. 27 schematically represents a carriage printing system that can be used in some embodiments.

FIG. 27 schematically shows an example of a carriage printing system 90 that can be used with a printhead 50 having one or more two-dimensional arrays of drop ejectors as described in embodiments above. The two-dimensional array has a length L along array direction 54 as described above. A carriage (not shown) moves printhead 50 along a carriage path 91. In a first pass, the carriage moves printhead 50 in forward direction 92 as the drop ejectors print a first swath on the recording medium 62. At the end of the swath the recording medium 62 is advanced as represented by media advance 94. In a second pass the carriage moves printhead 50 in a reverse direction 93 as the drop ejectors print a second swath. In successive bidirectional printing swaths the image is printed on recording medium 62. In bidirectional printing the scan direction reverses for each successive swath. As described above with reference to FIGS. 11A-11E and 18A-18D, whether the scan direction pitch p is greater than or less than the ejector spacing $X_1$ depends on whether the firing order is such that the direction 127 between the first ejector and the second ejector in a group enabled for firing is the same as the scan direction, or such that the direction 128 between the first ejector and the second ejector in a group enabled for firing is opposite to the scan direction. In order to keep the scan direction pitch constant from swath to swath in a bidirectional carriage printing system 90, it is necessary to reverse the firing order on each successive swath. Optionally the successive swaths can be partially overlapping. An advantage of using two-dimensional arrays of the types described in embodiments above is that multiple nozzles in each group cooperatively print the pixels in any given line across the recording medium 62 parallel to the carriage path 91. Therefore, extensive overlap between adjacent swaths is not necessary for disguising printing defects. Optionally a small overlap in swaths can be used to disguise variations in the media advance 94. Having a smaller swath overlap enables faster printing throughput relative to prior art carriage printing systems that use multi-pass printing to achieve high quality printing.

If a color printhead such as the printhead shown in FIG. 23 is used in a bidirectional inkjet printing system 90, it can be necessary to adjust the image to correct for color shift due different orders of color laydown in adjacent swaths as the carriage moves the printhead 50 in the forward direction 92 and then in the reverse direction 93. For example, cyan dots can be printed over magenta dots in forward direction 92, and magenta dots can be printed over cyan dots in reverse direction 93 providing a different appearance. Some prior art printheads have had mirror-symmetric arrangements of color drop ejectors. For example, a three-color mirror symmetric printhead can have five drop ejector arrays, including a central yellow array that is bordered on either side by two magenta arrays and having outer cyan arrays. An embodiment of the drop ejector configuration of FIG. 7 is contemplated where the distance $X_5$ between two adjacent banks of drop ejectors is not on the order of $2X_1$, but rather is large enough to accommodate a drop ejector array for printing a second color ink between drop ejector banks that both print a first color ink.

If a color printhead such as the printhead shown in FIG. 22 is used in a bidirectional inkjet printing system 90, it is not necessary to adjust the image to correct for color shift because the orders of color laydown in adjacent swaths is unchanged as the carriage moves the printhead 50 in the forward direction 92 and then in the reverse direction 93.

Figure 28C:
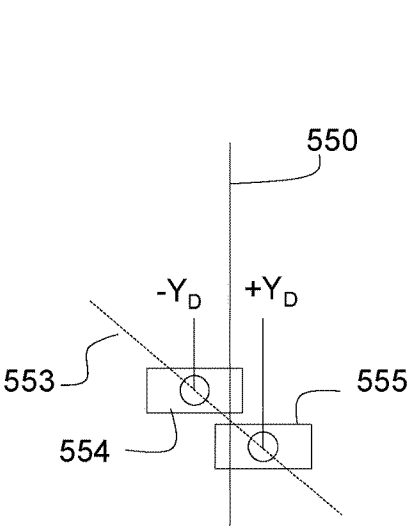
FIG. 28C shows a pair of drop ejectors and a best-fit line along the scan direction.
Figure 28B:
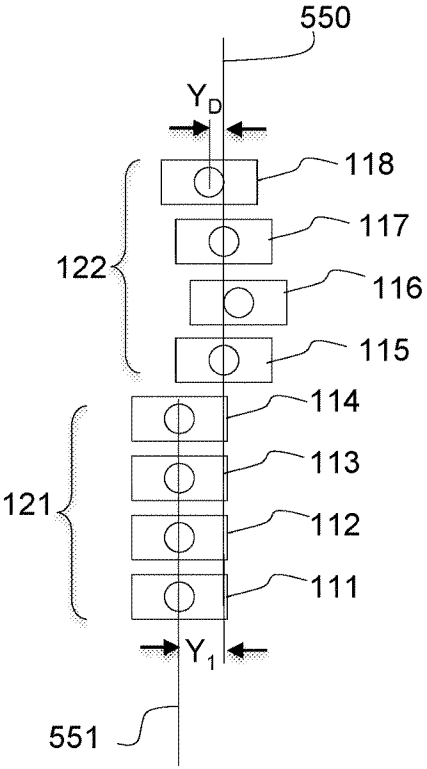
FIG. 28B shows a group of drop ejectors that is perfectly aligned and a group of drop ejectors that is not perfectly aligned along the scan direction.
Figure 28A:
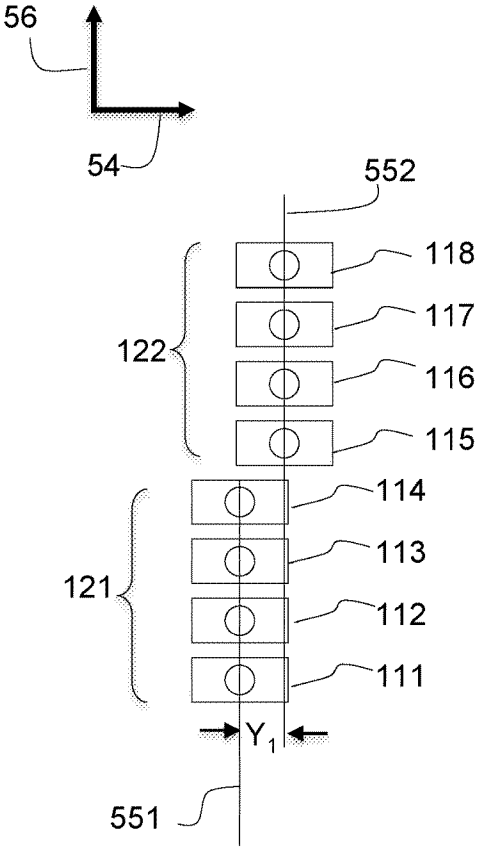
FIG. 28A shows two groups of drop ejectors that are perfectly aligned along the scan direction.

At least some of the examples above have been described and shown in idealized forms. For example, in FIG. 7 drop ejectors 111-114 in group 121 have been shown as being perfectly aligned along scan direction 56. In the real world small deviation from perfect alignment is contemplated when it is said herein that the drop ejectors within each group are aligned substantially along the scan direction. Similar to FIG. 7, FIG. 28A shows a group 121 of drop ejectors 111-114 and a group 122 of drop ejectors 115-118 that are perfectly aligned along the scan direction 56. In other words, a line 551 along scan direction 56 passes through the centers of all drop ejectors 111-114 of group 121, and a line 552 along scan direction 56 passes through the centers of all drop ejectors 115-118 of group 122. Line 552 is spaced apart from line 551 by first offset $Y_1$ along array direction 54. FIG. 28B shows a group 121 of drop ejectors 111-114 that are perfectly aligned along the scan direction 56 and a group 122 of drop ejectors 115-118 that are not perfectly aligned along the scan direction 56. A best-fit line 550 along scan direction 56 passes through the centers of drop ejectors 115 and 117. However, the center of drop ejector 118 is offset to the left of best-fit line 550 by displacement $Y_D$ along the scan direction 56, and the center of drop ejector 116 is similarly offset to the right of best-fit line 550. Such displacement can be related to manufacturing tolerances or they can be intentionally designed to occur. Drop ejectors that are fabricated using photolithography and microelectronic fabrication methods can have placement accuracies on the order of one micron in some embodiments. First offset $Y_1$ in some embodiments can be 1/1200 of an inch or about 21 microns. In such embodiments manufacturing tolerances permit alignment of drop ejectors along scan direction 56 to within 10% of first offset $Y_1$. In other embodiments some amount of drop ejector misalignment is designed in order to disguise the effects of misdirectionality, i.e. the deviation of ejected drops from their intended courses such that even perfectly aligned drop ejectors do not provide perfectly aligned dots on the recording media 62. Herein it is said that the drop ejectors in a group are substantially aligned along the scan direction when the maximum displacement $Y_D$ along the array direction of a drop ejector in the group from the best-fit line is less than half the first offset $Y_1$. Since the straightness of lines such as line 351 in FIG. 14 partly depends on having a small maximum displacement, in some embodiments it is preferred for the maximum displacement $Y_D$ to be less than $0.3Y_1$, and in other embodiments it is more preferred for the maximum displacement $Y_D$ to be less than $0.2Y_1$. So-called best-fit lines in general may be calculated in a variety of ways, such as by linear regression by least square fitting for example. FIG. 28C shows a linear regression line 553 that passes through the centers of two drop ejectors 554 and 555. Linear regression line 553 is not what is meant herein by a best-fit line along scan direction 56 because linear regression line 553 is not parallel to scan direction 56. Best-fit line 550 in FIG. 28C extends along scan direction 56. In addition, the best-fit line 550 is defined herein such that the sum of displacements of drop ejectors from best-fit line 550 is zero. In the simple example shown in FIG. 28C, the center of drop ejector 554 has a displacement of $-Y_D$ from best-fit line 550 and the center of drop ejector 555 has a displacement of $+Y_D$ from best-fit line 550, so that the sum of displacements is 0.

Other uses of the word "substantially" herein will next be described. When it is said herein that the drop ejectors within each group are substantially evenly spaced by a distance $X_1$ along the scan direction 56, it is meant that adjacent drop ejectors within the group are spaced by a distance within a range $X_1 \pm 20\%$. When it is said herein that adjacent groups within each bank are substantially evenly spaced apart by first offset $Y_1$ along array direction 54, it is meant that the adjacent groups are spaced by a distance within a range $Y_1 \pm 20\%$. Similarly, when it is said herein that a first endmost group of a first two-dimensional array and a second endmost group of a second two-dimensional array are spaced apart along the array direction by a distance that is substantially equal to the first offset $Y_1$, it is meant that they are spaced by a distance within a range $Y_1 \pm 20\%$.

When it is said herein that a first printhead die and a second printhead die are substantially identical, it is meant that their design is the same, but they can have differences due to manufacturing tolerances. Similarly when it is said herein that a two-dimensional array is substantially identical to another two-dimensional array it is meant that their design is the same, but they can have differences due to manufacturing tolerances. When it is said that the steps on a first edge of a first printhead die and the steps on an adjacent edge of an adjacent second printhead die are positioned in substantially complementary fashion, it is meant deviations from a complementary fitting of the two edges are less than 20% of a width w of the step feature.

When it is said herein that the recording media is moved relative to the printhead along the scan direction at a substantially constant velocity V, it is meant that during the ejection of drops, either the recording medium is moved past a stationary printhead at a velocity within a range V±20%, or the printhead is moved past a stationary recording medium at a velocity within a range V±20%.

The invention has been described in detail with particular reference to certain preferred embodiments thereof, but it will be understood that variations and modifications can be effected within the spirit and scope of the invention.

PARTS LIST

1 inkjet printing system
2 image data source
3 image processing unit
4 controller
5 electrical pulse source
6 transport mechanism
7 transport control unit
8 ejection control unit
10 base plate
18 nozzle
20 partition wall
22 pressure chamber
24 ink inlet
30 nozzle plate
32 nozzle
35 heater (actuator)
40 half-sized dots
42 overlapping dots
50 printhead
52 linear array
54 array direction
56 scan direction
57*a* reference line (parallel to scan direction)
57*b* reference line (parallel to scan direction)
57*c* reference line (parallel to scan direction)
57*d* reference line (parallel to scan direction)
60 drop ejector
62 recording medium
64 pixel grid
66 allowable dot location
68 pixel row
70 pixel column
80 roll-to-roll printing system
81 source roll
82 take up roll
83 roller
90 carriage printing system
91 carriage path
92 forward direction
93 reverse direction
94 media advance
100-*kl* nozzle

102 pressure chamber
111 drop ejector
112 drop ejector
113 drop ejector
114 drop ejector
115 drop ejector
116 drop ejector
117 drop ejector
118 drop ejector
120 group
121 group
122 group
123 group
124 group
125 lower drop ejector
126 upper drop ejector
127 direction
128 direction
130 bank
131 bank
132 bank
140 column
141 column
142 column
143 column
144 column
150 two-dimensional array
151 two-dimensional array
152 two-dimensional array
153 two-dimensional array
154 two-dimensional array
160 driver circuitry
161 driver transistor
170 addressing circuitry
171 address line
172 address line
173 address line
174 address line
175 sequencer
180 electrical lead
191 first endmost group
192 second endmost group
201 substrate
202 top side
203 bottom side
209 non-butting edge
210 printhead module
211 array
212 first drop ejector
213 second drop ejector
214 butting edge
215 printhead die
216 printhead die
217 second printhead die
220 ink feed
221 slot
230 electrical circuitry
240 electrical contact
250 pixel grid
251 boundary line
290 first ink source
291 second ink source
300 pixel location
301 first dot
302 second dot
303 third dot
304 fourth dot
308 eighth dot.
311 first position (first stroke)
312 second position (first stroke)
318 eighth position (first stroke)
351 line of dots
352 line of dots
353 line of dots
354 line of dots
360 portion of array
361 nozzle set (cyan)
362 nozzle set (magenta)
363 nozzle set (yellow)
364 address circuitry
365 bond pads
368 nozzle
401 allowable dot positions (first odd stroke)
411 first odd dot (first odd stroke)
412 second odd dot (first odd stroke)
413 third odd dot (first odd stroke)
414 fourth odd dot (first odd stroke)
415 fifth odd dot (first odd stroke)
416 sixth odd dot (first odd stroke)
417 seventh odd dot (first odd stroke)
418 eighth odd dot (first odd stroke)
421 first even dot (first even stroke)
422 second even dot (first even stroke)
423 third even dot (first even stroke)
424 fourth even dot (first even stroke)
431 first odd dot (second odd stroke)
432 second odd dot (second odd stroke)
433 third odd dot (second odd stroke)
434 fourth odd dot (second odd stroke)
441 first even dot (second even stroke)
451 first dot (first stroke)
452 second dot (first stroke)
461 first dot (second stroke)
463 third dot (second stroke)
464 fourth dot (second stroke)
465 fifth dot (second stroke)
471 first dot (third stroke)
473 third dot (third stroke)
477 seventh dot (third stroke)
481 first dot (fourth stroke)
501 first dot
502 second dot
511 printhead die
512 printhead die
521 printhead die
522 printhead die
531 printhead die
532 printhead die
533 butting edge
534 butting edge
535 step
536 step
550 best fit line along scan direction
551 line
552 line
553 linear regression line
554 drop ejector
555 drop ejector
$D_x$ pixel grid spacing in scan direction
$D_y$ drop ejector spacing
f drop ejection frequency
G gap spacing
L length
P dot spacing p scan direction pitch
$R_x$ resolution in the scan direction
$R_y$ resolution in the array direction
S array spacing
$t_n$ time at the start of the nth printing cycle
$t_S$ time at the start of the next stroke
V velocity
W width
w step width
X scan axis
$X_1$ drop ejector spacing along scan direction
Y array axis
$Y_1$ first offset
$Y_D$ displacement

The invention claimed is:

1. An inkjet printhead comprising:

a two-dimensional array of drop ejectors arranged as a plurality of columns, each column including a plurality of banks, and each bank including a plurality of groups that each include a plurality of drop ejectors, wherein all of the drop ejectors in each bank are members of the plurality of groups in that bank, wherein the drop ejectors in each group are substantially aligned along a first direction, wherein the groups in each bank are spaced from each other along the first direction and are offset from each other along a second direction, wherein the banks in each column are spaced from each other along the first direction and are offset from each other along the second direction, wherein the columns are offset from each other along the second direction, wherein the two-dimensional array has a width W along the first direction and a length L greater than W along the second direction, and wherein each drop ejector in the two-dimensional array includes:

a nozzle;

an ink inlet that is configured to be in fluidic communication with a first ink source;

a pressure chamber in fluidic communication with the nozzle and the ink inlet; and an actuator configured to selectively pressurize the pressure chamber for ejecting ink through the nozzle.

2. The inkjet printhead of claim 1 further comprising:

driver circuitry, wherein the actuator of each drop ejector is electrically connected to the driving circuitry for energizing the actuator, and addressing circuitry for selectively energizing the actuators of the drop ejectors by the driver circuitry.

3. The inkjet printhead of claim 2, wherein the address circuitry includes a plurality of address lines, wherein each drop ejector in a bank is connected to a different address line of the addressing circuitry, and wherein each address line of the addressing circuitry is connected to one drop ejector in a corresponding location in each group in each bank.

4. The inkjet printhead of claim 2, wherein the addressing circuitry is configured to selectively address the driving circuitry for energizing the actuators in either a first sequence or a second sequence that is opposite to the first sequence.

5. The inkjet printhead of claim 1, wherein the first direction is perpendicular to the second direction.

6. The inkjet printhead of claim 1, wherein each group includes a first number of drop ejectors, and wherein each bank includes a second number of groups, and wherein each column includes a third number of banks.

7. The inkjet printhead of claim 6, wherein the first number is an even number.

8. The inkjet printhead of claim 1, wherein the drop ejectors within each group are substantially evenly spaced by a distance $X_1$ along the first direction.

9. The inkjet printhead of claim 8, wherein a spacing along the first direction between nearest neighbor drop ejectors of adjacent groups in a bank is equal to $X_1$.

10. The inkjet printhead of claim 9, wherein a spacing along the first direction between nearest neighbor drop ejectors of a first bank and an adjacent second bank in a column is greater than or equal to $X_1$.

11. The inkjet printhead of claim 10, wherein the spacing along the first direction between the nearest neighbor drop ejectors of the first bank and the adjacent second bank in the column is greater than $X_1$, and wherein an electrical lead is disposed between the first and second banks.

12. The inkjet printhead of claim 8, wherein adjacent columns in the two-dimensional array are displaced along the first direction by a distance $m*X_1$, where m is an integer.

13. The inkjet printhead of claim 1, wherein adjacent groups within each bank are substantially evenly spaced apart by a first offset along the second direction, and wherein the nearest adjacent groups in adjacent banks in each column are spaced apart by the first offset along the second direction.

14. The inkjet printhead of claim 13, wherein a smallest spacing along the second direction between a first group in a first column and a second group in an adjacent second column is equal to the first offset.

15. The inkjet printhead of claim 13, wherein the drop ejectors in each group are disposed in relation to a corresponding best-fit line along the first direction corresponding to that group, wherein a maximum displacement of a drop ejector in the group from the best-fit line in the second direction is less than half of the first offset.

16. The inkjet printhead of claim 1, the two-dimensional array being a first two-dimensional array of first drop ejectors, the inkjet printhead further comprising at least a second two-dimensional array of second drop ejectors that is separated from the first two-dimensional array along the first direction.

17. The inkjet printhead of claim 16, wherein each of the second drop ejectors includes an ink inlet that is configured to be in fluidic communication with a second ink source that is different from the first ink source.

18. The inkjet printhead of claim 16, wherein the second drop ejectors have a different structure than the first drop ejectors.

19. The inkjet printhead of claim 1 further including at least a first die and a substantially identical second die that is displaced along the second direction from the first die, wherein the two-dimensional array includes a first two-dimensional array of drop ejectors disposed on the first die and a substantially identical two-dimensional array of drop ejectors disposed on the second die, and wherein each of the drop ejectors in the substantially identical two-dimensional array disposed on the second die includes an ink inlet that is configured to be in fluidic communication with the first ink source.

20. The inkjet printhead of claim 19, the two-dimensional array being a first two-dimensional array of first drop ejectors, the first die and the second die further comprising a second two-dimensional array of second drop ejectors that is separated from the first two-dimensional array along the first direction, wherein each of the second drop ejectors in the second two-dimensional array includes an ink inlet that is configured to be in fluidic communication with a second ink source that is different from the first ink source.

21. The inkjet printhead of claim 19, wherein adjacent groups within each bank are substantially evenly spaced apart by a first offset along the second direction, and wherein a first endmost group of the first two-dimensional array and a second endmost group of the substantially identical two-dimensional array are spaced apart along the second direction by a distance that is substantially equal to the first offset.

22. The inkjet printhead of claim 21, wherein a first edge of the first die and an adjacent second edge of the second die include steps, and wherein the steps on the first edge and the steps on the second edge are positioned in substantially complementary fashion.

23. The inkjet printhead of claim 1 further including at least a first die and a substantially identical second die that is displaced along the second direction from the first die and is spaced apart from the first die, wherein the two-dimensional array includes a first two-dimensional array of drop ejectors disposed on the first die and a substantially identical two-dimensional array of drop ejectors disposed on the second die, and wherein the drop ejectors on the first die includes an ink inlet that is configured to be in fluidic communication with the first ink source and the drop ejectors on the substantially identical second die includes an ink inlet that is configured to be in fluidic communication with a second ink source that is different from the first ink source.

24. An inkjet printing system comprising:

an ink source;

a printhead including:

a two-dimensional array of drop ejectors arranged as a plurality of columns, each column including a plurality of banks, and each bank including a plurality of groups that each include a plurality of drop ejectors, wherein all of the drop ejectors in each bank are members of the plurality of groups in that bank, wherein the drop ejectors in each group are substantially aligned along a first direction, and wherein the groups in each bank are spaced from each other along the first direction and are offset from each other along a second direction, and wherein the banks in each column are spaced from each other along the first direction and are offset from each other along the second direction, and wherein the columns are offset from each other along the second direction; and circuitry for selectively ejecting ink from the drop ejectors:

a transport mechanism for providing relative motion between the printhead and a recording medium along a scan direction that is substantially parallel to the first direction;

an image data source for providing image data; and a controller including:

an image processing unit;

a transport control unit; and an ejection control unit for ejecting ink drops to print a pattern of dots corresponding to the image data on the recording medium, such that the plurality of drop ejectors in a first group are configured to cooperatively print a first set of dots that are disposed linearly along the scan direction.

25. The inkjet printing system of claim 24, a second group of drop ejectors being offset from the first group by a first distance along a second direction perpendicular to the first direction, wherein the plurality of drop ejectors in the second group are configured to cooperatively print a second set of dots that are disposed linearly along the scan direction and separated from the first set of dots by the first distance along the second direction.

26. An inkjet printhead comprising:

a two-dimensional array of drop ejectors arranged as a plurality of columns, each column including a plurality of banks, and each bank including a plurality of groups that each include a plurality of drop ejectors, wherein the drop ejectors in each group are substantially aligned along a first direction, wherein the groups in each bank are spaced from each other along the first direction and are offset from each other along a second direction, wherein the drop electors within each group are substantially evenly spaced by a distance $X_1$ along the first direction, wherein a spacing along the first direction between nearest neighbor drop ejectors of adjacent groups in a bank is equal to $X_1$, wherein the banks in each column are spaced from each other along the first direction and are offset from each other along the second direction, wherein the columns are offset from each other along the second direction, wherein the two-dimensional array has a width W along the first direction and a length L greater than W along the second direction, and wherein each drop ejector in the two-dimensional array includes:

a nozzle;

an ink inlet that is configured to be in fluidic communication with a first ink source;

a pressure chamber in fluidic communication with the nozzle and the ink inlet; and an actuator configured to selectively pressurize the pressure chamber for ejecting ink through the nozzle.

27. An inkjet printhead comprising:

a two-dimensional array of drop ejectors arranged as a plurality of columns, each column including a plurality of banks, and each bank including a plurality of groups that each include a plurality of drop ejectors, wherein the drop ejectors in each group are substantially aligned along a first direction, wherein the groups in each bank are spaced from each other along the first direction and are offset from each other along a second direction, wherein the banks in each column are spaced from each other along the first direction and are offset from each other along the second direction, wherein adjacent groups within each bank are substantially evenly spaced apart by a first offset along the second direction, wherein the nearest adjacent groups in adjacent banks in each column are spaced apart by the first offset along the second direction, wherein the columns are offset from each other along the second direction, wherein a smallest spacing along the second direction between a first group in a first column and a second group in an adjacent second column is equal to the first offset, wherein the two-dimensional array has a width W along the first direction and a length L greater than W along the second direction, and wherein each drop ejector in the two-dimensional array includes:

a nozzle;

an ink inlet that is configured to be in fluidic communication with a first ink source;

a pressure chamber in fluidic communication with the nozzle and the ink inlet; and an actuator configured to selectively pressurize the pressure chamber for ejecting ink through the nozzle.

* * * * *